US007446084B2

(12) United States Patent
Barthel et al.

(10) Patent No.: US 7,446,084 B2
(45) Date of Patent: Nov. 4, 2008

(54) PROCESS FOR MANUFACTURING MULTI-PHASE DETERGENTS OR CLEANING AGENTS IN A WATER-SOLUBLE CONTAINER

(75) Inventors: Wolfgang Barthel, Langenfeld (DE); Salvatore Fileccia, Oberhausen (DE); Arno Düffels, Düsseldorf (DE); Maren Jekel, Willich (DE); Birgit Burg, Alpen (DE)

(73) Assignee: Henkel Kommanditgesellschaft auf Aktien, Dusseldorf (DE)

( * ) Notice: Subject to any disclaimer, the term of this patent is extended or adjusted under 35 U.S.C. 154(b) by 0 days.

(21) Appl. No.: 11/645,326

(22) Filed: Dec. 22, 2006

(65) Prior Publication Data

US 2007/0167340 A1 Jul. 19, 2007

Related U.S. Application Data

(63) Continuation of application No. PCT/EP2005/006290, filed on Jun. 11, 2005.

(30) Foreign Application Priority Data

Jun. 23, 2004 (DE) ..... 10 2004 030 318

(51) Int. Cl.
*C11D 17/04* (2006.01)

(52) U.S. Cl. ..... 510/296; 510/438; 510/439; 510/446

(58) Field of Classification Search ..... 510/296, 510/438, 439, 446
See application file for complete search history.

(56) References Cited

U.S. PATENT DOCUMENTS 6,448,212 B1 * 9/2002 Holderbaum et al. ..... 510/296
6,521,581 B1 * 2/2003 Hsu et al. ..... 510/297

FOREIGN PATENT DOCUMENTS

| | | | |
|---|---|---|---|
| DE | 2358382 A | * | 7/2001 |
| EP | 1314654 | | 2/2000 |
| EP | 1256623 | | 5/2001 |
| GB | 2391532 | | 2/2004 |
| WO | WO 93/08095 | | 4/1993 |
| WO | WO 01/83657 | | 11/2001 |
| WO | WO 01/85898 | | 11/2001 |
| WO | WO 02/42401 | | 5/2002 |
| WO | WO 02/053696 | | 7/2002 |
| WO | WO 02/085736 | | 10/2002 |
| WO | WO 02/085738 | | 10/2002 |

OTHER PUBLICATIONS

Römpp Chemie Lexikon, 1990, p. 2507, 9th edition, Georg Thieme, Stuttgart, New York.
Römpp Chemie Lexikon, 1991, p. 3168; 9th edition, Georg Thieme, Stuttgart, New York.
Römpp Chemie Lexikon, 1991, p. 4440, 9th Edition, vol. 6, Georg Thieme, Stuttgart, New York.
Voigt "Lehrbuch der pharmazeutischen Technologie" Textbook of pharmaceutical technology, 6th Edition, 1987, pp. 182-184, 1987.

* cited by examiner

*Primary Examiner*—Lorna M Douyon
(74) *Attorney, Agent, or Firm*—John S. Child, Jr.

(57) ABSTRACT

A method for the production of multi-phase detergents or cleaning agents, comprising the production of a water-soluble or water-dispersible container; the filling of said container with detergents or cleaning agents; application of a separating layer and filling of said container with other detergents or cleaning agents. The method is characterized in that a liquid separating agent is applied in order to form the separating layer, said agent solidifying in order to form the separating layer; the amount of packaging material used is reduced and the number of method steps is also reduced. the invention is further characterized by optimized use of space in the packaging body.

12 Claims, No Drawings

PROCESS FOR MANUFACTURING MULTI-PHASE DETERGENTS OR CLEANING AGENTS IN A WATER-SOLUBLE CONTAINER

CROSS-REFERENCE TO RELATED APPLICATIONS

This application is a continuation under 35 U.S.C. § 365(c) and 35 U.S.C. § 120 of International Application No. PCT/EP2005/006290, filed Jun. 11, 2005. This application also claims priority under 35 U.S.C. § 119 of German Patent Application No. DE 10 2004 030318.5, filed Jun. 23, 2004. Both the International Application and the German Application are incorporated herein by reference in their entireties.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

Field of the Invention

The present invention relates to a process for manufacturing multi-phase detergents and cleaning agents. In particular, this invention relates to a process that enables the provision of multi-phase detergents and cleaning agents in the form of unit doses that comprise a water-soluble or water-dispersible container.

Nowadays, detergents or cleaning agents are available to the consumer in a variety of commercial forms. In addition to washing powders and granulates, this range also includes, for example, cleaning agent concentrates in the form of extruded or tableted compositions. These solid, concentrated or densified commercial forms are characterized by a reduced volume per unit of dose and thereby lower the transport and packaging costs. In particular, such detergent or cleaning agent tablets also fulfill the wish of the consumer for easy dosing. Such agents are extensively described in the prior art. In addition to the cited advantages, however, compacted detergents or cleaning agents possess a number of disadvantages. In particular, products in the form of tablets, due to their high densification, are often prone to a delayed disintegration and thereby a delayed release of their ingredients. To solve this "conflict" between adequate tablet hardness and short disintegration times, numerous technical solutions have been disclosed in the patent literature, wherein here, reference can be made, for example, to the use of tablet disintegrators. These disintegration accelerators are added to the tablets in addition to the active detergent and cleaning substances, and generally do not possess any active detergent or cleaning properties and therefore increase the complexity and the costs of these agents. A further disadvantage of tableting mixtures of active substances, particularly mixtures comprising active detergent or cleansing substances, is that the pressure exerted during tablet compaction can inactivate the active substances. Tableting creates much greater contact surfaces of the ingredients with the result that chemical reactions can inactivate the active substances.

In recent years, solid or liquid detergents or cleaning agents having a water-soluble or water-dispersible packaging have been increasingly described as an alternative to the above-mentioned particulate or compacted detergents or cleaning agents. Like tablets, these agents are characterized by simpler dosing because they can be dosed along with the surrounding packaging into the washing machine or the automatic dishwasher. Secondly, however, at the same time they also allow detergents or cleaning agents in liquid or powder form to be packaged, resulting in better dissolution and faster efficiency than the compacted forms.

Thus, European Patent Application EP 1 314 654 A2 (Unilever) discloses a dome-shaped pouch with a receiving chamber that contains a liquid. The container can be manufactured by the thermoforming process.

In addition to the packaging types that only have one receiving chamber, other product forms that include more than one receiving chamber or more than one conditioned form, have been disclosed in the prior art.

On the other hand, Published International Application WO 01/83657 A2 (Procter & Gamble) discloses pouches that comprise a solid and a liquid component, wherein the liquid component is sealed into an individual pouch that is then sealed, together with the solid component, into an additional pouch. The pouch is manufactured by the deep drawing process.

The subject of European Patent Application EP 1 256 623 A1 (Procter & Gamble) is a kit of at least two pouches with a different composition and a different visual appearance. The pouches are separate from each other and are not present as a compact single product.

A pouch made of water-soluble or water-dispersible material, which has two receiving chambers, and is suitable, for example, for packaging toxic substances, is disclosed in Published International Application WO 93/08095 A1 (Rhone-Poulenc). The pouches can be manufactured by the thermoforming process.

Published International Application WO 02/42401 A1 (Procter & Gamble) claims a method for the automatic cleaning of tableware involving the use of a container having a plurality of receiving chambers. The receiving chambers are arranged horizontally in the corresponding containers and are manufactured by sequential sealing of individual films, wherein individual films, processed and shaped by deep drawing, can also be employed.

The subject of Published International Application WO 02/85738A1 (Reckitt Benckiser) is water-soluble containers having at least two receiving cavities. These containers are manufactured by the stepwise sealing of individual films or prefabricated single compartments to the final container.

Published International Application WO 02/85736 A1 (Reckitt Benckiser) describes water-soluble containers having at least two receiving chambers. The receiving chambers can be manufactured by injection molding or deep drawing and are designed in such a way that the sealed chambers can be fixed together by folding them in a mirror image arrangement.

The products from the packaging processes described in the prior art, especially from the disclosed injection molding processes, are characterized by a large quantity of packaging material. Generally, due to the material employed for the separation walls, the proportion of packaging material in deep drawn or injection molded packaging increases with the number of receiving chambers separated from one another and comprised in the packaging. As, in particular, the separation of the receiving chambers made by the deep drawing processes known from the prior art results from the addition of spacers or struts, over which a deformable film is drawn, the resulting products generally have a "volume loss" that corresponds to the volume of the spacer or strut and forms the interstitial space between the receiving chambers that are separated from one another. These volume losses diminish the stability of the packaged end product.

The objective of the present invention is to provide a process for manufacturing multi-phase detergents and cleaning agents with water-soluble or water-dispersible packaging, thus minimizing both the quantities of the employed water-soluble or water-dispersible materials as well as being able to reduce the number of process steps in comparison with processes known from the prior art. The process should enable a reduction in production costs of multi-phase detergents and cleaning agents together with adequate stability of the end products of the process, wherein the end products of the process should be visually appealing. Moreover, the end product of the process should be characterized by an optimized utilization of space in the packaging as well as an increased stiffness and transport or storage stability of the resulting container.

BRIEF SUMMARY OF THE INVENTION

It has now been determined that the above objectives are achieved for manufacturing the multi-phase portions of detergents and cleaning agents when a water-soluble or water-dispersible container is produced which is filled with a first detergent or cleaning agent to form a first phase. Then a liquid separation agent that will harden to a parting layer is introduced onto this phase and in the last step the container is filled with a second detergent or cleaning agent to form a second phase.

The subject matter of the present invention is a process for manufacturing multi-phase detergents or cleaning agents, comprising the steps:

a) manufacturing a water-soluble or water-dispersible container;
b) filling the container with a first detergent or cleaning agent to form a first phase;
c) applying a liquid separation agent onto this first phase and hardening the separation agent to form a parting layer; and
d) filling the container with a second detergent or cleaning agent to form a second phase.

The subject matter of the present application is also a multi-phase detergent or cleaning agent, comprising a) a water-soluble or water-dispersible container made of a first water-soluble or water-dispersible wrapping material; and
b) at least two phases of detergents or cleaning agents, which are separated from one another, arranged beside and/or one on top of the other, and which are separated from one another by a separation layer made of a hardened, liquid separation agent.

BRIEF DESCRIPTION OF THE SEVERAL VIEWS OF THE DRAWING(S)

Not Applicable

DETAILED DESCRIPTION OF THE INVENTION

Providing the Container According to Point a)

In principle, the water-soluble or water-dispersible containers manufactured in the inventive process can be made by any technique described in the prior art. However, in the inventive process, particularly preferred containers are manufactured by the deep drawing process, the injection molding process or the melt casting process.

The terms "below" and "above" are used in the following observations in regard to the container, individual receiving chambers of the container or the separation layer(s) provided that this helps to clarify the subject matter of the application. The floor of the container manufactured in step a) is called the "under-side" of the container. A first receiving chamber or separation layer that, relative to an additional receiving chamber or separation layer, is located between the floor and this additional receiving chamber or separation layer, is therefore located "below" this additional receiving chamber or separation layer, whereas the additional receiving chamber or separation layer is arranged "above" the first receiving chamber or separation layer.

Deep Drawing Process.

In the context of the present application, "deep drawing" or "deep drawing processes" are those processes for finishing packaging materials, in which said materials, after an optional pre-treatment with heat and/or solvents, and/or conditioning under relative air humidities and/or temperatures that are different from the surrounding conditions, are shaped by means of a suitably shaped female mold. The packaging material can be introduced as, for example, a sheet or film, between both parts of the tool—the positive and the negative—and by pressing both of these parts together, can be shaped; however, the shaping can also result without the use of a negative tool, by the action of a vacuum and/or compressed air and/or the weight of the confined detergent or cleaning agent itself.

The deep drawing process can be sub-divided into two methods, one in which the external coating material is fed horizontally into a mold and from there fed horizontally to filling and/or sealing and/or cutting, and processes, in which the external coating material is fed over a continuously circulating matrix shaping roll (optionally with a counter-rotating stamping shaping roll, which leads the upper shaping stamps into the cavities of the matrices' shaping roll). The first mentioned process variant, the flatbed process, is driven both continuously and discontinuously. The second process variant with the shaping rolls is usually continuous. All known deep drawing processes are suitable for manufacturing the preferred agents according to the invention. The receiving cavities in the matrices can be arranged "in line" or offset.

From the range of described deep drawing processes, those processes are preferred, in which the first wrapping material in the form of a film is placed above a female mold provided with cavities, and by the action of compressed air on the upper side of the film or by the action of a vacuum on the lower side of the film, particularly preferably under the simultaneous action of compressed air and a vacuum, is brought into the cavities of the female mold and shaped to correspond to the shape of the cavity. Particularly advantageous processes are those wherein the film is pre-treated by the action of heat and/or solvents prior to shaping. In a further preferred variant of the process, a film, after optional pre-treatment (solvent, heat), is pressed into the cavity of a female mold and molded by the action of a punch and/or the weight of the filling material.

In the inventive process, a container with one, preferably two, three, four or more receiving chambers is manufactured by deep drawing.

The action of heat and/or solvents on the wrapping material serves to facilitate its plastic deformation. For this, the wrapping material can be heated, for example, by radiated heat, hot air or, particularly preferably by direct contact with a hot plate. Alternatively, the wrapping material can also be heated by means of heated rollers or cylinders. The duration of the heat treatment as well as the temperature of the radiated heat, hot air or the surfaces of the hot plates is naturally dependent on the type of the wrapping material that is used. A temperature between 90° C. and 130° C., in particular, between 105° C. and 115° C., is preferred for water-soluble or water-dispersible materials like PVA-containing polymers or copolymers. The duration of the heat treatment, in particular, the contact time when using a hot plate, preferably ranges between 0.1 and 7 seconds, particularly preferably between 0.2 and 6 seconds and especially between 0.3 and 4 seconds. Contact times below one second, in particular, in the range 400 to 900 milliseconds, preferably between 500 and 800 milliseconds, have proven to be particularly advantageous for polyvinyl alcohol materials.

There are various possibilities to obtain a contact between the wrapping material to be deformed and the hot plates. Thus, for example, the wrapping material can be led between two plates that are facing opposite each other, of which at least one serves as the hot plate, and the material is brought into direct contact with their surfaces by raising and/or lowering one of these plates. Alternatively, the wrapping material can also be led under or over a heated surface and be blown onto the surface by compressed air.

When hot plates are employed to heat the wrapping material, then the preferably film-forming wrapping material can be heated evenly over the complete film surface or unevenly by means of a targeted heating. In a preferred embodiment of the inventive process, the targeted heating is effected by means of hot spots located in the hot plates.

The hot spots located in the hot plates can be planar, concave or convex in shape. If the hot spots are convex or concave, then the ratio of the maximum diameter of the hot spot to its maximum height is preferably greater than 2, particularly preferably greater than 4 and particularly greater than 8.

The above described targeted heating produces a grid or lattice of non-heated and less elastic film material on the film that will be processed, which avoids an unwanted deformation and stretching of the film material in the region between the heated film parts, for example, due to its own film weight or the applied tensions during the film transport. The spatial orientation of the receiving basins to each other and the spatial orientation of the receiving basins within the film are stabilized in this manner, such that the receiving basins are located in the intended positions during further transportation for filling, sealing and separation, thus avoiding any incorrect filling, sealing or separation.

The above described application of a vacuum on the inner side of the cavity of the female mold during the shaping of the film has the advantage that the air, located in the cavity below the wrapping material being molded, is easily removed and the molded wrapping material can be retained in the molded state. Continuous deep drawing processes, i.e. processes on a circulating endless female mold on which the molded receiving chambers remain in the cavities of the mold for filling and/or sealing or even for cutting out, are preferred, wherein the receiving chambers formed in the cavities are held there in their molded state by means of a vacuum that is applied during the molding step and sustained until the end of the filling step, preferably to the end of the sealing step, particularly preferably to when the chambers are cut out of the film grid. In discontinuous processes, i.e. processes in which the film transport is periodically interrupted and the shaped wrapping material is removed from the cavities of the mold prior to filling and then transported into a filling station, it is preferred that the preformed containers in the filling station are held in identical or spatially similar loading shapes to the mold cavities or these cavities in which a vacuum is applied before and/or during and/or after filling in order to retain the shape of the preformed receiving chambers and to prevent any shrinkage and/or creasing, for example. The vacuum should be chosen such that the receiving chambers formed from the flat film retain their shape, the corresponding wrapping material is not damaged by the effects of the vacuum, and any spillage of the active substance(s) filled into the receiving chambers due to shrink-back of the receiving chambers is avoided. The exact level of vacuum depends, inter alia, on the type of the wrapping material used or its wall thickness. However, a vacuum is typically in the region of 0.01 to 1 bar, preferably 0.1 to 0.8 bar, particularly preferably between 0.2 and 0.6 bar.

Injection Molding Process.

Other than by deep drawing, the water-soluble or water-dispersible containers can also be manufactured by injection molding.

Injection-molding means converting a molding material in such a way that material required for more than one injection cycle is heated in a barrel to plastically soften it. It then flows, under pressure, through a die into the cavity of an already closed mold.

The process is principally used for non-crosslinkable molding materials, which solidify by cooling down in the mold (thermoplastics). Thermosets and elastomers can also be processed; however, in this case the mold is electrically heated to cure or vulcanize the injected material.

Injection molding is a very efficient modern process for manufacturing molded objects and is particularly suitable for automated mass-production. In practical operation, the thermoplastic molding materials (powder, pellets, diced forms, pastes, inter alia) are heated until liquid (to 180° C.) and then injected under high pressure (up to 140 MPa) into a preferably water-cooled, closed, two-piece mold, consisting of a cavity (earlier a matrix) and core (earlier stamp), where they cool and solidify. Plunger and screw injection molding machines are suitable. Water-soluble polymers, such as, for example, cellulose ethers, pectins, polyethylene glycols, polyvinyl alcohols, polyvinyl pyrrolidones, alginates, gelatines or starches are suitable molding materials (injection molding materials). The preferred molding materials in the inventive process for manufacturing the water-soluble or water-dispersible container are described further below.

In the inventive process, an open hollow body comprising one, preferably two, three, four or more receiving chambers is manufactured by injection molding.

When the molding material has been injected into the mold, shrinking of the cooled molding is preferably compensated by the application of a follow-on pressure. The cooling phase, which can last between 1 and 30 seconds, preferably between 1.5 and 25 seconds, particularly preferably between 1.7 and 20 seconds and especially between 2 and 15 seconds, is followed by the ejection of the molded object.

An advantage of the injection molding process is that the wall thicknesses of the containers manufactured in the inventive process can be specifically chosen. In this way, it is possible to guarantee a lowest possible consumption of wrapping material for optimized container stability. In contrast to deep drawing processes, the containers can also be manufactured with constant wall thicknesses, thereby affording an increased stability and also an improved storage and transportability. Normally, the wall thicknesses of injection molded containers are greater than 100 μm, preferably greater than 200 μm, particularly preferably between 250 and 1,000

μm, quite particularly preferably between 300 and 800 μm and especially between 350 and 700 μm.

Because the choice of the mold tooling is unlimited, it is also possible, and preferred, in this process to introduce a sign and/or lettering/logo by the injection molding process on the side of the water-soluble or water-dispersible container that is visible to the consumer and hence to increase the recognition value of the product. The end product is also visually enhanced when a transparent or translucent wrapping material is used. This embodiment is particularly preferred.

Melt Casting Process.

In a third preferred embodiment of the inventive process, the melt casting process is employed to manufacture the water-soluble or water-dispersible container. Melt casting means converting a molding material in such a way that material required for preferably more than one melt casting cycle is heated in a cylinder to plastically soften it. It then flows into the cavity of a mold which is already closed.

As in injection molding, the process is also preferably used for non-crosslinkable molding materials, which solidify by cooling down in the mold (thermoplastics). Thermosets and elastomers can also be processed; however in this case the mold is electrically heated to cure or vulcanize the injected material.

In the preferred process, the molding materials are cast and subsequently solidify to form a dimensionally stable casting. In the context of the present invention, "solidifying" characterizes every curing mechanism that yields a room temperature-solid body from a formable, preferably flowable mixture or a material of this type or a compound of this type, without the need for molding or compaction forces. Thus "solidifying" in the sense of the present invention is, for example, the curing of melts of substances that are solid at room temperature by cooling. In the sense of the present application, "solidification processes" are also the curing of formable compounds by delayed water bonding, by evaporation of solvents, by chemical reaction, crystallization etc., as well as the reactive curing of flowable powder mixtures to stable hollow objects.

Preferred castings are manufactured by casting a molding material into a mold tool and then ejecting the solidified cast object to form a (hollow) molded object. "Mold tool" preferably refers to tooling that has cavities that can be filled with castable substances. Tooling of this type can be designed in the form of individual cavities, for example, but also in the form of sheets with a plurality of cavities. In industrial processes the individual cavities or sheet cavities are preferably mounted on horizontally circulating conveyor belts that enable a continuous or discontinuous transport of the cavities, for example, along a series of different work stations (e.g., casting, cooling, filling, sealing, ejection etc.).

The above-mentioned hollow objects are preferably molded by the subsequent impression of a suitably shaped tooling into the flowing molding material. Here, it is particularly preferred that at the moment of impressing the tooling, the viscosity of the molding material has already increased by 1-50%, preferably 1-35%, especially 1-20% in comparison with the viscosity that the molding material had on flowing into the casting mold.

The wall thicknesses of the containers manufactured according to the invention by melt casting processes can be specifically adjusted by the choice of suitable mold tooling, thus enabling an optimization of the stability of the container and thereby the storability and transportability. Preferably, the wall thicknesses of the manufactured containers are greater than 100 μm, preferably greater than 200 μm, particularly preferably between 250 and 1,000 μm, quite particularly preferably between 300 and 800 μm and especially between 350 and 700 μm.

In addition to providing thin-walled containers, melt casting also enables the provision of containers that already comprise active detergent or cleaning agents in the molding material. Preferred castings are manufactured by casting an active detergent or cleaning preparation into a mold tool and then ejecting the solidified cast object to form a (hollow) molded object that is subsequently filled with one or a plurality of detergent or cleaning agent(s). The wall thicknesses of this molded object are preferably between 0.3 and 25 mm, particularly preferably between 0.3 and 15 mm, quite particularly preferably between 0.3 and 10 mm and especially between 0.3 and 5 mm.

Generally, all active detergent or cleaning preparations that can be processed by casting techniques are suitable for processing. The preferred molding materials in the inventive process for manufacturing the water-soluble or water-dispersible container are described further below.

The homogeneity of the casting is increased and thus an optimization of the visual appearance, when the castings, after the molding material has flowed into the mold tool, pass through a downstream tumbling phase. The duration of the tumbling phase is advantageously 1-160 seconds, preferably 2-45 seconds, particularly preferably 3-30 seconds, especially 3-15 seconds.

To dissipate the heat brought into the receiving chamber by the filled product (e.g., melts), it is preferred to cool the molds and the receiving cavities located in these molds. They are advantageously cooled down to temperatures below 20° C., preferably below 15° C., particularly preferably to temperatures between 2 and 14° C. and particularly to temperatures between 4 and 12° C. Preferably, the cooling is continuous from the start of the production of the water-soluble or water-dispersible containers to the sealing and separation of the receiving chambers. Liquid coolants are particularly suitable for cooling; preferably water, which is circulated inside the matrix by means of special cooling ducts.

In the inventive process, an open hollow body (casting) comprising one, preferably two, three, four or more receiving chambers is manufactured by melt casting.

Shape of the Water-Soluble or Water-Dispersible Container.

In preferred embodiments of the inventive process, the container manufactured in step a) comprises one, two, three, four, five or more receiving chambers. They are obtained through the choice of suitable mold tooling when the injection molding process or the melt casting process is used. By using the deep drawing process, containers with a plurality of receiving chambers can be made, for example, by combining several neighboring receiving chambers on the deep drawing mold into one dosing unit or by using deep drawing molds with parts that can be lowered.

In a preferred embodiment of the process according to the invention, the ratio of the height of the container external wall to the height of the partition walls that subdivide the container into several receiving chambers is 1:1, i.e., the container external wall and the partition wall have the same height. If the two, three, four or more receiving chambers in a container of this type are only partially filled in step b), then after applying and curing the liquid separation layer (step c)), the remaining volumes of these receiving chambers remain available for filling with additional detergent and cleaning agents (step d)).

A preferred process for manufacturing multi-phase detergents and cleaning agents comprises the steps:

a) manufacturing a water-soluble or water-dispersible container that comprises preferably three, particularly preferably four, especially five or more receiving chambers;

b) filling the container with the first two, preferably three, particularly preferably four, especially five or more different detergent or cleaning agents;

c) applying a liquid separation agent onto this first detergent and cleaning agent and hardening the separation agent to form a parting layer;

d) filling the container with the additional two, preferably three, particularly preferably four, especially five or more different detergent or cleaning agents.

Likewise preferred is a process in which the ratio of the height of the container external wall to the heights of the partition walls that subdivide the container into several receiving chambers is less than 1:1. In such a container, the partition wall is smaller than the external wall of the container. If the receiving chambers that are separated by the partition wall are essentially completely filled in step b), then after applying and curing the liquid separation layer and sealing these receiving chambers (step c)), there results only one additional receiving chamber that is located above the two, three, four or more receiving chambers filled in step b) and which remains available for filling with an additional detergent and cleaning agent (step d)). The ratio of the height of the container external wall to the heights of the partition walls is preferably between 1:0.2 and 1:1, particularly preferably between 1:0.3 and 1:0.9, quite particularly preferably between 1:0.4 and 1:0.8, especially between 1:0.4 and 1:0.7 and stands in direct proportion to the ratio of the fill height of the detergent or cleaning agent placed below the separation layer to the detergent or cleaning agent placed above the separation layer.

In a further preferred embodiment of the process according to the invention, the container has at least two, preferably three, four or more partition walls, wherein the ratio of the height of the container external wall to the height of at least one of the partition walls is 1:1, whereas the ratio of the height of the container external wall to the height of at least one additional partition walls is between 1:0.2 and 1:1, particularly preferably between 1:0.3 and 1:0.9, quite particularly preferably between 1:0.4 and 1:0.8, especially between 1:0.4 and 1:0.7.

The receiving chambers formed by the deep drawing process, injection molding process or the melt casting process can have any shape that is technically possible. Spherically dome shaped, cylindrical or cubic chambers are particularly preferred. Preferred receiving chambers have at least one edge and one corner, receiving chambers with two, three, four, five, six, seven, eight, nine, ten, eleven, twelve, thirteen, fourteen, fifteen, sixteen, seventeen, eighteen, nineteen, twenty or more edges or two, three, four, five, six, seven, eight, nine, ten, eleven, twelve, thirteen, fourteen, fifteen, sixteen, seventeen, eighteen, nineteen, twenty or more corners are also feasible and inventively preferred. Further feasible and preferred receiving chambers in alternative embodiments of the inventive process have a dome-shaped design. The side walls of the receiving chambers are preferably planar. Side walls that are spatially opposite one another can be both parallel and also not parallel to one another. The base of the receiving chambers can be convex, concave or planar, planar bases being preferred. The base itself can be circular, but can also have corners. Bases with one corner (droplet form), two, three, four, five, six, seven, eight, nine, ten, eleven, twelve, thirteen, fourteen, fifteen, sixteen, seventeen, eighteen, nineteen, twenty or more corners are also preferred in the context of the present application. In preferred embodiments of this application, the transition of the base to the side wall(s) or the transition of the side walls into one another is in a well rounded shape. Consequently, the receiving chambers do not possess any exterior spikes or sharp edges but rather rounded edges.

Accordingly, a preferred inventive process is one wherein the bases of the receiving chambers are planar.

The dimensions and the volume of the receiving chambers and gaps formed by the molding operation are principally orientated to the subsequent application purpose of the resulting container. In a preferred variant of the inventive process, receiving chambers are manufactured having a total volume between 0.1 and 1,000 ml, preferably between 0.2 and 100 ml, particularly preferably between 0.4 and 50 ml, quite particularly preferably between 0.6 and 30 ml, and especially between 0.8 and 10 ml. Here, in a preferred embodiment in the context of the inventive process, the at least two receiving chambers have the same spatial form and an identical volume. In another preferred embodiment, the at least two receiving chambers in the container have different volumes, wherein the ratio of these volumes is preferably between 25:1 and 1.05:1, particularly preferably between 20:1 and 2:1 and quite particularly preferably between 15:1 and 4:1.

In preferred inventive processes, the container has two receiving chambers of different volumes, wherein the volume of the smaller receiving chamber is at least 2%, preferably at least 5%, particularly preferably at least 10% and quite particularly preferably at least 20%, 30%, 40%, 50%, 60%, 65%, 70%, 75% or 80% of the volume of the larger receiving chamber. The volume of the individual chambers is advantageously between 0.05 and 900 ml, particularly preferably between 0.1 and 90 ml, quite particularly preferably between 0.5 and 40 ml and especially between 1.0 and 25 ml.

In a preferred embodiment of the inventive process, the containers have receiving chambers with different depths. There is not necessarily a direct relationship between the chamber depth and the chamber volume. Thus, in a container with two receiving chambers, the shallowest receiving chamber can possibly have a larger chamber volume, while the deeper receiving chamber has a smaller volume. The two or more chambers can also possess the same volume in spite of different chamber depths. However, in the context of the present application, a process is preferred in which the receiving chamber with the smaller chamber depth also has a smaller volume in comparison with the additional receiving chamber(s), wherein in regard to the absolute volumes and the volume ratios, reference is made to the above information.

Containers manufactured according to a preferred inventive process have receiving chambers with vertically sloping side walls. However, particularly preferred containers are those in which the receiving chamber possesses an inclined side wall. In such receiving chambers, the angle between the side wall and an imaginary seal closing the receiving chamber is therefore less than 90°. If the receiving chambers only have a single side wall (cylindrical receiving chambers), then this side wall can have different angles in the corresponding molding of the deep drawing molds or mold tooling used. Preferred receiving chambers are those in which the cited angle is between 30 and 90°, preferably between 35 and 89°, particularly preferably between 40 and 88° and especially between 45 and 87°.

The receiving chamber produced by molding can additionally possess gradations. The suitable receiving chamber manufactured in a preferred process variant does not therefore have plain side walls, but rather has side walls characterized by steps or curves. The number of curves can vary, wherein processes are preferred, in which the number of steps and/or curves in a receiving chamber is maximum 10, advantageously between 1 and 9, particularly preferably between 1 and 8, quite particularly preferably between 2 and 7 and especially between 2 and 6. The steps or curves can be formed around or only on single side walls.

The course of the steps or curves is preferably horizontal. Steps and/or curves with a screw thread resemble upward or downward running paths are, however, also feasible and preferred for certain application areas.

Wrapping Materials.

In general, all wrapping materials that can be processed by deep drawing processes, injection molding processes or melt casting processes can be used in the inventive process, the use of water-soluble or water-dispersible packaging materials being preferred, however.

Several particularly preferred water-soluble or water-dispersible wrapping materials that are suitable for both the manufacture of the receiving chambers, and also their sealing/use as the separation layer, are listed below. The cited polymers can be used as the wrapping material both alone as well as in combination with one another or in combination with further substances, for example, plasticizers, slip agents or lubricants, or solubility enhancers.

a) water-soluble nonionic polymers from the group of the
- a1) polyvinyl pyrrolidones,
- a2) vinyl pyrrolidone/vinyl ester-copolymers,
- a3) cellulose ethers b) water-soluble amphoteric polymers from the group of the
- b1) alkylacrylamide/acrylic acid-copolymers
- b2) alkylacrylamide/methacrylic acid-copolymers
- b3) alkylacrylamide/methyl methacrylic acid-copolymers
- b4) alkylacrylamide/acrylic acid/alkylaminoalkyl(meth) acrylic acid-copolymers
- b5) alkylacrylamide/methacrylic acid/alkylaminoalkyl (meth)acrylic acid-copolymers
- b6) alkylacrylamide/methyl methacrylic acid/alkylaminoalkyl(meth)acrylic acid-copolymers
- b7) alkylacrylamide/alkyl methacrylic acid/alkylaminoethyl methacrylate/alkyl methacrylate-copolymers
- b8) copolymers of
  - b8i) unsaturated carboxylic acids,
  - b8ii) cationically derivatized unsaturated carboxylic acids
  - b8iii) optional additional ionic or nonionic monomers c) water-soluble zwitterionic polymers from the group of the
- c1) acrylamidoalkyl trialkyl ammonium chloride/acrylic acid-copolymers as well as their alkali metal and ammonium salts
- c2) acrylamidoalkyl trialkyl ammonium chloride/methacrylic acid-copolymers as well as their alkali metal and ammonium salts
- c3) methacroylethyl betaine/methacrylate-copolymers d) water-soluble anionic polymers from the group of the
- d1) vinyl acetate/crotonic acid-copolymers
- d2) vinyl pyrrolidone/vinyl acrylate-copolymers
- d3) acrylic acid/ethyl acrylate/N-tert.butylacrylamide-terpolymers
- d4) Grafted polymers of vinyl esters, esters of acrylic acid or methacrylic acid alone or in mixtures, copolymerized with crotonic acid, acrylic acid or methacrylic acid with polyalkylene oxides and/or polyalkylene glycols
- d5) grafted and crosslinked copolymers from the copolymerization of
  - d5i) at least one monomer of the nonionic type,
  - d5ii) at least one monomer of the ionic type,
  - d5iii) polyethylene glycol, and
  - d5iv) a crosslinker
- d6) copolymers obtained by copolymerizing at least one monomer from each of the three following groups:
  - d6i) esters of unsaturated alcohols and short-chain saturated carboxylic acids and/or esters of short-chain saturated alcohols and unsaturated carboxylic acids,
  - d6ii) unsaturated carboxylic acids,
  - d6iii) esters of long-chain carboxylic acids and unsaturated alcohols and/or esters of the carboxylic acids of group d6ii) with saturated or unsaturated, straight-chain or branched $C_{8-18}$ alcohols
- d7) terpolymers of crotonic acid, vinyl acetate and an allyl or methallyl ester
- d8) tetra- and pentapolymers of
  - d8i) crotonic acid or allyloxyacetic acid
  - d8ii) vinyl acetate or vinyl propionate
  - d8iii) branched allyl or methallyl esters
  - d8iv) vinyl ethers, vinyl esters or straight chain allyl or methallyl esters
- d9) crotonic acid copolymers with one or more monomers from the group consisting of ethylene, vinylbenzene, vinyl methyl ether, acrylamide and the water-soluble salts thereof
- d10) terpolymers of vinyl acetate, crotonic acid and vinyl esters of a saturated aliphatic α-branched monocarboxylic acid.

e) water-soluble cationic polymers from the group of the
- e1) quaternized cellulose derivatives
- e2) polysiloxanes with quaternary groups
- e3) cationic guar derivatives
- e4) polymeric dimethyl diallyl ammonium salts and their copolymers with esters and amides of acrylic acid and methacrylic acid
- e5) copolymers of vinyl pyrrolidone with quaternized derivatives of dialkylaminoacrylate and dialkylaminomethacrylate
- e6) vinyl pyrrolidone-methoimidazolinium chloride-copolymers
- e7) quaternized polyvinyl alcohol
- e8) polymers described by the INCI designations Polyquaternium 2, Polyquaternium 17, Polyquaternium 18 and Polyquaternium 27.

Water-soluble polymers in the context of the invention are such polymers that have a solubility higher than 2.5 wt. % in water at room temperature.

In a preferred process variant, the container comprises one or a plurality of water-soluble polymer(s), preferably a material from the group (optionally acetalized) polyvinyl alcohol (PVAL), polyvinyl pyrrolidone, polyethylene oxide, gelatine, cellulose, and their derivatives and mixtures.

"Polyvinyl alcohols" (abbreviation PVAL, sometimes also PVOH) is the term for polymers with the general structure

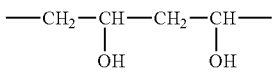

which comprise lesser amounts (approximately 2%) of structural units of the type

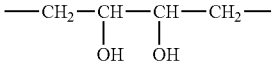

Typical commercial polyvinyl alcohols, which are offered as yellowish white powders or granules having degrees of polymerization in the range of approximately 100 to 2,500 (molar masses of approximately 4,000 to 100,000 g/mol), have degrees of hydrolysis of 98-99 or 87-89 molar % and thus still have a residual acetyl group content. The manufacturers characterize the polyvinyl alcohols by stating the degree of polymerization of the initial polymer, the degree of hydrolysis, the saponification number and/or the solution viscosity.

The solubility in water and in a few strongly polar organic solvents (formamide, dimethylformamide, dimethyl sulfoxide) of polyvinyl alcohols is a function of the degree of hydrolysis; they are not attacked by (chlorinated) hydrocarbons, esters, fats or oils. Polyvinyl alcohols are classified as toxicologically inoffensive and are at least partially biologically degradable. The solubility in water can be reduced by post-treatment with aldehydes (acetalization), by complexing with Ni salts or Cu salts or by treatment with dichromates, boric acid or borax. The coatings of polyvinyl alcohol are substantially impenetrable to gases such as oxygen, nitrogen, helium, hydrogen and carbon dioxide, but do allow water vapor to pass.

In the context of the present invention, it is preferred that the wrapping material used in the inventive process at least partially includes a polyvinyl alcohol whose degree of hydrolysis is 70 to 100 molar %, preferably 80 to 90 molar %, particularly preferably from 81 to 89 molar %, and quite particularly preferably, from 82 to 88 molar %. In a preferred embodiment, the first wrapping material used in the inventive process material consists of at least 20 wt. %, particularly preferably of at least 40 wt. %, quite particularly preferably of at least 60 wt. % and especially of at least 80 wt. % of a polyvinyl alcohol, whose degree of hydrolysis ranges from 70 to 100 molar %, advantageously 80 to 90 molar %, particularly preferably 81 to 89 molar % and quite particularly preferably 82 to 88 molar %.

Preferably, polyvinyl alcohols of a defined molecular weight range are used for the containers, wherein according to the invention it is preferred that the wrapping material includes a polyvinyl alcohol whose molecular weight lies in the range 10,000 to 100,000 $gmol^{-1}$, advantageously from 11,000 $gmol^{-1}$ to 90,000 $gmol^{-1}$, particularly preferably from 12,000 to 80,000 $gmol^{-1}$, and quite particularly preferably, from 13,000 to 70,000 $gmol^{-1}$.

The degree of polymerization of such preferred polyvinyl alcohols lies between approximately 200 to approximately 2,100, preferably between approximately 220 to approximately 1,890, with particularly preferably between approximately 240 to approximately 1,680, and in quite particularly preferably between approximately 260 to approximately 1,500.

The above-described polyvinyl alcohols are widely commercially available, for example, under the trade name Mowiol® (Clariant). Examples of polyvinyl alcohols which are particularly suitable in the context of the present invention are Mowiol® 3-83, Mowiol® 4-88, Mowiol® 5-88, and Mowiol® 8-88.

Further polyvinyl alcohols that are particularly suitable as wrapping materials are to be found in the following table:

TABLE 1

Polyvinyl alcohols suitable as wrapping materials.

| Name | Hydrolysis Degree [%] | Mol Wt [kDa] | Melting point [° C.] |
|---|---|---|---|
| Airvol ® 205 | 88 | 15-27 | 230 |
| Vinex ® 2019 | 88 | 15-27 | 170 |
| Vinex ® 2144 | 88 | 44-65 | 205 |
| Vinex ® 1025 | 99 | 15-27 | 170 |
| Vinex ® 2025 | 88 | 25-45 | 192 |
| Gohsefimer ® 5407 | 30-28 | 23.600 | 100 |
| Gohsefimer ® LL02 | 41-51 | 17.700 | 100 |

Additional polyvinyl alcohols that are suitable as wrapping materials are ELVANOL® 51-05, 52-22, 50-42, 85-82, 75-15, T-25, T-66, 90-50, (trademark of Du Pont), ALCOTEX® 72.5, 78, B72, F80/40, F88/4, F88/26, F88/40, F88/47, (trademark of Harlow Chemical Co.), Gohsenol® NK-05, A-300, AH-22, C-500, GH-20, GL-03, GM-14L, KA-20, KA-500, KH-20, KP-06, N-300, NH-26, NM11Q, KZ-06 (trademark of Nippon Gohsei K.K.).

The water content of PVAL can be modified by post-treatment with aldehydes (acetalization) or ketones (ketalization). Polyvinyl alcohols, which are acetalized or ketalized with the aldehyde or ketone groups of saccharides or polysaccharides or their mixtures, have proved to be particularly preferred and because of their extremely good solubility in cold water, particularly advantageous. The reaction products of PVAL and starch are used most advantageously.

Exemplary suitable water-soluble PVAL films are available under the trade name "SOLUBLON®" from Syntana Handelsgesellschaft E. Harke Gmbh & Co. Their solubility in water can be adjusted exactly. Films of this product series are available which are soluble in aqueous phase over all temperature ranges relevant to each application.

Polyvinyl pyrrolidones, abbreviated "PVP," can be described by means of the general formula:

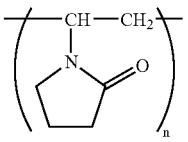

PVP are manufactured by radical polymerization of 1-vinyl pyrrolidone. Commercial PVP have molecular weights in the range 2,500 to 750,000 g/mol and are supplied as white, hygroscopic powders or as aqueous solutions.

Polyethylene oxides, abbreviated to PEOX, are polyalkylene glycols of the general formula $$H—[O—CH_2—CH_2]_n—OH$$

which are manufactured industrially by the base-catalyzed polyaddition of ethylene oxide (oxirane) in systems with the least possible water content with ethylene glycol as the starting molecule. They have molecular weights from approximately 200 to 5,000,000 g/mol, corresponding to degrees of polymerization n of approximately 5 to >100,000. Polyethylene oxides possess an extremely low concentration of reactive hydroxy end groups and show only weak glycol properties.

Gelatine is a polypeptide (molecular weight: approximately 15,000 to >250,000 g/mol) obtained principally by hydrolysis under acidic or alkaline conditions of the collagen present in the skin and bones of animals. The amino acid composition of gelatine corresponds largely to that of the collagen from which it was obtained, and varies as a function of its provenance. The use of gelatine as a water-soluble coating material is extremely widespread, especially in pharmacy, in the form of hard or soft gelatine capsules. Gelatine in the form of films finds only limited use, due to its high price compared with the above cited polymers.

In the context of the present invention, wrapping materials are preferred, which include a polymer from the group starch and starch derivatives, cellulose and cellulose derivatives, particularly methyl cellulose and mixtures thereof.

Starch is a homoglycan in which the glucose units are attached by α-glycoside bonds. Starch is made up of two components of different molecular weight, namely approximately 20-30% straight-chain amylose (molecular weight approximately 50,000 to 150,000) and 70-80% of branched-chain amylopectin (molecular weight approximately 300,000 to 2,000,000,000,000). Small quantities of lipids, phosphoric acid and cations are also present. Whereas the amylose—on account of the bond in the 1,4-position—forms long, helical entwisted chains containing about 300 to 1,200 glucose molecules, the amylopectin chain branches through a 1,6-bond after—on average—25 glucose units to form a branch-like structure containing about 1,500 to 12,000 glucose molecules. In addition to pure starch, starch derivatives obtainable from starch by polymer-analog reactions may also be used in the context of the present invention for the production of water-soluble coatings for the detergent, rinse agent and cleaning agent portions. These chemically modified starches include, for example, products of esterification or etherification reactions in which hydroxy hydrogen atoms have been substituted. However, starches in which the hydroxy groups have been replaced by functional groups that are not attached by an oxygen atom may also be used as starch derivatives. The group of starch derivatives includes, for example, alkali metal starches, carboxymethyl starches (CMS), starch esters and ethers and amino starches.

Pure cellulose has the formal empirical composition $(C_6H_{10}O_5)_n$ and, formally, is a β-1,4-polyacetal of cellobiose that, in turn, is made up of two molecules of glucose. Suitable celluloses consist of approximately 500 to 5,000 glucose units and, accordingly, have average molecular weights of 50,000 to 500,000. In the context of the present invention, cellulose derivatives obtainable from cellulose by polymer-analogous reactions may also be used as cellulose-based disintegrators. These chemically modified celluloses include, for example, products of esterification or etherification reactions in which hydroxy hydrogen atoms have been substituted. However, celluloses in which the hydroxy groups have been replaced by functional groups that are not attached by an oxygen atom may also be used as cellulose derivatives. The group of cellulose derivatives includes, for example, alkali metal celluloses, carboxymethyl cellulose (CMC), cellulose esters and ethers and aminocelluloses.

Meltable substances from the group of the fats and triglycerides and/or fatty acids and/or fatty alcohols and/or waxes and/or paraffins are particularly suitable as the matrix material for castings that are manufactured by melt solidification.

Fat(s) and/or triglyceride(s) is the term for compounds of glycerol, in which the three hydroxyl groups of glycerol are esterified with carboxylic acids. Naturally occurring fats are triglycerides, which generally contain different fatty acids in the same glycerol molecule. Saponification of the fats and subsequent esterification or reaction with acyl chlorides enable synthetic triglycerides to be obtained in which only one fatty acid is present (e.g. tripalmitine, trioleine or tristearine). In the context of the present invention, natural and/or synthetic fats and/or mixtures of both are preferred as the matrix material or matrix component for castings or one of the other cited solids.

In the present application, aliphatic saturated or unsaturated carboxylic acids with branched or unbranched carbon chains are termed fatty acids. There exist a number of production methods to manufacture fatty acids. Whereas lower fatty acids are usually synthesized using oxidative processes starting from alcohols and/or aldehydes and aliphatic or acyclic hydrocarbons, the higher homologs are usually obtained today by saponifying natural fats. Advances in the field of transgenic plants have now provided almost unlimited possibilities for varying the fatty acid spectrum in the stored fats of plant oils. In the context of the present invention, preferred fatty acids have a melting point that permits them to be processed as the material or ingredient of a casting. In this respect, fatty acids with a melting point above 25° C. have proven to be particularly advantageous. Accordingly, preferred matrix materials and/or matrix ingredients are capric acid and/or undecanoic acid and/or lauric acid and/or tridecanoic acid and/or myristic acid and/or pentadecanoic acid and/or palmitic acid and/or margarinic acid and/or stearic acid and/or nonadecanoic acid and/or arachic acid and/or erucic acid and/or elaeosteraric acid. However, fatty acids with a melting point below 25° C. can also be used as components of the matrix for castings or others of the above-mentioned solids.

"Fatty alcohol" is a collective term for linear, saturated or unsaturated primary alcohols having 6 to 22 carbon atoms that were obtained by reducing triglycerides, fatty acids or fatty acid esters. Depending on the manufacturing process, the fatty alcohols can be saturated or unsaturated. Myristyl alcohol and/or 1-pentadecanol and/or cetyl alcohol and/or 1-heptadecanol and/or stearyl alcohol and/or erucyl alcohol and/or 1-nonadecanol and/or arachidyl alcohol and/or 1-heneicosanol and/or behenyl alcohol and/or erucyl alcohol and/or brassidyl alcohol are preferred components of the matrix of castings or others of the solids enclosed by the inventively manufactured containers.

It has also proven advantageous when the solids enclosed in the inventively manufactured containers, in particular, the preferably enclosed castings, comprise waxes as the matrix material. Preferred waxes have a melting region between about 45° C. and about 75° C. In the present case, this means that the melting region starts within the given temperature interval and does not describe the breadth of the melting region. Waxes with a melting region of this type are firstly shape-stable at room temperature but melt at 30° C. to 90° C.—temperatures that are typical for automatic dishwashers and are therefore more easily water-dispersible at these temperatures.

"Waxes" are understood to mean a series of natural or synthetic materials that in general melt without decomposition above 40° C. and already a little above their melting point are of relatively low viscosity and cannot be spun into threads. They exhibit a strongly temperature-dependent consistence and solubility.

Waxes are subdivided into three groups depending on their origin, natural waxes, chemically modified waxes and synthetic waxes.

Natural waxes include, for example, plant waxes, such as candelilla wax, carnauba wax, Japan wax, esparto grass wax, cork wax, guaruma wax, rice germ oil wax, sugarcane wax, ouricury wax, or montan wax, animal waxes, such as beeswax, shellac wax, spermaceti, lanolin (wool wax), or uropygial grease, mineral waxes, such as ceresin or ozokerite (earth wax), or petrochemical waxes, such as petrolatum, paraffin waxes or microcrystalline waxes.

Chemically modified waxes include, for example, hard waxes, such as montan ester waxes, Sasol waxes or hydrogenated jojoba waxes.

Synthetic waxes are generally understood to mean polyalkylene waxes or polyalkylene glycol waxes. Compounds from other substance classes that fulfil the requirements in regard to the softening point can also be employed as the meltable or softenable substances for the mixtures that solidify on cooling. Higher esters of phthalic acid, in particular, dicyclohexyl phthalate, commercially available under the name Unimoll® 66 (Bayer AG), for example, have proven to be suitable synthetic compounds. Synthetic waxes from lower carboxylic acids and fatty alcohols, for example, dimyristyl tartrate, commercially available under the name Cosmacol® ETLP (Condea), are also suitable. On the other hand, synthetic or partially synthetic esters of lower alcohols and naturally sourced fatty acids can also be used. An example of this substance class is Tegin® 90 (Goldschmidt), a glycerine monostearate palmitate. Shellac, for example, Schellack-KPS-Dreiring-SP (Kalkhoff GmbH) can also be used according to the invention as the matrix material in solids, preferably in castings.

In the context of the present invention, the so-called wax alcohols, for example, are also counted as waxes. Wax alcohols are high molecular, water-insoluble fatty alcohols with generally about 22 to 40 carbon atoms. The wax alcohols are found, for example, in the form of wax esters of high molecular fatty acids (wax acids) as the major constituent of many natural waxes. Examples of wax alcohols are lignoceryl alcohol (1-tetracosanol), cetyl alcohol, myristyl alcohol or melissyl alcohol. The coating of the inventively coated solid particles can optionally also comprise wool wax alcohols, which are understood to mean triterpenoid and steroid alcohols, for example, lanolin, which is available, for example, under the trade name Argowax® (Pamentier & Co).

In a further preferred embodiment, one or a plurality of the solids enclosed in the inventively manufactured containers, preferably, however, a casting manufactured by melt solidification, comprise(s) mainly paraffin wax as the matrix material. That means that at least 50 wt. % of the total of the comprised meltable or softenable substances, preferably more, consist of paraffin wax. Particularly suitable paraffin wax contents (based on the total weight of the matrix materials) are about 60 wt. %, about 70 wt. % or about 80 wt. %, wherein even higher proportions of for example, more than 90 wt. % are particularly preferred. In a particular embodiment of the invention, the entire matrix material of one or a plurality of fillers filled into the containers consists of paraffin wax.

In the context of the present invention, paraffin waxes possess an advantage in comparison with the other mentioned natural waxes, in that when the inventively manufactured containers are used as dosage units for detergent and cleaning agents in an alkaline cleaning agent medium, the waxes are not hydrolyzed (as would be expected for wax esters), as paraffin wax does not comprise any hydrolyzable groups.

Paraffin waxes mainly consist of alkanes, together with lower amounts of iso- and cycloalkanes. The inventively utilizable paraffin preferably possesses essentially no components with a melting point of more than 70° C., particularly preferably of more than 60° C.

Preferred solids, particularly castings, comprise at least one paraffin wax with a melting range of 40° C. to 60° C. as the matrix material and/or matrix component.

In the added paraffin wax, the content of alkanes, isoalkanes and cycloalkanes that are solid at the temperature of the surroundings (generally about 10 to 30° C.) is preferably as high as possible. The more solid wax components that are present in a wax at room temperature, the more useful it is in the context of the present invention.

Further advantageous components of the matrix of solids, in particular, of castings, are wax alcohols, i.e. fatty alcohols containing approximately 24-36 carbon atoms, which, in the form of wax esters of higher molecular weight fatty acids (wax acids) are the major component of many natural waxes. Lignoceryl alcohol, ceryl alcohol, myricyl alcohol or melissyl alcohol may be cited as examples of preferred wax alcohols.

Dispersions are particularly suitable for processing as castings, wherein dispersions with active detergent or cleaning active substances or mixtures of active substances are employed with particular preference. In a particularly preferred embodiment of the present invention, the active detergent or cleaning preparation used for the manufacture of the casting, is a dispersion of solid particles in a dispersion agent, wherein particularly preferred dispersions comprise i) 10 to 85 wt. % dispersion agent and ii) 15 to 90 wt. % dispersed materials, based on their total weight.

A dispersion in this application is described as a multiphase system having a continuous phase (dispersion agent) and at least one additionally finely divided phase (dispersed material).

Particularly preferred dispersions are characterized in that they comprise the dispersion agent in quantities above 11% by weight, preferably above 13% by weight, particularly preferably above 15% by weight, quite particularly preferably above 17% by weight, and especially above 19% by weight, each based on the total weight of the dispersion. Furthermore, preferred utilizable dispersions are those, which possess a dispersion containing a weight proportion of dispersion agent above 20 wt. %, preferably above 21 wt. % and particularly above 22 wt. %, each based on the total weight of the dispersion. The maximum content of preferred inventive dispersions in dispersion agents, based on the total weight of the dispersion, is preferably less than 63 wt. %, more preferably less than 57 wt. %, particularly preferably less than 52 wt. %, quite particularly preferably less than 47 wt. % and especially less than 37 wt. %. In the context of the present invention, such active detergent or cleaning preparations are particularly preferred that comprise, based on their total weight, dispersion agents in quantities of 12 to 62 wt. %, preferably 14 to 49 wt. % and particularly 16 to 38 wt. %. Particularly preferred dispersions have a dispersion agent content between 16 and 30 wt. %, preferably between 16 and 26 wt. % and especially between 16 and 22 wt. %, each based on the total weight of the dispersion.

The added dispersion agents are preferably water-soluble or water-dispersible. The solubility of these dispersion agents at 25° C. is here preferably more than 200 g/l, more preferably more than 300 g/l, particularly preferably more than 400 g/l, quite particularly preferably between 430 and 620 g/l and especially between 470 and 580 g/l.

Water-soluble or water-dispersible polymers, particularly the water-soluble or water-dispersible nonionic polymers are preferred dispersion agents in the context of the present invention. The dispersion agents can be both a single polymer and a mixture of different water-soluble or water-dispersible nonionic polymers. In a further preferred embodiment of the present invention, the dispersion agent, or at least 50 wt. % of the polymer mixture, consists of water-soluble or water-dispersible nonionic polymers from the group of polyvinyl pyrrolidones, vinyl pyrrolidone/vinyl ester-copolymers, cellulose ethers, polyvinyl alcohols, polyalkylene glycols, particularly polyethylene glycol and/or polypropylene glycol.

In particular, polyethylene glycols and polypropylene glycols can be considered as the already previously mentioned polyalkylene glycols. Polymers of ethylene glycols satisfy the general formula $$H—(O—CH_2—CH_2)_n—OH$$

wherein n can assume values between 1 (ethylene glycol) and several thousand. There exist different nomenclatures for polyethylene glycols, which can lead to confusion. It is common practice to indicate the mean relative molecular weight after the initials "PEG," so that "PEG 200" characterizes a polyethylene glycol having a relative molecular weight of about 190 to about 210. Cosmetic ingredients are covered by another nomenclature, in which the initials PEG are followed by a hyphen and the hyphen is in turn directly followed by a number that corresponds to the index n in the above formula. Under this nomenclature (so-called INCI nomenclature, CTFA International Cosmetic Ingredient Dictionary and Handbook, $5^{th}$ Edition, The Cosmetic, Toiletry and Fragrance Association, Washington, 1997), PEG-4, PEG-6, PEG-8, PEG-9, PEG-10, PEG-12, PEG-14 and PEG-16 for example, are suitable. Polyethylene glycols are commercially obtainable, for example, under the trade names of Carbowax® PEG 200 (Union Carbide), Emkapol® 200 (ICI Americas), Lipoxol® 200 MED (HULS America), Polyglycol® E-200 (Dow Chemical), Alkapol® PEG 300 (Rhone-Poulenc), Lutrol® E300 (BASF) and the corresponding trade names with higher numbers. The average relative molecular weight of at least one of the dispersion agents added in the inventive detergent or cleaning agents, particularly of at least one of the added polyalkylene glycols, ranges from 200 to 36,000, preferably between 200 and 6,000 and particularly between 300 and 5,000.

Polypropylene glycols (abbreviated PPG) are polymers of propylene glycol, which satisfy the general formula $$H—(O—\underset{\underset{CH_3}{|}}{CH}—CH_2)_n—OH$$

wherein n can assume values between 1 (propylene glycol) and several thousand. In this case the industrially significant representatives are, in particular, di-, tri- and tetrapropylene glycol, i.e., the representatives where n=2, 3 and 3 in the above formula.

Particularly preferably, dispersions are used that comprise a nonionic polymer, preferably a polyalkylene glycol, most preferably a polyethylene glycol and/or a polypropylene glycol, as the dispersion agent, the proportion by weight of the polyethylene glycol to the total weight of all dispersion agents being preferably between 10 and 90 wt. %, particularly preferably between 30 and 80 wt. % and quite particularly preferably between 50 and 70 wt. %. Particularly preferred dispersions are those where the dispersion agent consists of more than 92% by weight, preferably more than 94% by weight, particularly preferably more than 96% by weight, quite particularly preferably more than 98% by weight, and especially 100% by weight of a polyalkylene glycol, preferably polyethylene glycol and/or polypropylene glycol, particularly, however polyethylene glycol. Dispersion agents, which also comprise polypropylene glycol in addition to polyethylene glycol, preferably have a weight proportion ratio of polyethylene glycol to polypropylene glycol between 40:1 and 1:2, preferably between 20:1 and 1:1, particularly preferably between 10:1 and 1.5:1 and especially between 7:1 and 2:1.

Further preferred dispersion agents are the nonionic surfactants that are added alone, particularly preferably, however in combination with a nonionic polymer. Detailed embodiments concerning the nonionic surfactants that can be used are to be found further below in the context of the description of active detergents or cleaning substances.

Preferred added dispersions are characterized in that at least one dispersion agent has a melting point above 25° C., preferably above 35° C. and particularly preferably above 40° C. It is particularly preferred to add dispersion agents having a melting point or a melting range between 30 and 80° C., preferably between 35 and 75° C., particularly preferably between 40 and 70° C., especially between 45 and 65° C., wherein these dispersion agents have a weight proportion, based on the total weight of the added dispersion agents, above 10 wt. %, particularly above 40 wt. %, particularly preferably above 70 wt. % and particularly between 80 and 100 wt. %.

In the context of the present application, suitable dispersed materials are all active detergents or cleaning substances that are solid at room temperature, particularly, however, active detergent or cleaning substances from the group of builders and co-builders, the active detergent and cleaning polymers, bleaching agents, bleach activators, protection agents for glass corrosion and silver, and/or enzymes. A more detailed description of these ingredients is found below.

The water-content of the dispersions that are preferably used in the inventive process, is advantageously less than 30 wt. %, preferably less than 23 wt. %, particularly preferably less than 19 wt. %, quite particularly preferably less than 15 wt. % and especially less than 12 wt. %, based on their total weight. According to the invention, preferred dispersions that are used are low in water or are anhydrous. Particularly preferred dispersions are those comprising a free water content below 10 wt. %, advantageously below 7 wt. %, quite particularly preferably below 3 wt. % and especially below 1 wt. %, based on their total weight.

The dispersions preferably used as the active detergent or cleaning preparation are characterized by a high density. Dispersions with a density above 1.04 g/cm$^3$ are particularly preferably employed. Inventively preferred processes are those wherein the active detergent and cleaning preparation has a density above 1.040 g/cm$^3$, preferably above 1.15 g/cm$^3$, particularly preferably above 1.30 g/cm$^3$ and quite preferably above 1.40 g/cm$^3$. This high density not only reduces the total volume of a cast dosage unit but also simultaneously improves its mechanical stability. Particularly preferred inventive processes are those wherein the dispersion has a density between 1.050 and 1.670 g/cm$^3$, preferably between 1.120 and 1.610 g/cm$^3$, particularly preferably between 1.210 and 1.570 g/cm$^3$, quite particularly preferably between 1.290 and 1.510 g/cm$^3$, and especially between 1.340 and 1.480 g/cm$^3$. The density data refer to the densities of the agents at 20° C. In order to avoid demixing processes during the processing of these dispersions, in particular, from vibrations of the mold tooling, the dispersion agents and dispersed substances preferably have densities that differ by less than 0.6 g/cm$^3$, particularly preferably less than 0.46 g/cm$^3$ and quite particularly preferably less than 0.3 g/cm$^3$.

According to the invention, preferred dispersions that are employed as the active detergent or cleaning preparation are those which dissolve in water (40° C.) in less than 9 minutes, advantageously in less than 7 minutes, preferably in less than 6 minutes, particularly preferably in less than 5 minutes and quite particularly preferably in less than 4 minutes. In order to determine the solubility, 20 g of the dispersion is placed in the interior of a dishwasher (MIELE G 646 PLUS). The main cleaning cycle of a standard cleaning program (45° C.) is started. The solubility determination is made by measuring the conductivity, displayed using a conductivity sensor. The dissolving process ends at the conductivity maximum. This maximum corresponds to a plateau in the conductivity diagram. The conductivity measurement begins when the circulation pump in the main cleaning cycle switches on. The added quantity of water is 5 liters.

Processes according to the invention, wherein at least one of the added wrapping materials is transparent or translucent, are preferred.

The wrapping material used for deep drawing, injection molding and/or melt casting is preferably transparent. In the context of this invention, transparency is understood to mean that the transmittance in the visible spectrum of light (410 to 800 nm) is greater than 20%, advantageously greater than 30%, most preferably greater than 40% and, in particular, greater than 50%. Thus, as soon as a wavelength of the visible spectrum of light has a transparency greater than 20%, then in the context of the invention it is to be considered as transparent.

In a preferred embodiment of the process according to the invention, the wrapping material is colored to improve the visual impression.

Plasticizer is preferably added to the wrapping material of the containers manufactured in the inventive process. They are comprised in the employed wrapping material in up to 22 wt. %, preferably between 2 and 20 wt. %, particularly preferably between 4 and 19 wt. %.

Any of the plasticizers known to the person skilled in the art can be used as the plasticizer. However, preferably pentaerythritol, dipentaerythritol, sorbitol, mannitol, glycerine and glycols such as glycerol, ethylene glycol and polyethylene glycol are used.

Solids such as talcum, stearic acid, magnesium stearate, silicon dioxide, zinc stearate and colloidally dispersed silica, as well as magnesium trisilicate, prevent the formation of sticky surfaces and permit the wall thicknesses of the container to be reduced. They are preferably admixed with the wrapping material.

In a preferred embodiment of the containers manufactured by the inventive process, in which transparent wrapping material was employed for the manufacture, a stabilizer may also be comprised. In the context of the invention, stabilizers are materials that protect the ingredients in the receiving chamber from decomposition or deactivation from light irradiation. Antioxidants, UV-absorbers and fluorescent dyes have proven to be particularly suitable.

In the context of the invention, antioxidants are particularly suitable stabilizers. The formulations can comprise antioxidants in order to prevent undesirable changes to the formulation caused by light irradiation and radically induced decomposition. Phenols, bisphenols and thiobisphenols, substituted with sterically hindered groups can be used, for example, as antioxidants. Further examples are propyl gallate, butylhydroxytoluene (BHT), butylhydroxyanisole (BHA), t-butyl hydroquinone (TBHQ), tocopherol and the long-chained (C8-C22) esters of gallic acid, such as dodecyl gallate. Other substance classes are aromatic amines, preferably secondary aromatic amines and substituted p-phenylenediamines, phosphorus compounds with trivalent phosphorus such as phosphines, phosphites and phosphonites, citric acids and citric acid derivatives, such as isopropyl citrate, compounds with ene-diol groups, so-called reductonesa, such as ascorbic acid and its derivatives, such as ascorbic acid palmitate, organosulfur compounds, such as the esters of 3,3'-thiodipropionic acid with $C_{1-18}$-alkanols, particularly $C_{10-18}$-alkanols, metal deactivators, which are capable of complexing autoxidative catalytic metal ions such as copper, like nitriloacetic acid and its derivatives and their mixtures. The antioxidants can be comprised in the formulations in amounts up to 35 wt. %, preferably up to 25 wt. %, particularly preferably from 0.01 to 20 and particularly from 0.03 to 20 wt. %.

A further class of preferred suitable stabilizers is the UV-absorbers, which can improve the light stability of the ingredients of the recipe. UV-absorbers are understood to mean organic substances (light protective filters), which are able to absorb UV radiation and emit the resulting energy in the form of longer wavelength radiation, for example, as heat. Compounds which possess these desired properties are, for example, the efficient radiationless deactivating compounds and derivatives of benzophenone having substituents in position(s) 2- and/or 4. Also suitable are substituted benzotriazoles, such as, for example, the water-soluble sodium salt of 3-(2H-benzotriazole-2-yl) hydroxy-5-(methylpropyl)-benzenesulfonic acid (Cibafast® H), acrylates, which are phenyl-substituted in position 3 (cinnamic acid derivatives) optionally with cyano groups in position 2, salicylates, organic Ni complexes, as well as natural substances such as umbelliferone and the endogenous urocanic acid. The biphenyl and above all the stilbene derivatives which are commercially available as Tinosorb® FD or Tinosorb® FR from Ciba, are of particular importance. In addition, the following can be cited as UV-B absorbers: 3-benzylidenecamphor or 3-benzylidenenorcamphor and its derivatives, for example, 3-(4-methylbenzylidene) camphor, 4-aminobenzoic acid derivatives, preferably 2-ethylhexyl ester of 4-(dimethylamino) benzoic acid, 4-(dimethylamino)benzoic acid, 2-octyl ester and 4-(dimethylamino)benzoic acid, amyl ester; esters of cinnamic acid, preferably 4-methoxycinnamic acid, 2-ethylhexyl ester, 4-methoxycinnamic acid, propyl ester, 4-methoxycinnamic acid, isoamyl ester, 2-cyano-3,3-phenylcinnamic acid, 2-ethylhexyl ester (octocrylene); esters of salicylic acid, preferably salicylic acid, 2- ethylhexyl ester, salicylic acid, 4-isopropylbenzyl ester, salicylic acid, homomenthyl ester; derivatives of benzophenone, preferably 2-hydroxy-4-methoxybenzophenone, 2-hydroxy-4-methoxy-4'-methylbenzophenone, 2,2'-dihydroxy-4-methoxybenzophenone; esters of benzalmalonic acid, preferably 4-methoxybenzmalonic acid, di-2-ethylhexylester; triazine derivatives, such as, for example, 2,4,6-trianilino-(p-carbo-2'-ethyl-1'-hexyloxy)-1,3,5-triazine and octyl triazone, or dioctyl butamidotriazone (Uvasorb® HEB); propane-1,3-dione, such as, for example, 1-(4-tert.butylphenyl)-3-(4'-methoxyphenyl)propane-1,3-dione; ketotricyclo(5.2.1.0)decane derivatives. Further suitable UV-B absorbers are 2-phenylbenzimidazole-5-sulfonic acid and its alkali-, alkaline earth-, ammonium-, alkyl ammonium-, alkanol ammonium- and glucammonium salts; sulfonic acid derivatives of benzophenones, preferably 2-hydroxy-4-methoxybenzophenone-5-sulfonic acid and its salts; sulfonic acid derivatives of 3-benzylidenecamphor, such as for example, 4-(2-oxo-3-bornylidenemethyl)benzene sulfonic acid and 2-methyl-5-(2-oxo-3-bornylidene) sulfonic acid and its salts.

Typical UV-A filters particularly include derivatives of benzoylmethane, such as, for example, 1-(4'-tert.-butylphenyl)-3-(4'-methoxyphenyl)propane-1,3-dione, 4-tert.-butyl-4'-methoxydibenzoylmethane (Parsol 1789), 1-phenyl-3-(4'-isopropylphenyl)-propane-1,3-dione as well as enamine compounds. Naturally, the UV-A and UV-B filters can also be added as mixtures. In addition to the cited soluble materials, insoluble, light protecting pigments, namely finely dispersed, preferably, nano metal oxides or salts can also be considered for this task. Exemplary suitable metal oxides are particularly zinc oxide and titanium oxide and also oxides of iron, zirconium, silicon, manganese, aluminum and cerium as well as their mixtures. Silicates (talc), barium sulfate or zinc stearate can be added as salts. The oxides and salts are already used in the form of pigments for skin care and skin protecting emulsions and decorative cosmetics. Here, the particles should have a mean diameter of less than 100 nm, preferably between 5 and 50 nm and particularly preferably between 15 and 30 nm. Although they are typically spherical, elliptical or other shaped particles can also be used. The pigments can also be surface treated, i.e., hydrophilized or hydrophobized. Typical examples are coated titanium dioxides, such as, for example, Titandioxid T 805 (Degussa) or Eusolex® T2000 (Merck). Hydrophobic coating agents preferably include silicones and among them specifically trialkoxyoctylsilanes or Simethicones. Micronized zinc oxide is preferably used.

The UV absorbers can be comprised in quantities up to 5 wt. %, advantageously up to 3 wt. %, particularly preferably 0.01 wt. % to 2.0 and particularly from 0.03 wt. % to 1 wt. %, each based on the total weight of a mixture of substances present in a receiving chamber.

A further preferred class of stabilizers is the fluorescent dyes. They include 4,4'-diamino-2,2'-stilbenedisulfonic acids (flavonic acids), 4,4'-distyrylbiphenylene, methyl umbelliferone, coumarine, dihydroquinolinones, 1,3-diarylpyrazolines, naphthoic acid imide, benzoxazole-, benzisoxazole- and benzimidazole-systems as well as heterocyclic substituted pyrene derivatives. The sulfonic acid salts of diaminostilbene derivatives and polymeric fluorescent dyes are of particular importance.

The fluorescence dyes can be comprised in quantities up to 5 wt. %, advantageously up to 1 wt. %, preferably 0.01 wt. % to 0.5 and particularly preferably from 0.03 wt. % to 0.1 wt. %, each based on the total weight of a mixture of substances present in a receiving chamber.

In a preferred embodiment, the above-mentioned stabilizers are used in any mixtures. The stabilizers are used in quantities up to 40 wt. %, advantageously up to 30 wt. %, preferably 0.01 wt. % to 20 wt. % and particularly preferably from 0.02 wt. % to 5 wt. %, each based on the total weight of a mixture of substances present in a receiving chamber.

In a preferred inventive process, at least one of the employed wrapping material(s) consists of a water-soluble or water-dispersible polymer, preferably a polymer film.

Preferred process variants are those wherein film used in step a) of the inventive process has a thickness of 5 to 2,000 μm, advantageously 10 to 1,000 μm, preferably 15 to 500 μm, particularly preferably 20 to 200 μm and quite particularly preferably 25 to 100 μm.

The films can be a single or multilayered film (laminate film). The water content of the films is preferably below 10 wt. %, particularly preferably below 7 wt. %, quite particularly preferably below 5 wt. % and especially below 4 wt. %.

As can be inferred from the previous statements, the agents manufactured by the inventive process are particularly suited for the controlled release of the active substances contained therein from the group of detergents or cleaning agents.

Consequently, a preferred embodiment according to the invention is when the container is fully water-soluble. For example, when used in washing or automatic cleaning, the container completely dissolves when the intended conditions for dissolution are attained. A marked advantage of this embodiment is that the container at least partially dissolves under exactly defined conditions in the wash liquor in a short time, for example, within some seconds to 5 minutes. and depending on the requirements of the enclosed contents, i.e. the active cleaning material (or materials), releases them into the water. This release can now be controlled or directed in various ways.

In a first, and due to the advantageous properties, preferred embodiment of the invention, the water-soluble container includes lower water-soluble/water-dispersible or completely water-insoluble/non water-dispersible regions, or regions that are water-soluble/water-dispersible only at higher temperature and good water-soluble/water-dispersible regions or regions that are water-soluble/water-dispersible at low temperatures. In other words, the container does not consist of a uniform material exhibiting the same water-solubility/water-dispersibility, but rather consists of materials exhibiting different water-solubilities/water-dispersibilities. Areas of good water-solubility/water-dispersibility are to be differentiated from those of less good water-solubility/water-dispersibility, of poorer or even no water-solubility/water-dispersibility, or from areas, in which the water-solubility/water-dispersibility first attains the desired value only at higher temperature or first at another pH, or first at a modified electrolyte concentration. Under adjustable conditions of intended use, this can lead to specific areas of the container dissolving/dispersing, while other areas remain intact. Thus, a container with pores or holes can be imagined into which water and/or liquor infiltrate, dissolve the active detergent, rinse or cleaning ingredients and drain out of the container. In this manner, systems with controlled-released active detergent, active rinse or active cleaning ingredients can be manufactured.

The invention is not subject to any limitations in the construction of this type of system. Thus, containers can be provided, in which a uniform polymer material includes small areas of built-in compounds (salts, for example), which dissolve/disperse faster in water than the polymeric material. On the other hand, a plurality of polymeric materials with different water-solubilities/water-dispersibilities can be mixed (polymer blend), such that the faster dissolving polymeric material is disintegrated faster under defined conditions by water or the liquor than the slower dissolving material.

In a preferred embodiment of the invention, the lower water-soluble/water-dispersible or completely water-insoluble/non-water-dispersible regions, or regions that are water-soluble/water-dispersible only at higher temperature of the container are of one material. That material, chemically, essentially corresponds to that of good water-soluble/water-dispersible regions or regions that are water-soluble/water-dispersible only at lower temperatures. The material may have a thicker layer and/or a modified degree of polymerization from the same polymers and/or a higher degree of crosslinking of the same polymer structure. The material may also have a higher degree of acetalization (for PVAL, for example, with saccharides, polysaccharides like starch) and/or a content of water-insoluble/water-dispersible salt components and/or a content of water-insoluble/non water dispersible polymers. Even if the container does not completely dissolve, according to the invention, such a container comprising portioned detergent and cleaning agents can exhibit the advantageous properties when releasing the active substances into the liquors, particularly active substances from the group of detergent or cleaning agents.

In addition to this controlled release, which is made possible by the judicious choice of the external coating materials, there are, however, even more processing techniques available to the expert. An alternative approach, which can be suitably used alone or in combination with the previously-cited control by choosing specific external wrapping materials for controlled release of active substances or mixtures of active substances, is the integration of one or more "switches" into the above-mentioned active substances, mixtures of active substances or preparations of active substances.

In particularly preferred embodiments, possible "switches" that influence the dissolution behavior of the active substances enclosed in the inventive containers are physico-chemical parameters. Examples of these, which however, should not be understood as limiting, are the following:

- the mechanical stability, for example, of a capsule, a coating or a compacted shaped object such as a tablet, which—depending on the time, temperature or other parameters—can be a defining factor for the disintegration;
- the solubility of optionally employed capsules or coatings or matrices, which depends on pH and/or temperature and/or ion strength;
- the rate of dissolution of optionally employed capsules or coatings or matrices, which depends on pH and/or temperature and/or ion strength; and
- the melting behavior (melting point) of optionally employed capsules, coatings or matrices, which depends on pH and/or temperature and/or ion strength.

In a preferred embodiment of the inventive process, the manufactured agent includes at least one active substance or mixture of active substances whose release is delayed. Accordingly, the delayed release results advantageously from the use of at least one of the above-cited agents. However from the use of different packaging materials and/or the use of selected coating materials, wherein it is particularly important that this delayed release for active substances or mixtures of active substances from the group of detergents or cleaning agents happens not before 5 minutes, preferably not before 7 minutes, particularly preferably not before 10 minutes, quite particularly preferably not before 15 minutes and especially not before 20 minutes after the start of the cleaning or washing process. For the purpose of this delayed release, the addition of meltable coating materials from the group of waxes and paraffins is particularly preferred.

Filling the Container According to Point b).

In the context of this invention, the filling volume is designated as the "volume" which can be realized on filling the chambers or compartments with a liquid so that the liquid does not overflow on to the preferably planar sealed edges.

The receiving chambers produced by the deep drawing process, the injection molding process or the melt casting process can be filled with solids or liquids.

A multi-phase detergent or cleaning agent according to the invention is preferred, wherein the phases of detergents or cleaning agents that are separated from one other are a solid and a liquid.

If more than one chamber is formed in step a) of the inventive process, then these two, three, four, five or more chambers can be filled simultaneously or consecutively. In addition, prior to sealing, there is at least one (preferably two, three or four) of the receiving chambers produced in step a) that is not filled. When added to liquid, preferably aqueous media, the resulting packaging exhibits increased buoyancy.

A preferred process of the invention is one wherein the resulting container possesses at least two receiving chambers that are each filled with different agents. The agents can differ both in their composition as well as in their composition and physical state.

The subject matter of the present invention is a process for manufacturing multi-phase detergents or cleaning agents, comprising the steps:

a) manufacturing a water-soluble or water-dispersible container that possesses two receiving chambers;
b) filling the container with a first and a second detergent or cleaning agent;
c) applying a liquid separation agent onto this detergent and cleaning agent and hardening the separation agent to form a parting layer; and
d) filling the container with a third, preferably with a third and a fourth detergent or cleaning agent.

The subject matter of the present invention is a process for manufacturing multi-phase detergents or cleaning agents, comprising the steps:

a) manufacturing a water-soluble or water-dispersible container that possesses three receiving chambers;
b) filling the container with a first, second and a third detergent or cleaning agent;
c) applying a liquid separation agent onto this detergent and cleaning agent and hardening the separation agent to form a parting layer; and
c) filling the container with at least one additional detergent or cleaning agent.

The subject matter of the present invention is a process for manufacturing multi-phase detergents or cleaning agents, comprising the steps:

a) manufacturing a water-soluble or water-dispersible container that possesses four receiving chambers;
b) filling the container with a first, a second, a third and a fourth detergent or cleaning agent;
c) applying a liquid separation agent onto this detergent and cleaning agent and hardening the separation agent to form a parting layer; and
d) filling the container with at least one additional detergent or cleaning agent.

A preferred process of the invention is one wherein the receiving chambers of a container that possesses at least two receiving chambers are filled with the same agents. However, it is preferred that at least one, particularly preferably two, quite particularly preferably three, especially four of the agents possess(es) a composition and/or a physical state which do(es) not correspond to any other of the filled materials. It is particularly preferred that all the filled agents differ in their composition and/or their physical state.

A preferred embodiment of the inventive process is one wherein at least one of the detergents or cleaning agents filled in steps b) and d) is a solid.

A further preferred embodiment of the inventive process is one wherein at least one of the detergents or cleaning agents filled in steps b) and d) is a liquid.

In the following, the state of aggregation of the fillable active substances or combinations of active substances will be differentiated between solid and liquid agents, wherein in the context of the present application, active substances or combinations of active substances are considered to be solids when they have a solid, i.e., shape-stable, non-flowable consistency. Substances, for example, in the solid state, but also shape-stable substances such as gels or combinations of these substances fall into this category. Moreover, filler bodies having a solid outer casing are designated as solids, i.e., independently of the state of aggregation of the fillers comprised in these filled bodies.

In the context of the present application, powders and/or granules and/or extrudates and/or compactates and/or castings are preferably considered as solids, i.e., independently of whether they are pure substances or mixtures of substances.

The cited solids can be present in amorphous and/or crystalline and/or partially crystalline form. In the context of the present invention, preferred solids have a water content (measurable, for example, as the loss in drying or according to Karl Fischer) below 7 wt. %, preferably below 4.5 wt. % and particularly preferably below 2 wt. %.

Powder is a general term for a form of divided solid materials and/or mixtures of materials that are obtained by comminution, i.e., by pulverizing or crushing in the mortar (pulverizing), grinding in mills or as the result of spray drying or lyophilization. A particularly fine dispersion is often called atomizing or micronizing; the corresponding powders are called micro-powder. Preferred powders have a uniform (homogeneous) mixture of the solid, finely divided components and in the case of mixtures of substances, do not tend to separate into the individual components of the mixture. Accordingly, in the context of the present application, particularly preferred powders have a particle size distribution, in which at least 80 wt. %, preferably at least 60 wt. %, particularly preferably at least 95 wt. % and quite particularly preferably at least 99 wt. % of the powder, each based on the total weight, diverge to maximum 80%, preferably maximum 60% and particularly preferably maximum 40% from the average particle size of this powder.

Powder is normally broadly classified according to its particle size into coarse, fine and very fine powder. A more accurate classification of bulk powders is made on the basis of bulk density and by sieve analysis. Although in principle, powders of any particle size can be used, preferred powders have average particle sizes of 40 to 500 μm, preferably 60 to 400 μm and especially 100 to 300 μm. Methods for determining the average particle size usually depend on the above-mentioned sieve analysis and are extensively described in the prior art.

Unwanted agglomeration of the powders can be countered by the use of flow aids or dusting agents. In a preferred embodiment of the inventive process, the manufactured powders therefore comprise flow aids or dusting agents, preferably in parts by weight of 0.1 to 4 wt. %, particularly preferably 0.2 to 3 wt. % and quite particularly preferably 0.3 to 2 wt. %, each based on the total weight of the powder. Preferred flow aids or dusting agents are silicates and/or silicon dioxide and/or urea, preferably in very finely ground form.

As particulate mixtures, powders can be agglomerated by a series of techniques. Any known method in the prior art is basically suitable for the agglomeration of particulate mixtures to convert the solids included in the manufactured containers of the invention into larger aggregates. As solid(s) in the context of the present invention, preferred added agglomerates in addition to the granules, are compactates and extrudates.

Aggregations of granule particles are designated as granulates. A granule grain (granulate) is an asymmetric aggregate of powder particles. Granulation methods are extensively described in the prior art. Granules can be manufactured by wet granulation, by dry granulation or compaction and by granulation of solidified melts.

The most common granulation technique is wet granulation as this technique is subject to the fewest limitations and is the most reliable for producing granules with favorable properties. Wet granulation is effected by moistening the powder mixture with solvents and/or mixtures of solvents and/or solutions of binders and/or solutions of adhesives and is preferably carried out in mixers, fluid beds or spray towers, wherein the cited mixers can be equipped, for example, with stirrers and kneading tools. However, combinations of fluid bed(s) and mixer(s) or combinations of various mixers can also be used for the granulation. Depending on the starting material and the desired product properties, granulation is effected under the action of low to high shear forces.

When granulation is effected in a spray tower, then melts (melt solidification) or preferably aqueous slurries (spray drying) of solid substances can be used as the starting materials. These are sprayed at the top of a tower in defined droplet sizes, solidify or are dried in free fall and accumulate on the floor of the tower as the granulate. In general, melt solidification is particularly suitable for shaping low melting materials that are stable in the region of their melting point (e.g., urea, ammonium nitrate and various formulations like enzyme concentrates, medicaments etc.); the corresponding granulates are also called prills. Spray drying is particularly employed for manufacturing detergents or detergent ingredients.

Additional agglomeration techniques that are described in the prior art are the extruder or piercing mill granulation, in which powder mixtures, optionally mixed with granulation liquid, are plastically shaped by molding though a die plate (extrusion) or on piercing mills. The products from extruder granulation are also called extrudates.

Compactates can be manufactured by means of dry granulation methods such as tableting or roller compaction. Single or multiphase tablets or briquettes can be manufactured by compacting in tablet presses. In addition to multi-layer or sandwich tablets, multi-phase tablets also include coated tablets and bull's eye tablets. Briquettes, like shells that are manufactured in compaction rollers, can be comminuted at the end of compaction by means of counter-rotating pin feed drums or be struck through sieves.

The solids further include castings that can be manufactured, for example, by the above-described processes of solidification and/or crystallization from melts or solutions, the castings not necessarily having the shape of the above described water-soluble or water-dispersible containers. Preferably, the solidification and/or crystallization takes place in pre-prepared female molds. After solidification, the castings are ejected from the female mold. Depending on the size of the mold and the end-use of the casting, they can then be used in their original size, or optionally, after comminution, as the solid in the water-soluble containers of the invention.

Gels.

In the context of the present invention, shape-stable gels are a further particularly preferred solid. The term "shape-stable" designates gels that exhibit their own dimensional stability. Under normal conditions of manufacture, storage, transport and consumer utilization this shape stability allows them to assume a non-disintegrated shape, wherein this shape does not change under the cited conditions, even over a longer period, preferably four weeks, particularly preferably eight weeks and particularly thirty-two weeks. Under normal conditions of manufacture, storage, transport and utilization by the customer, shape-stable gels remain in the spatial and geometric shape defined by their manufacture. These gels do not flow or revert to their prior geometrical shape under the action of an external force typical of the conditions of production, storage, transport and utilization.

Gels of a desired shape stability that also have good product properties (solubility, washing and cleaning performance, gel stability), are obtained through the use of thickeners selected from the group including agar-agar, carrageen, tragacanth, gum arabic, alginates, pectins, polyoses, guar-flour, locust bean flour, starches, dextrins, gelatines, casein, carboxymethyl cellulose, bean flour ether, polyacrylic and polymethacrylic compounds, vinyl polymers, polycarboxylic acids, polyethers, polyimines, polyamides, polysilicas, mineral clays such as montmorillonite, zeolite and silicas. It has proven particularly advantageous when the gels comprise these or one of the following thickeners in amounts between 0.2 and 10 wt. %, preferably between 0.3 and 7 wt. % and particularly preferably between 0.4 and 4 wt. %, based on the total weight of the shaped object.

Exemplary, naturally occurring polymers that can be used as thickeners in the context of the present invention are as previously described agar agar, carrageen, tragacanth, gum Arabic, alginates, pectins, polyoses, guar meal, locust tree bean flour, starches, dextrins, gelatines and casein. Modified natural products mainly derive from the group of modified starches and celluloses, examples being carboxymethyl cellulose and other cellulose ethers, hydroxyethyl and hydroxypropyl cellulose as well as bean flour ether.

A major group of thickeners that are widely used in the most varied applications are the synthetic polymers such as polyacrylic and polymethacrylic compounds, vinyl polymers, polycarboxylic acids, polyethers, polyimines, polyamides and polyurethanes. Thickeners from the cited classes of substances are commercially available and offered, for example, under the trade names Acusol®-820 (methacrylic acid (stearylalkohol-20-EO) ester-acrylic acid copolymer, 30% in water, Rohm & Haas), Dapral®-GT-282-S (alkylpolyglycol ether, Akzo), Deuterol®-Polymer-11 (dicarboxylic acid copolymer, Schöner GmbH), Deuteron®-XG (anionic heteropolysaccharide based on β-D-glucose, D-mannose, D-glucuronic acid, Schöner GmbH), Deuteron®-XN non-iogenic polysaccharide, Schöner GmbH), Dicrylan®-Verdicker-O (ethylene oxide adduct, 50% in water/isopropanol, Pfersse Chemie), EMA®-81 and EMA®-91 (ethylene-maleic anhydride copolymer, Monsanto), Verdicker-QR-1001 (polyurethane emulsion, 19-21% in water/diglycol ether, Rohm & Haas), Mirox®-AM (anionic acrylic acid acrylate copolymer dispersion, 25% in water, Stockhausen), SER-AD-FX-1100 (hydrophobic urethane polymer, Servo Delden), Shellflo®-S (high molecular weight polysaccharide, stabilized with formaldehyde, Shell) and Shellflo®-XA (Xanthane biopolymer, stabilized with formaldehyde, Shell).

As a result of their manufacturing process as well as from the optimization of their dissolution behavior, preferred gels comprise various solvents, wherein in regard to their product properties, gels that comprise water and/or one or a plurality of water-miscible solvents in amounts of 5 to 70 wt. %, preferably 10 to 65 wt. % and particularly preferably 15 to 60 wt. % have proven to be particularly advantageous.

In addition, it has proven particularly advantageous when the water-miscible solvents comprise one or more substances from the group from ethanol, n- or i-propanol, n- or sec- or tert.-butanol, glycol, propanediol or butanediol, glycerol, diglycol, propyl diglycol or butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl-, -ethyl- or -propyl ether, dipropylene glycol methyl-, or -ethyl ether, methoxy-, ethoxy- or butoxy triglycol, 1-butoxyethoxy-2-propanol, 3-methyl-3-methoxybutanol, propylene glycol t-butyl ether.

Capsules.

Further solids included in the containers in a preferred inventive process are the capsules. "Capsule" is a name for a frequently used packaging form, which in various sizes of optionally colored external layers of gelatine, wax or wafer material, comprises solid, semi-solid or liquid substances. Gelatine capsules (of hard or soft gelatine) are used most frequently.

In a particular embodiment of the present invention, one, a plurality or all of the solids filled into the containers of the invention, i.e., for example, one, a plurality or all of the powders and/or granule(s) and/or compactate(s) and/or castings and/or shape-stable gel(s) and/or capsule(s) has/have a coating. This type of coating can serve various purposes. One purpose is the prevention of an unwanted contact of the hydrolysis or oxidation-sensitive active substances that are comprised in the solids with atmospheric air, or with additional solids enclosed in the inventive water-soluble container. Another purpose of the coating is to provide an advantageous visual effect.

Liquids.

The above-mentioned liquids and solids are suitable ingredients for the receiving chambers or interstitial spaces. Here, for the solids, a distinction is made between powders, granules, extrudates, compactates, castings and shape-stable gels. In the context of this application, suitable liquids are, for example, emulsions or suspensions, in addition to low-viscosity liquids or flowable gels or flowable dispersions. Active principles or combinations of active principles are considered to be flowable when they do not have their own dimensional stability that allows them, under normal conditions of manufacture, storage, transport and consumer utilization, to assume a non-disintegrated shape, wherein this shape does not change under the cited conditions, even over a longer period, preferably two weeks, particularly preferably eight weeks and quite particularly preferably thirty-two weeks. Under normal conditions of manufacture, storage, transport and utilization by the customer the shape-stable gels remain in the spatial and geometric shape defined by their manufacture, i.e., do not deliquesce. The flowability is determined particularly under the normal conditions of storage and transport, therefore below 50° C., preferably below 40° C. Liquids are therefore preferably active substances or combinations of active substances with a melting point below 25° C., particularly preferably below 20° C., and quite particularly preferably below 15° C.

The containers that can be manufactured with two or three filled receiving cavities according to the processes of the invention are listed in the following tables.

TABLE 2

Container with two receiving chambers.

| Receiving Chamber 1 | Receiving Chamber 2 |
|---|---|
| Liquid | Liquid |
| Liquid | Powder |
| Liquid | Granule |
| Liquid | Compactate |
| Liquid | Extrudate |
| Liquid | Cast object |
| Liquid | Shape-stable gel |
| Powder | Liquid |
| Powder | Powder |
| Powder | Granule |
| Powder | Compactate |
| Powder | Extrudate |
| Powder | Cast object |
| Powder | Shape-stable gel |
| Granule | Liquid |
| Granule | Powder |
| Granule | Granule |
| Granule | Compactate |
| Granule | Extrudate |
| Granule | Cast object |

TABLE 2-continued

Container with two receiving chambers.

| Receiving Chamber 1 | Receiving Chamber 2 |
|---|---|
| Granule | Shape-stable gel |
| Compactate | Liquid |
| Compactate | Powder |
| Compactate | Granule |
| Compactate | Compactate |
| Compactate | Extrudate |
| Compactate | Cast object |
| Compactate | Shape-stable gel |
| Extrudate | Liquid |
| Extrudate | Powder |
| Extrudate | Granule |
| Extrudate | Compactate |
| Extrudate | Extrudate |
| Extrudate | Cast object |
| Extrudate | Shape-stable gel |
| Cast object | Liquid |
| Cast object | Powder |
| Cast object | Granule |
| Cast object | Compactate |
| Cast object | Extrudate |
| Cast object | Cast object |
| Cast object | Shape-stable gel |
| Shape-stable gel | Liquid |
| Shape-stable gel | Powder |
| Shape-stable gel | Granule |
| Shape-stable gel | Compactate |
| Shape-stable gel | Extrudate |
| Shape-stable gel | Cast object |
| Shape-stable gel | Shape-stable gel |

TABLE 3

Container with three receiving chambers.

| Receiving Chamber 1 | Receiving Chamber 2 | Receiving Chamber 3 |
|---|---|---|
| Liquid | Liquid | Liquid |
| Liquid | Powder | Liquid |
| Liquid | Granule | Liquid |
| Liquid | Compactate | Liquid |
| Liquid | Extrudate | Liquid |
| Liquid | Cast object | Liquid |
| Liquid | Shape-stable gel | Liquid |
| Liquid | Liquid | Powder |
| Liquid | Powder | Powder |
| Liquid | Granule | Powder |
| Liquid | Compactate | Powder |
| Liquid | Extrudate | Powder |
| Liquid | Cast object | Powder |
| Liquid | Shape-stable gel | Powder |
| Liquid | Liquid | Granule |
| Liquid | Powder | Granule |
| Liquid | Granule | Granule |
| Liquid | Compactate | Granule |
| Liquid | Extrudate | Granule |
| Liquid | Cast object | Granule |
| Liquid | Shape-stable gel | Granule |
| Liquid | Liquid | Compactate |
| Liquid | Powder | Compactate |
| Liquid | Granule | Compactate |
| Liquid | Compactate | Compactate |
| Liquid | Extrudate | Compactate |
| Liquid | Cast object | Compactate |
| Liquid | Shape-stable gel | Compactate |
| Liquid | Liquid | Extrudate |
| Liquid | Powder | Extrudate |
| Liquid | Granule | Extrudate |
| Liquid | Compactate | Extrudate |
| Liquid | Extrudate | Extrudate |
| Liquid | Cast object | Extrudate |
| Liquid | Shape-stable gel | Extrudate |
| Liquid | Liquid | Cast object |

TABLE 3-continued

Container with three receiving chambers.

| Receiving Chamber 1 | Receiving Chamber 2 | Receiving Chamber 3 |
|---|---|---|
| Liquid | Powder | Cast object |
| Liquid | Granule | Cast object |
| Liquid | Compactate | Cast object |
| Liquid | Extrudate | Cast object |
| Liquid | Cast object | Cast object |
| Liquid | Shape-stable gel | Cast object |
| Liquid | Liquid | Shape-stable gel |
| Liquid | Powder | Shape-stable gel |
| Liquid | Granule | Shape-stable gel |
| Liquid | Compactate | Shape-stable gel |
| Liquid | Extrudate | Shape-stable gel |
| Liquid | Cast object | Shape-stable gel |
| Liquid | Shape-stable gel | Shape-stable gel |
| Powder | Liquid | Liquid |
| Powder | Powder | Liquid |
| Powder | Granule | Liquid |
| Powder | Compactate | Liquid |
| Powder | Extrudate | Liquid |
| Powder | Cast object | Liquid |
| Powder | Shape-stable gel | Liquid |
| Powder | Liquid | Powder |
| Powder | Powder | Powder |
| Powder | Granule | Powder |
| Powder | Compactate | Powder |
| Powder | Extrudate | Powder |
| Powder | Cast object | Powder |
| Powder | Shape-stable gel | Powder |
| Powder | Liquid | Granule |
| Powder | Powder | Granule |
| Powder | Granule | Granule |
| Powder | Compactate | Granule |
| Powder | Extrudate | Granule |
| Powder | Cast object | Granule |
| Powder | Shape-stable gel | Granule |
| Powder | Liquid | Compactate |
| Powder | Powder | Compactate |
| Powder | Granule | Compactate |
| Powder | Compactate | Compactate |
| Powder | Extrudate | Compactate |
| Powder | Cast object | Compactate |
| Powder | Shape-stable gel | Compactate |
| Powder | Liquid | Extrudate |
| Powder | Powder | Extrudate |
| Powder | Granule | Extrudate |
| Powder | Compactate | Extrudate |
| Powder | Extrudate | Extrudate |
| Powder | Cast object | Extrudate |
| Powder | Shape-stable gel | Extrudate |
| Powder | Liquid | Cast object |
| Powder | Powder | Cast object |
| Powder | Granule | Cast object |
| Powder | Compactate | Cast object |
| Powder | Extrudate | Cast object |
| Powder | Cast object | Cast object |
| Powder | Shape-stable gel | Cast object |
| Powder | Liquid | Shape-stable gel |
| Powder | Powder | Shape-stable gel |
| Powder | Granule | Shape-stable gel |
| Powder | Compactate | Shape-stable gel |
| Powder | Extrudate | Shape-stable gel |
| Powder | Cast object | Shape-stable gel |
| Powder | Shape-stable gel | Shape-stable gel |
| Granule | Liquid | Liquid |
| Granule | Powder | Liquid |
| Granule | Granule | Liquid |
| Granule | Compactate | Liquid |
| Granule | Extrudate | Liquid |
| Granule | Cast object | Liquid |
| Granule | Shape-stable gel | Liquid |
| Granule | Liquid | Powder |
| Granule | Powder | Powder |
| Granule | Granule | Powder |
| Granule | Compactate | Powder |
| Granule | Extrudate | Powder |
| Granule | Cast object | Powder |

TABLE 3-continued

Container with three receiving chambers.

| Receiving Chamber 1 | Receiving Chamber 2 | Receiving Chamber 3 |
|---|---|---|
| Granule | Shape-stable gel | Powder |
| Granule | Liquid | Granule |
| Granule | Powder | Granule |
| Granule | Granule | Granule |
| Granule | Compactate | Granule |
| Granule | Extrudate | Granule |
| Granule | Cast object | Granule |
| Granule | Shape-stable gel | Granule |
| Granule | Liquid | Compactate |
| Granule | Powder | Compactate |
| Granule | Granule | Compactate |
| Granule | Compactate | Compactate |
| Granule | Extrudate | Compactate |
| Granule | Cast object | Compactate |
| Granule | Shape-stable gel | Compactate |
| Granule | Liquid | Extrudate |
| Granule | Powder | Extrudate |
| Granule | Granule | Extrudate |
| Granule | Compactate | Extrudate |
| Granule | Extrudate | Extrudate |
| Granule | Cast object | Extrudate |
| Granule | Shape-stable gel | Extrudate |
| Granule | Liquid | Cast object |
| Granule | Powder | Cast object |
| Granule | Granule | Cast object |
| Granule | Compactate | Cast object |
| Granule | Extrudate | Cast object |
| Granule | Cast object | Cast object |
| Granule | Shape-stable gel | Cast object |
| Granule | Liquid | Shape-stable gel |
| Granule | Powder | Shape-stable gel |
| Granule | Granule | Shape-stable gel |
| Granule | Compactate | Shape-stable gel |
| Granule | Extrudate | Shape-stable gel |
| Granule | Cast object | Shape-stable gel |
| Granule | Shape-stable gel | Shape-stable gel |
| Compactate | Liquid | Liquid |
| Compactate | Powder | Liquid |
| Compactate | Granule | Liquid |
| Compactate | Compactate | Liquid |
| Compactate | Extrudate | Liquid |
| Compactate | Cast object | Liquid |
| Compactate | Shape-stable gel | Liquid |
| Compactate | Liquid | Powder |
| Compactate | Powder | Powder |
| Compactate | Granule | Powder |
| Compactate | Compactate | Powder |
| Compactate | Extrudate | Powder |
| Compactate | Cast object | Powder |
| Compactate | Shape-stable gel | Powder |
| Compactate | Liquid | Granule |
| Compactate | Powder | Granule |
| Compactate | Granule | Granule |
| Compactate | Compactate | Granule |
| Compactate | Extrudate | Granule |
| Compactate | Cast object | Granule |
| Compactate | Shape-stable gel | Granule |
| Compactate | Liquid | Compactate |
| Compactate | Powder | Compactate |
| Compactate | Granule | Compactate |
| Compactate | Compactate | Compactate |
| Compactate | Extrudate | Compactate |
| Compactate | Cast object | Compactate |
| Compactate | Shape-stable gel | Compactate |
| Compactate | Liquid | Extrudate |
| Compactate | Powder | Extrudate |
| Compactate | Granule | Extrudate |
| Compactate | Compactate | Extrudate |
| Compactate | Extrudate | Extrudate |
| Compactate | Cast object | Extrudate |
| Compactate | Shape-stable gel | Extrudate |
| Compactate | Liquid | Cast object |
| Compactate | Powder | Cast object |
| Compactate | Granule | Cast object |
| Compactate | Compactate | Cast object |

TABLE 3-continued

Container with three receiving chambers.

| Receiving Chamber 1 | Receiving Chamber 2 | Receiving Chamber 3 |
|---|---|---|
| Compactate | Extrudate | Cast object |
| Compactate | Cast object | Cast object |
| Compactate | Shape-stable gel | Cast object |
| Compactate | Liquid | Shape-stable gel |
| Compactate | Powder | Shape-stable gel |
| Compactate | Granule | Shape-stable gel |
| Compactate | Compactate | Shape-stable gel |
| Compactate | Extrudate | Shape-stable gel |
| Compactate | Cast object | Shape-stable gel |
| Compactate | Shape-stable gel | Shape-stable gel |
| Extrudate | Liquid | Liquid |
| Extrudate | Powder | Liquid |
| Extrudate | Granule | Liquid |
| Extrudate | Compactate | Liquid |
| Extrudate | Extrudate | Liquid |
| Extrudate | Cast object | Liquid |
| Extrudate | Shape-stable gel | Liquid |
| Extrudate | Liquid | Powder |
| Extrudate | Powder | Powder |
| Extrudate | Granule | Powder |
| Extrudate | Compactate | Powder |
| Extrudate | Extrudate | Powder |
| Extrudate | Cast object | Powder |
| Extrudate | Shape-stable gel | Powder |
| Extrudate | Liquid | Granule |
| Extrudate | Powder | Granule |
| Extrudate | Granule | Granule |
| Extrudate | Compactate | Granule |
| Extrudate | Extrudate | Granule |
| Extrudate | Cast object | Granule |
| Extrudate | Shape-stable gel | Granule |
| Extrudate | Liquid | Compactate |
| Extrudate | Powder | Compactate |
| Extrudate | Granule | Compactate |
| Extrudate | Compactate | Compactate |
| Extrudate | Extrudate | Compactate |
| Extrudate | Cast object | Compactate |
| Extrudate | Shape-stable gel | Compactate |
| Extrudate | Liquid | Extrudate |
| Extrudate | Powder | Extrudate |
| Extrudate | Granule | Extrudate |
| Extrudate | Compactate | Extrudate |
| Extrudate | Extrudate | Extrudate |
| Extrudate | Cast object | Extrudate |
| Extrudate | Shape-stable gel | Extrudate |
| Extrudate | Liquid | Cast object |
| Extrudate | Powder | Cast object |
| Extrudate | Granule | Cast object |
| Extrudate | Compactate | Cast object |
| Extrudate | Extrudate | Cast object |
| Extrudate | Cast object | Cast object |
| Extrudate | Shape-stable gel | Cast object |
| Extrudate | Liquid | Shape-stable gel |
| Extrudate | Powder | Shape-stable gel |
| Extrudate | Granule | Shape-stable gel |
| Extrudate | Compactate | Shape-stable gel |
| Extrudate | Extrudate | Shape-stable gel |
| Extrudate | Cast object | Shape-stable gel |
| Extrudate | Shape-stable gel | Shape-stable gel |
| Cast object | Liquid | Liquid |
| Cast object | Powder | Liquid |
| Cast object | Granule | Liquid |
| Cast object | Compactate | Liquid |
| Cast object | Extrudate | Liquid |
| Cast object | Cast object | Liquid |
| Cast object | Shape-stable gel | Liquid |
| Cast object | Liquid | Powder |
| Cast object | Powder | Powder |
| Cast object | Granule | Powder |
| Cast object | Compactate | Powder |
| Cast object | Extrudate | Powder |
| Cast object | Cast object | Powder |
| Cast object | Shape-stable gel | Powder |
| Cast object | Liquid | Granule |
| Cast object | Powder | Granule |

TABLE 3-continued

Container with three receiving chambers.

| Receiving Chamber 1 | Receiving Chamber 2 | Receiving Chamber 3 |
|---|---|---|
| Cast object | Granule | Granule |
| Cast object | Compactate | Granule |
| Cast object | Extrudate | Granule |
| Cast object | Cast object | Granule |
| Cast object | Shape-stable gel | Granule |
| Cast object | Liquid | Compactate |
| Cast object | Powder | Compactate |
| Cast object | Granule | Compactate |
| Cast object | Compactate | Compactate |
| Cast object | Extrudate | Compactate |
| Cast object | Cast object | Compactate |
| Cast object | Shape-stable gel | Compactate |
| Cast object | Liquid | Extrudate |
| Cast object | Powder | Extrudate |
| Cast object | Granule | Extrudate |
| Cast object | Compactate | Extrudate |
| Cast object | Extrudate | Extrudate |
| Cast object | Cast object | Extrudate |
| Cast object | Shape-stable gel | Extrudate |
| Cast object | Liquid | Cast object |
| Cast object | Powder | Cast object |
| Cast object | Granule | Cast object |
| Cast object | Compactate | Cast object |
| Cast object | Extrudate | Cast object |
| Cast object | Cast object | Cast object |
| Cast object | Shape-stable gel | Cast object |
| Cast object | Liquid | Shape-stable gel |
| Cast object | Powder | Shape-stable gel |
| Cast object | Granule | Shape-stable gel |
| Cast object | Compactate | Shape-stable gel |
| Cast object | Extrudate | Shape-stable gel |
| Cast object | Cast object | Shape-stable gel |
| Cast object | Shape-stable gel | Shape-stable gel |
| Shape-stable gel | Liquid | Liquid |
| Shape-stable gel | Powder | Liquid |
| Shape-stable gel | Granule | Liquid |
| Shape-stable gel | Compactate | Liquid |
| Shape-stable gel | Extrudate | Liquid |
| Shape-stable gel | Cast object | Liquid |
| Shape-stable gel | Shape-stable gel | Liquid |
| Shape-stable gel | Liquid | Powder |
| Shape-stable gel | Powder | Powder |
| Shape-stable gel | Granule | Powder |
| Shape-stable gel | Compactate | Powder |
| Shape-stable gel | Extrudate | Powder |
| Shape-stable gel | Cast object | Powder |
| Shape-stable gel | Shape-stable gel | Powder |
| Shape-stable gel | Liquid | Granule |
| Shape-stable gel | Powder | Granule |
| Shape-stable gel | Granule | Granule |
| Shape-stable gel | Compactate | Granule |
| Shape-stable gel | Extrudate | Granule |
| Shape-stable gel | Cast object | Granule |
| Shape-stable gel | Shape-stable gel | Granule |
| Shape-stable gel | Liquid | Compactate |
| Shape-stable gel | Powder | Compactate |
| Shape-stable gel | Granule | Compactate |
| Shape-stable gel | Compactate | Compactate |
| Shape-stable gel | Extrudate | Compactate |
| Shape-stable gel | Cast object | Compactate |
| Shape-stable gel | Shape-stable gel | Compactate |
| Shape-stable gel | Liquid | Extrudate |
| Shape-stable gel | Powder | Extrudate |
| Shape-stable gel | Granule | Extrudate |
| Shape-stable gel | Compactate | Extrudate |
| Shape-stable gel | Extrudate | Extrudate |
| Shape-stable gel | Cast object | Extrudate |
| Shape-stable gel | Shape-stable gel | Extrudate |
| Shape-stable gel | Liquid | Cast object |
| Shape-stable gel | Powder | Cast object |
| Shape-stable gel | Granule | Cast object |
| Shape-stable gel | Compactate | Cast object |
| Shape-stable gel | Extrudate | Cast object |
| Shape-stable gel | Cast object | Cast object |
| Shape-stable gel | Shape-stable gel | Cast object |

TABLE 3-continued

Container with three receiving chambers.

| Receiving Chamber 1 | Receiving Chamber 2 | Receiving Chamber 3 |
|---|---|---|
| Shape-stable gel | Liquid | Shape-stable gel |
| Shape-stable gel | Powder | Shape-stable gel |
| Shape-stable gel | Granule | Shape-stable gel |
| Shape-stable gel | Compactate | Shape-stable gel |
| Shape-stable gel | Extrudate | Shane-stable gel |
| Shape-stable gel | Cast object | Shape-stable gel |
| Shape-stable gel | Shape-stable gel | Shape-stable gel |

In the context of the present application, particularly preferred inventive processes are those wherein at least one receiving chamber is filled with a liquid and at least one other receiving chamber is filled with a solid. Inventive processes are particularly preferred in which at least one receiving chamber is filled with a casting (melt) and at least one other receiving chamber is filled with a solid.

Applying and Hardening the Separation Agent According to Step c).

In the inventive process, after filling the container with the first detergent or cleaning agent(s), a solid separation agent is applied (step c)), which solidifies on forming a parting layer. This can be introduced vertically or horizontally to the floor of the container. Inclined separation layers, in which the angle between the separation layer and the floor of the container is between 0 and 90°, are also possible. However, it is preferred to form separation layers that are parallel to the floor of the container.

After the separation layer has solidified, the water-soluble or water-dispersible container is filled again (step d)).

A preferred process is one wherein the steps c) and d) are repeated once, twice, three times or many times.

The liquid separation agent can be applied successively onto the individual partially filled containers, although it is preferred to carry out the application simultaneously by means of a batch process on 2, preferably 2-4, preferably 4-6, particularly preferably 6-8, quite particularly preferably 8-10, especially 10-25 partially filled containers. Here, the term "partially filled container" is understood to mean a water-soluble or water-dispersible container that was already filled with one or a plurality of detergents in step b).

The liquid separation agent can be sprayed in by means of any suitable devices for this purpose known to the person skilled in the art. Single material- or high pressure spray nozzles, spray nozzles for two materials, or spray nozzles for three materials are preferably used for spraying. For spraying with single material spray nozzles, the use of a high material pressure (5-15 MPa) is required in some cases, whereas spraying in spray nozzles for two materials is carried out by means of compressed air (0.15-0.3 MPa). Spraying with spray nozzles for two materials is more favourable, particularly in regard to potential blockages, but is more expensive due to the high consumption of compressed air. The spray nozzles for three materials, a modern development, have, in addition to the compressed air flow, an additional air delivery system for nebulization, which is intended to prevent blockages and droplet formation at the nozzle.

The liquid separation agent is applied by means of a spray device within 6 seconds, preferably 4 seconds, particularly preferably 2 seconds, quite particularly preferably 1 second and especially 0.2 seconds. Viscous separation agents can also be applied when the spray nozzles have an internal diameter between 0.2 and 5 mm, preferably between 0.2 and 4 mm, particularly preferably between 0.2 and 3 mm. Spray nozzles with internal diameters between 0.05 and 1 mm are used for low viscosity separation agents.

The droplet diameter of the sprayed separation agent is preferably between 1 and 100 μm, particularly preferably between 2 and 80 μm, quite particularly preferably between 4 and 70 μm and especially between 8 and 60 μm.

In a preferred process, the liquid separation agent solidifies after application onto the already filled detergent or cleaning agent. Likewise, a process is preferred, in which an additional component is applied to solidify the separation layer, and the solid separation layer is formed by a chemical reaction, chemisorption or physisorption.

The subject matter of the present invention is a multi-phase detergent or cleaning agent, wherein the separation layer is a solidified solution. As the liquid separation agent is preferably injected, i.e. sprayed onto the detergent or cleaning agent filled in step b), suspensions or melts or aqueous solutions are preferably employed as the separation agent.

The use of aqueous solutions is particularly advantageous in those process variants in which the first detergent or cleaning agent filled in step b) comprises solid hygroscopic substances, for example, hydratable salts. The interaction between the aqueous separation agent and the hygroscopic substance firstly accelerates the solidification of the separation agent and secondly hardens—at least the surface—of the first detergent or cleaning agent, thereby affording an improvement in the separation force of the separation agent and an increased stability and rigidity of the container.

If aqueous solutions are used as the separation layer, then the water content of these solutions is preferably between 10 and 90 wt. %, particularly preferably between 20 and 80 vol. % and quite particularly preferably between 30 and 80 wt. %.

The term "suspension" designates a specific form of dispersion, in which insoluble solid particles are comprised in liquids, plastic compounds or solidified melts. When suspensions are used as the liquid separation agent, it must be noted in this invention that larger solid particles lead to sedimentation of the suspended particles, with the result that the separation agent is no longer homogeneous. To counteract this effect, the suspension employed in the inventive process has no solid particles with particle sizes greater than 500 μm, preferably 400 μm, particularly preferably 300 μm, quite particularly preferably 200 μm, especially 100 μm. Coarser solid components are preferably comminuted in a milling process. In this context, it is particularly preferred to carry out the milling process with the already suspended filler material.

A further possibility for preventing sedimentation of the solid particles is to increase the viscosity of the suspension. In addition, the lowest possible amount of solvent is chosen. Accordingly, the employed suspensions preferably comprise less than 80 wt. %, particularly preferably less than 60 wt. %, quite particularly preferably between 1 and 40 wt. % and especially between 2 and 20 wt. % solvent.

Suspension aids also increase the stability of the suspension and are preferably employed in the inventive process. Suspension aids are preferably surface-active materials that function by increasing the wetting of the suspended particles with the solvent. Surfactants, particularly surfactants containing linear carbon chains, are preferably used. The group of the surfactants is described further below. However, polar solvents such as alcohols, ethers, pyridines and alkyl formats, are also preferably used.

In addition to suspensions, the liquid separation agent preferably comprises melts. The melting point of the melts is preferably less than 150° C., preferably less than 120° C., particularly preferably between 30 and 100° C. and especially between 40 and 80° C. Particularities that have to be taken into account when processing melts have already been discussed in the manufacture of castings.

The separation layer is intended to spatially separate different detergents or cleaning agents and thereby prevent their reaction with each other, such as, for example, the bleaching agent of one detergent or cleaning agent bleaching a colorant in another detergent or cleaning agent, and a mixing of different detergent or cleaning agents. Suitable thicknesses of the separation layer have proved to be between 1 and 1,000 μm, preferably between 1 and 300 μm, particularly preferably between 1 and 100 μm and quite particularly preferably between 1 and 40 μm.

A preferred multi-phase detergent or cleaning agent is one in which the separation layer has a thickness between 1 and 1,000 μm, preferably between 1 and 300 μm, particularly preferably between 1 and 100 μm and quite particularly preferably between 1 and 40 μm.

Moreover, the separation layer can exhibit stabilizing properties. Taking into account this and other factors, a suitable thickness of the separation layer has proved to be between 5 and 1,000 μm, preferably between 10 and 500 μm, particularly preferably between 20 and 300 μm and quite particularly preferably between 40 and 100 μm. This type of stabilizing separation layer is particularly preferably employed when flowable substances or liquids are used as the detergent or cleaning agent.

A preferred multi-phase detergent or cleaning agent is one wherein the separation layer has a thickness between 5 and 1,000 μm, preferably between 10 and 500 μm, particularly preferably between 20 and 300 μm and quite particularly preferably between 40 and 100 μm.

The object of the invention was to reduce the weight proportion of the packaging material in relation to the multi-phase detergent or cleaning agent packaged with water-soluble or water-dispersible wrapping material compared with the prior art. It is possible to reduce the material requirement by applying a liquid separation agent. In comparison with other methods, only the required amount of wrapping material—in this invention, of liquid separation agent—is used, whereas, for example, the application and sealing of a film results in trim that has to be disposed of or recycled. In addition to material savings, several process steps, the application of the film, the sealing of the container and applied film, the separation or the cutting up of excess film and the recycling of the film trimmings, are replaced by step c) in the inventive process, i.e., the application of a liquid separation agent and its solidification to form a solid separation layer.

The material savings should enable the content by weight of the separation agent, based on the total weight of the multi-phase detergent or cleaning agent that is packaged with water-soluble or water-dispersible wrapping material, to be preferably less than 10 wt. %, particularly preferably less than 8 wt. %, quite particularly preferably between 0.1 and 6 wt. % and especially between 0.5 and 4 wt. %.

In the inventive process, a liquid separation agent is preferably used, whose solidified form, i.e. the separation layer, is water-soluble or water-dispersible. Suitable ingredients of the liquid separation agent are all those agents from this field known to the person skilled in the art. However, those that comprise organic polymers and/or inorganic or organic salts are preferably used.

In addition to being suitable for the manufacture of the receiving chambers, some particularly preferred water-soluble or water-dispersible materials that are also suitable for providing the separation layer are the water-soluble polymers. Preferably employed polymers and/or copolymers from this group comprise polyvinyl alcohol, polyvinyl pyrrolidone, alkylacrylamide, acrylic acid, vinyl acetate, polyethylene oxide as the monomers, as well as their derivatives. Polymers of saturated and unsaturated carboxylic acids, cellulose that can be esterified or etherified, starches, gelatine and polysiloxanes are likewise preferred for the manufacture of the liquid separation material.

Alcohols and esters of the mono- and polycarboxylic acids, such as tartaric acid, citric acid, agaric acid and 1,2,3-propanetricarboxylic acid, trimellitic acid, trimesic acid, pyromellitic acid and mellitic acid are particularly preferably used as the monomers from the group of the saturated and unsaturated carboxylic acids. Additionally preferred polymers for the provision of the liquid separation agent are described in the section on wrapping materials. The polymers cited there can be used as the liquid separation agent both alone and in combination with one another or in combination with further substances, for example, plasticizers, slip agents or lubricants, or solubility enhancers.

A further class of compounds that is preferably used in the liquid separation agents used in the inventive process is the sugars, sugar acids and sugar alcohols. The monosaccharides, disaccharides and oligosaccharides as well as their derivatives and mixtures are preferably employed. Glucose, fructose, ribose, maltose, lactose, saccharose, maltodextrin and Isomalt® as well as mixtures of two, three, four or more mono- and/or disaccharides and/or derivatives of mono- and/or disaccharides are particularly preferred.

The sugar acids, alone or in combination with other substances such as, for example, the above-mentioned sugars, can be used as the ingredient of a preferred liquid separation agent. Preferred sugar acids are gluconic acid, galactonic acid, mannonic acid, fructonic acid, arabinonic acid, xylonic acid, ribonic acid, and 2-desoxyribonic acid and their derivatives.

Compounds from the group of the sugar alcohols, preferably mannitol, sorbitol, xylitol, dulcitol and arabitol are preferably used alone or in mixtures with these sugar acids, derivatives of sugar acids, sugars and/or sugar derivatives.

The combination of one or a plurality of organic polymers with inorganic and/or organic salts is likewise preferred. A preferred process is one wherein the liquid separation agent comprises an inorganic or organic salt.

All toxicologically acceptable salts can be used that have sufficient solubility that they are eliminated along with the wash liquor or the aqueous solution of the cleaning agent. Since they do not leave any residues on fabrics or on solid surfaces, and do not lead to incrustations, they are not detected by the consumer.

When choosing inorganic or organic salts, care should be taken that they do not undergo any reaction with the detergent or cleaning agent. In addition to the salts of the above-mentioned sugar acids, particularly preferred salts include the acetates, acrylates, adipates, alginates, aspartates, azelates, benzoates, carbamates, carbonates, chlorides, chlorosulfates, cinnamates, citrates, sulfates, enantates, fluates, fluoroborates, fluorosilicates, formates, glutamates, glycolates, hydrogen carbonates, hydrogen phosphates, hydrogen sulfates, iodides, lactates, laurates, malates, maleates, malonates, mandelates, mesylates, metaphosphates, nitrates, octoates, oleates, orotates, oxalates, pectates, pectinates, phosphates, phosphonates, pivalates, saccharates, salicylates, silicates, sorbates, stearates, succinates, sulfates, tartrates, and valerates. Alkali metal salts, alkaline earth metal salts, ammonium, zinc and/or aluminium salts are particularly preferably used. Salts that comprise sodium, potassium, magnesium, calcium, zinc, aluminum and ammonium as the cations are particularly preferred. Salts of fatty acids, particularly the soaps, are also preferred.

Additional ingredients of the liquid separation agent include adhesive systems. In the scope of the present invention, both chemically setting and physically setting adhesive systems can be used.

Physically setting adhesives generally consist of only one component and can set by the evaporation of solvents or also by changing the physical state. Examples of preferred physically setting adhesives are melt adhesives such as styrene-butadiene-copolymers, polyamides, ethylene-vinyl acetate-copolymers and polyesters, plastisol-adhesives such as polyvinyl chlorides with plasticizers and coupling agents, pressure-sensitive adhesives such as rubbers and polyacrylates, contact adhesives such as polyurethanes, polyacrylates, nitrile- or styrene-butadiene-copolymers and polychloroprenes, solvent- or dispersion adhesives such as polyurethanes, vinyl acetate-, vinyl chloride-, vinylidene chloride-copolymers, isoprene rubbers, homo- and copolymers of acrylic acid esters such as e.g. polyvinyl acetate, poly(meth) acrylates and ethylene-vinyl acetate-copolymers, glues such as glutine, starches, dextrin, casein, polyvinyl alcohol, polyvinyl pyrrolidones and cellulose ethers as well as hot sealing adhesives such as (co)polymers based on ethylene, (meth) acrylates, vinyl chloride, vinylidene chloride and vinyl acetate as well as polyamides, polyesters and polyurethanes.

Chemically setting adhesive systems, on the other hand, are based on one or a plurality of components; setting can be based on all polyreactions. Thus, two-component systems of epoxy resins and acid anhydrides or polyamines react according to polyaddition mechanisms, cyanacrylates or methacrylates according to polymerization mechanisms and systems based on aminoplasts or phenoplasts according to polycondensation mechanisms. Examples of preferred chemically setting adhesive systems are: epoxy resins with acid anhydrides, epoxy resins with polyamines, polyisocyanates with polyols, cyanacrylates, methacrylates, unsaturated polyesters with styrene or methacrylates, silicone resins with moisture, phenol resins with polyvinyl formals or acrylic-1,3-butadiene rubber, polyimides or polybenzimidazoles, urea resins, melamine-formaldehyde resins, phenol resins and resorcinol-formaldehyde resins.

Polyanhydride resins, coumarone-indene resins and isocyanate resins are also preferred.

The separation layer formed in step c) should be at least partially transparent or translucent, as this property improves the visual impression gained by the consumer from the end product of the process. Accordingly, a preferred embodiment of the inventive process is wherein the separation layer formed in step c) is at least partially transparent or translucent.

A multi-phase detergent or cleaning agent is preferred wherein the separation layer is at least partially transparent or translucent.

Transparency is understood to mean here that the transmittance in the visible spectrum of light (410 to 800 nm) is greater than 20%, advantageously greater than 30%, most preferably greater than 40% and in particular, greater than 50%. Thus, as soon as a wavelength of the visible spectrum of light has a transmittance greater than 20%, then in the context of the invention it is to be considered as transparent.

The separation agent is preferably colored to further improve the visual impression. The preferred colors include red, yellow, blue as well as their mixed colors such as green, violet and lilac.

Within a preferred embodiment of the inventive process to manufacture the separation layer, the transparent separation agent used for its manufacture may comprise a stabilizer. Antioxidants, UV-absorbers and fluorescent dyes have proven to be particularly suitable. The stabilizers have already been described for the wrapping materials of the water-soluble and water-dispersible container.

Filling the Container According to Point d).

After having applied the separation layer, the container is filled with an additional detergent or cleaning agent that forms an additional phase. Both flowable, solid and also liquid detergents or cleaning agents can be filled in this step. Thus, the addition of preferably flowable powders, granules, castings or capsules as well as the addition of gels and liquids is preferred in step d) of the inventive process.

To avoid repetition, since the solids and liquids have already been described above, reference may be made there.

Inventive processes, in which flowable or liquid detergents or cleaning agents are filled in step b) and/or step d), are inventively preferred.

Preferably, water-soluble or water-dispersible containers are used in the inventive process, in which the total container is divided by intermediate walls into two, preferably three, particularly preferably four, quite particularly preferably five or more receiving chambers. These intermediate walls can end at the height at which the separation layer will be applied, such that above the separation layer, there will be only one receiving chamber to be filled. However, in a preferred embodiment of the process, the intermediate walls are as high as the external walls of the container, such that at least two, preferably three, particularly preferably four, quite particularly preferably five or more receiving chambers are available for filling above the separation layer. Also, containers in which some of the intermediate walls are as high as the separation layer, while other walls are as high as the external walls of the container, are also suitable in the context of the present invention for the manufacture of multi-phase cleaning agents. In this case, the number of the receiving chambers to be filled in step d) is preferably one, particularly preferably two, quite particularly preferably three, especially four, less than the number of receiving chambers to be filled in step b).

In the inventive process, the receiving chambers can be filled simultaneously or sequentially. In a further preferred embodiment of the inventive process, one, preferably two, three or four of the receiving chambers located above the separation layer is/are not filled in order to increase the buoyancy of the multi-phase detergent or cleaning agent.

The receiving chambers of a container, which has at least two receiving chambers above the separation layer, are preferably filled with the same agent in step d). However, it is preferred that at least one, particularly preferably two, quite particularly preferably three, especially four of the agents possess(es) a composition and/or a physical state which do(es) not correspond to any other of the agents filled in step d). It is particularly preferred that all the agents filled in step d) differ in their composition and/or their physical state.

The receiving chambers of a container, which has at least two receiving chambers, are preferably filled with the same agent in step b) and in step d). However, it is preferred that at least one, particularly preferably two, quite particularly preferably three, especially four of the agents possess(es) a composition and/or a physical state which do(es) not correspond to any other of the agents filled in steps b) and d). It is particularly preferred that all the agents filled in steps b) and d) differ in their composition and/or their physical state.

A preferred embodiment of the inventive process is wherein at least one of the detergents or cleaning agents filled in steps b) and d) is a solid.

A preferred embodiment of the inventive process is wherein at least one of the detergents or cleaning agents filled in steps b) and d) is a liquid.

In a preferred process, the ratio of the fill height of the detergent and cleaning agent underneath the separation layer to the fill height of the detergent above the separation layer is between 9:1 and 1:9, preferably between 5:1 and 1:2, particularly preferably between 3:1 and 1:1 and quite particularly preferably between 1:1 and 1:0.2.

An inventive process, in which steps c) and d) are repeated once, twice, three times or many times, is particularly preferred.

Sealing with a Water-Soluble Film According to Point e).

In step d), one, preferably two, particularly preferably three, especially four additional detergents or cleaning agents is/are filled on top of the separation layer formed by the solidification of the liquid separation agent. Preferably, this/these cleaning agent(s) is/are not covered with a wrapping material, i.e. sealed. However, in a further preferred embodiment of the inventive process, the filled receiving chamber(s) can be sealed with a wrapping material after filling. The sealing is preferably effected by the action of pressure and/or heat and/or solvent. The additional wrapping material used for sealing can be identical to the wrapping material or liquid separation agent employed in step a) or in step c) of the inventive process, but can also differ in its composition or thickness from both these materials.

A preferred embodiment of the inventive process is one wherein the filled container is sealed up with a water-soluble film in an additional step e).

In a preferred embodiment of the process according to the invention, the surface of the wrapping material is first etched with a solvent before sealing (in the case of water-soluble films, water is particularly suitable) and then adhesively bonded to the water-soluble or water-dispersible container. Alternatively, the sealing can also be effected through the action of pressure and/or heat. Suitable sealing temperatures for water-soluble wrapping materials are e.g. 120 to 200° C., preferably temperatures in the range 130 to 170° C., particularly temperatures in the range 140 to 150° C. Pressures in the range 250 to 800 kPa, preferably 272 to 554 kPa, particularly preferably 341 to 481 kPa have proved to be advantageous sealing pressures. The sealing times preferably range from at least 0.3 seconds, preferably between 0.4 and 4 seconds. Sealing temperatures, pressures and sealing times also depend on the sealing machine in addition to the wrapping material.

In addition to the above-mentioned sealing possibilities for the wrapping materials, laser melting is preferably employed. Furthermore, methods that utilize infrared, ultra sound or radio frequency waves are preferred.

The wall thicknesses of the water-soluble films used for sealing the container in step e) are preferably between 20 and 800 μm, particularly preferably between 30 and 600 μm, quite particularly preferably between 40 and 400 μm and especially between 50 and 200 μm.

In a preferred inventive process, the width of the sealing seams is between 0.5 and 7 mm, particularly preferably between 1.0 and 6 mm and quite particularly preferably between 1.5 and 5 mm. Sealing seam widths greater than 2 mm, preferably more than 2.5 mm, particularly preferably greater than 3 mm and quite particularly preferably greater than 3.5 mm have proven to be sufficiently stable. As the width of the sealing seam, depending on the production, can also vary for a single package, the cited data for the width of the sealing seam are for the minimal seam width measured on a single package. Sealing is carried out especially when the filling material is a liquid or is flowable. Examples of filler materials of this type are liquids, gels or particulate solids like powders.

If a liquid separation agent that can form a separation layer on solidification is employed for sealing the detergent or cleaning agent portion in step e), then the separation agent is preferably identical to the separation agent used in step c). However, the use of all other available liquid separation agents that were described above is also possible. Liquid separation agents that adhesively bond to the water-soluble or water-dispersible container are preferably employed, thereby obviating a sealing, i.e., a treatment with heat or solvents. Preferably, the thickness of the seal obtained from the use of a liquid separation agent in step e) is 5 to 1,000 μm, particularly preferably between 10 and 500 μm, quite particularly preferably between 20 and 300 μm and especially between 40 and 100 μm.

However, in some cases, thicknesses between 1 and 1,000 μm, preferably between 1 and 300 μm, particularly preferably between 1 and 100 μm and quite particularly preferably between 1 and 40 μm can be preferred.

By sealing the receiving chambers, not only can a contact between the filled active principle or mixture of active principles, the surrounding atmosphere (e.g., atmospheric oxygen, air humidity) or a skin contact with the consumer be avoided, but at the same time the sealing also enables the release of the active principles located inside the sealed cavity to be controlled by the choice of suitable sealing materials. An example of such control is the use of water-soluble or water-dispersible sealing and/or wrapping materials of different solubilities, with the aim of releasing the contents of individual receiving chambers into the surrounding aqueous medium in a defined order. Thus, in the context of the present application, processes can be implemented, in which the wrapping materials used for sealing the receiving chambers are made of the same or different materials. In a preferred embodiment, the same wrapping materials are employed for sealing the receiving chambers. This embodiment enables the fillers located under the sealed surfaces to be released at the same time. In a further preferred embodiment, the materials used for sealing the receiving chambers are different.

In a further preferred process variant, the liquid separation agent is not solely applied onto the first phase of the detergent or cleaning agent, but preferably, also sprayed on the inner and/or outer walls of the water-soluble or water-dispersible container. In this way, not only are the shape stability and transport stability of the container manufactured according to the inventive process increased, but also, insofar as the separation agent is applied in the area of the wall that is later bonded with the sealing film applied in step e), the adhesion strength of this sealing film is further increased.

Prior to, at the same time, or after this last sealing step, the containers manufactured according to the inventive process are separated, preferably by using knives or punches, to form a rim running round the upper side of the container. In addition to other parameters, the width of this rim is also dependent upon the choice of the process used for manufacturing the appropriate container.

Among others, two variants can be differentiated in this process, which are particularly preferred for carrying out the inventive process. They are the process in which the wrapping material is fed into a molding station and from there fed horizontally for filling and/or sealing and/or separation, wherein again one can differentiate between continuous and discontinuous processes, and processes, in which the wrapping material is fed over a continuously circulating molding cylinder. In carrying out continuous processes, in which the molded wrapping material remains in the deep drawing cavity or cast mold after the manufacture of the water-soluble or water-dispersible container, there is the tendency to realize smaller rim widths in the range of 1 to 4 mm, whereas in discontinuous processes the rim widths are rather in the range 2.5 to 5 mm.

Additional Ingredients.

The above described inventive agents, or the agents manufactured according to the above described inventive processes, comprise active detergent and cleaning substances, preferably active detergent and cleaning substances from the group of builders, surfactants, polymers, bleaching agents, bleach activators, enzymes, glass corrosion inhibitors, corrosion inhibitors, disintegration auxiliaries, fragrances and perfume carriers. These preferred ingredients are more closely described below.

Builders.

The builders include especially the zeolites silicates, carbonates, organic co-builders and also—where there are no ecological reasons preventing their use—phosphates.

Of the suitable fine crystalline, synthetic zeolites containing bound water, zeolite A and/or P are preferred. Zeolite MAP® (commercial product of the Crosfield company), is particularly preferred as the zeolite P. However, zeolite X and mixtures of A, X, Y and/or P are also suitable. Commercially available and preferably used in the context of the present invention is, for example, also a co-crystallizate of zeolite X and zeolite A (approximately 80 wt. % zeolite X), which is marketed under the name of VEGOBOND Ax® by SASOL and which can be described by the formula $$n\mathrm{Na_2O}.(1-n)\mathrm{K_2O}.\mathrm{Al_2O_3}.(2\text{-}2.5)\mathrm{SiO_2}.(3.5\text{-}5.5)\mathrm{H_2O}$$

The zeolite can be added both as the builder in a granular compound as well as being used as a type of "dusting" of a granular mixture, preferably a mixture to be pressed, wherein normally, both ways are used to incorporate the zeolite in the premix. Suitable zeolites have a mean particle size of less than 10 μm (volume distribution, as measured by the Coulter Counter Method) and comprise preferably 18 to 22% by weight and more preferably 20 to 22% by weight of bound water.

Suitable crystalline, layered sodium silicates correspond to the general formula $NaMSi_xO_{2x+1}.H_2O$, wherein M is sodium or hydrogen, x is a number from 1.9 to 4 and y is a number from 0 to 20, preferred values for x being 2, 3 or 4. Preferred crystalline layered silicates of the given formula are those in which M stands for sodium and x assumes the values 2 or 3. Both β- and δ-sodium disilicates $Na_2Si_2O_5.yH_2O$ are preferred.

When the silicates are incorporated as a component of dishwasher detergents, then they preferably comprise at least one crystalline layer-forming silicate of the general formula $NaMSi_xO_{2x+1}.y\ H_2O$, wherein M represents sodium or hydrogen, x is a number from 1.9 to 22, preferably 1.9 to 4 and y stands for a number from 0 to 33. The crystalline layer-forming silicates of the formula $NaMSi_xO_{2x+1}.y\ H_2O$ are marketed, for example, by Clariant GmbH (Germany) under the trade names Na—SKS. Examples of these silicates are Na—SKS-1, ($Na_2Si_{22}O_{45}x\ H_2O$, Kenyait), (Na—SKS-2, $Na_2Si_{14}O_{29}x\ H_2O$, Magadiit), Na—SKS-3 ($Na_2Si_8O_{17}.x\ H_2O$) or Na—SKS-4 ($Na_2Si_4O_9.x\ H_2O$, Makatit).

Crystalline, layered silicates of formula $NaMSi_xO_{2x+1}$, in which x stands for 2, are particularly suitable for the purposes of the present invention. Na—SKS-5 (α-$Na_2Si_2O_5$), Na—SKS-7 (β-$Na_2Si_2O_5$, Natrosilit), Na—SKS-9 ($NaHSi_2O_5.H_2O$), Na—SKS-10 ($NaHSi_2O_5.3H_2O$, Kanemit), Na—SKS-11 (t-$Na_2Si_2O_5$) and Na—SKS-13 ($NaHSi_2O_5$), are most notably suitable, particularly, however, Na—SKS-6 (δ—$Na_2Si_2O_5$).

If silicates are incorporated as components of dishwasher detergents, then these agents comprise a content by weight of crystalline layered silicates of formula $NaMSi_xO_{2x+1}.y\ H_2O$ of 0.1 to 20 wt. %, preferably 0.2 to 15 wt. % and particularly 0.4 to 10 wt. %, each based on the total weight of the agent. Particularly preferred are those dishwasher detergents that have a total silicate content below 7 wt. %, advantageously below 6 wt. %, preferably below 5 wt. %, particularly preferably below 4 wt. %, quite particularly preferably below 3 wt. % and especially below 2.5 wt. %, wherein this silicate, based on the total weight of the comprised silicate is advantageously at least 70 wt. %, preferably at least 80 wt. % and particularly preferably at least 90 wt. % of a silicate of the general formula $NaMS_xO_{2x+1}.y\ H_2O$.

Other useful builders are amorphous sodium silicates with a modulus ($Na_2O:SiO_2$ ratio) of 1:2 to 1:3.3, preferably 1:2 to 1:2.8 and especially 1:2 to 1:2.6, which dissolve with a delay and exhibit multiple wash cycle properties. The delay in dissolution compared with conventional amorphous sodium silicates can be obtained in various ways, for example, by surface treatment, compounding, compressing/compacting or by over-drying. In the context of this invention, the term "amorphous" also means "X-ray amorphous." In other words, the silicates do not produce any of the sharp X-ray reflections typical of crystalline substances, but at best one or more maxima of the scattered X-radiation, which have a width of several degrees of the diffraction angle. However, particularly good builder properties may even be achieved where the silicate particles produce indistinct or even sharp diffraction maxima in electron diffraction experiments. This can be interpreted to mean that the products have microcrystalline regions between ten and a few hundred nm in size, values of up to at most 50 nm and especially up to at most 20 nm being preferred. This type of X-ray amorphous silicates similarly possesses a delayed dissolution in comparison with the customary water glasses. Compacted/densified amorphous silicates, compounded amorphous silicates and over dried X-ray-amorphous silicates are particularly preferred.

In the context of the present invention, detergents and cleaning agents preferably comprise silicate(s), preferably alkali silicates, particularly preferably crystalline or amorphous alkali disilicates in quantities of 10 to 60 wt. %, preferably 15 to 50 wt. % and especially 20 to 40 wt. %, each based on the weight of the detergent or cleaning agent.

Naturally, the generally known phosphates can also be added as builders, insofar that their use should not be avoided on ecological grounds. This is particularly true for the employment of the inventive agent, or the agent manufactured by the inventive process, as the dishwasher detergent, as is particularly preferred in the context of the present application. In the detergent and cleansing agent industry, among the many commercially available phosphates, the alkali metal phosphates are the most important and pentasodium or pentapotassium triphosphates (sodium or potassium tripolyphosphate) are particularly preferred.

"Alkali metal phosphates" is the collective term for the alkali metal (more particularly sodium and potassium) salts of the various phosphoric acids, in which metaphosphoric acids $(HPO_3)_n$ and orthophosphoric acid ($H_3PO_4$) and representatives of higher molecular weight can be differentiated. The phosphates combine several inherent advantages: They act as alkalinity sources, prevent lime deposits on machine parts and lime incrustations in fabrics and, in addition, contribute to cleansing power.

Exemplary suitable phosphates are sodium dihydrogen phosphate, $NaH_2PO_4$, in the form of the dihydrate (density 1.91 $gcm^{-3}$, melting point 60° C.) or in the form of the monohydrate (density 2.04 $gcm^{-3}$), disodium hydrogen phosphate (secondary sodium phosphate) $Na_2HPO_4$, that can be added in anhydrous form or with 2 mole (density 2.066 $gcm^{-3}$, water loss at 95° C.), 7 mole (density 1.68 $gcm^{-3}$, melting point 48° C. losing $5H_2O$) and 12 mole water (density 1.52 $gcm^{-3}$, melting point 35° C. losing $5H_2O$), in particular, however, trisodium phosphate (tertiary sodium phosphate) $Na_3PO_4$, that can be added as the dodecahydrate, as the decahydrate (corresponding to 19-20% $P_2O_5$) and in anhydrous form (corresponding to 39-40% $P_2O_5$).

A further preferred phosphate is tripotassium phosphate (tertiary or tribasic potassium phosphate), $K_3PO_4$. Further preferred is tetrasodium diphosphate (sodium pyrophosphate), $Na_4P_2O_7$, which exists in anhydrous form (density 2.534 $gcm^{-3}$, melting point 988°, a figure of 880° has also been mentioned) and as the decahydrate (density 1.815-1.836 $gcm^{-3}$, melting point 94° with loss of water), as well as the corresponding potassium salt potassium diphosphate (potassium pyrophosphate) $K_4P_2O_7$.

The industrially important pentasodium triphosphate, $Na_5P_3O_{10}$ (sodium tripolyphosphate), is anhydrous or crystallizes with $6H_2O$ to a non-hygroscopic white water-soluble salt of the general formula NaO—$[P(O)(ONa)—O]_n$—Na where n=3. The corresponding potassium salt pentapotassium triphosphate $K_5P_3O_{10}$ (potassium tripolyphosphate), is commercialized, for example, in the form of a 50 wt. % solution (>23% $P_2O_5$, 25% $K_2O$). The potassium polyphosphates are widely used in the detergent industry. Sodium potassium tripolyphosphates also exist and are also usable in the scope of the present invention. They are formed for example, when sodium trimetaphosphate is hydrolyzed with KOH:

$$(NaPO_3)_3+2KOH \rightarrow Na_3K_2P_3O_{10}+H_2O$$

According to the invention, they may be used in exactly the same way as sodium tripolyphosphate, potassium tripolyphosphate or mixtures thereof. Mixtures of sodium tripolyphosphate and sodium potassium tripolyphosphate, or mixtures of potassium tripolyphosphate and sodium potassium tripolyphosphate, or mixtures of sodium tripolyphosphate and potassium tripolyphosphate and sodium potassium tripolyphosphate may also be used in accordance with the invention.

In the context of the present invention, if phosphates are incorporated as the active detergent or cleaning substances in detergents or cleaning agents, then preferred agents comprise this/these phosphate(s), preferably alkali metal phosphate(s), particularly preferably pentasodium or pentapotassium triphosphate (sodium or potassium triphosphate) in quantities of 5 to 80 wt. %, preferably 15 to 75 wt. % and particularly preferably 20 to 70 wt. %, each based on the weight of the detergent or cleaning agent.

It is preferred to incorporate potassium tripolyphosphate and sodium tripolyphosphate in a proportion by weight of greater than 1:1, preferably greater than 2:1, particularly preferably greater than 5:1, quite particularly preferably greater than 10:1 and especially greater than 20:1. It is particularly preferred to incorporate potassium tripolyphosphate exclusively, without the addition of other phosphates.

Further builders are the alkalinity sources. Alkali metal hydroxides, alkali metal carbonates, alkali metal hydrogen carbonates, alkali metal sesquicarbonates, the cited alkali silicates, alkali metal silicates and mixtures of the cited materials are examples of alkalinity sources that can be used, the alkali carbonates being preferably used, especially sodium carbonate, sodium hydrogen carbonate or sodium sesquicarbonate in the context of this invention. A builder system comprising a mixture of tripolyphosphate and sodium carbonate is particularly preferred. A builder system comprising a mixture of tripolyphosphate and sodium carbonate and sodium disilicate is also particularly preferred. Because of their low chemical compatibility—in comparison with other builders—with the usual ingredients of detergents and cleaning agents, the alkali metal hydroxides are preferably only incorporated in low amounts, advantageously in amounts below 10 wt. %, preferably below 6 wt. %, particularly preferably below 4 wt. % and quite particularly preferably below 2 wt. %, each based on the total weight of the detergent or cleaning agent. Agents that comprise less than 0.5 wt. %, based on the total weight, and, in particular, no alkali metal hydroxide, are particularly preferred.

Particularly preferred detergents and cleaning agents comprise carbonate(s) and/or hydrogen carbonate(s), preferably alkali carbonate(s), particularly preferably sodium carbonate in quantities of 2 to 50 wt. %, quite particularly preferably 5 to 40 wt. % and especially 7.5 to 30 wt. %, each based on the weight of the detergent or cleaning agent. Particularly preferred agents comprise, based on the weight of the detergent or cleaning agent, less than 20 wt. %, advantageously less than 17 wt. %, preferably less than 13 wt. % and particularly preferably less than 9 wt. % carbonate(s) and/or hydrogen carbonate(s), preferably alkali carbonates, particularly preferably sodium carbonate.

Organic co-builders include, in particular, polycarboxylates/polycarboxylic acids, polymeric polycarboxylates, aspartic acid, polyacetals, dextrins, other organic co-builders (see below) and phosphonates. These classes of substances are described below.

Useful organic builders are, for example, the polycarboxylic acids usable in the form of their sodium salts, polycarboxylic acids in this context being understood to be carboxylic acids that carry more than one acid function. These include, for example, citric acid, adipic acid, succinic acid, glutaric acid, malic acid, tartaric acid, maleic acid, fumaric acid, sugar acids, aminocarboxylic acids, nitrilotriacetic acid (NTA), providing its use is not ecologically unsafe, and mixtures thereof. Preferred salts are the salts of polycarboxylic acids such as citric acid, adipic acid, succinic acid, glutaric acid, tartaric acid, sugar acids and mixtures thereof.

Acids per se can also be used. In addition to their building effect, the acids also typically have the property of an acidifying component and, hence also serve to establish a relatively low and mild pH in detergents and cleaning agents. Citric acid, succinic acid, glutaric acid, adipic acid, gluconic acid and any mixtures thereof are particularly mentioned in this regard.

Other suitable builders are additional polymeric polycarboxylates, for example, the alkali metal salts of polyacrylic or polymethacrylic acid, for example, those with a relative molecular weight of 500 to 70,000 g/mol.

The molecular weights mentioned in this specification for polymeric polycarboxylates are weight-average molecular weights $M_w$ of the particular acid form which, fundamentally, were determined by gel permeation chromatography (GPC), equipped with a UV detector. The measurement was carried out against an external polyacrylic acid standard, which provides realistic molecular weight values by virtue of its structural similarity to the polymers investigated. These values differ significantly from the molecular weights measured against polystyrene sulfonic acids as standard. The molecular weights measured against polystyrene sulfonic acids are generally significantly higher than the molecular weights mentioned in this specification.

Particularly suitable polymers are polyacrylates, which preferably have a molecular weight of 2,000 to 20,000 g/mol. By virtue of their superior solubility, preferred representatives of this group are again the short-chain polyacrylates, which have molecular weights of 2,000 to 10,000 g/mol and, more particularly, 3,000 to 5,000 g/mol.

Further suitable copolymeric polycarboxylates are particularly those of acrylic acid with methacrylic acid and of acrylic acid or methacrylic acid with maleic acid. Copolymers of acrylic acid with maleic acid, which comprise 50 to 90 wt. % acrylic acid and 50 to 10 wt. % maleic acid, have proven to be particularly suitable. Their relative molecular weight, based on free acids, generally ranges from 2,000 to 70,000 g/mol, preferably 20,000 to 50,000 g/mol and particularly preferably 30,000 to 40,000 g/mol.

The (co)polymeric polycarboxylates can be added either as powders or as aqueous solutions. The (co)polymeric polycarboxylate content of the detergents or cleaning agents is preferably from 0.5 to 20% by weight, in particular, from 3 to 10% by weight.

In order to improve the water solubility, the polymers can also comprise allylsulfonic acids as monomers, such as for example, allyloxybenzenesulfonic acid and methallylsulfonic acid.

Particular preference is also given to biodegradable polymers comprising more than two different monomer units, examples being those comprising, as monomers, salts of acrylic acid and of maleic acid, and also vinyl alcohol or vinyl alcohol derivatives, or those comprising, as monomers, salts of acrylic acid and of 2-alkylallylsulfonic acid, and also sugar derivatives.

Other preferred copolymers are those which preferably contain acrolein and acrylic acid/acrylic acid salts or acrolein and vinyl acetate as monomers.

Similarly, other preferred builders are polymeric aminodicarboxylic acids, salts or precursors thereof. Polyaspartic acids or their salts are particularly preferred.

Further preferred builders are polyacetals that can be obtained by treating dialdehydes with polyol carboxylic acids that possess 5 to 7 carbon atoms and at least 3 hydroxyl groups. Preferred polyacetals are obtained from dialdehydes like glyoxal, glutaraldehyde, terephthalaldehyde as well as their mixtures and from polycarboxylic acids like gluconic acid and/or glucoheptonic acid.

Further suitable organic builders are dextrins, for example, oligomers or polymers of carbohydrates that can be obtained by the partial hydrolysis of starches. The hydrolysis can be carried out using typical processes, for example, acidic or enzymatic catalyzed processes. The hydrolysis products preferably have average molecular weights in the range 400 to 500,000 g/mol. A polysaccharide with a dextrose equivalent (DE) of 0.5 to 40 and, more particularly, 2 to 30 is preferred, the DE being an accepted measure of the reducing effect of a polysaccharide in comparison with dextrose, which has a DE of 100. Both maltodextrins with a DE between 3 and 20, and dry glucose syrups with a DE between 20 and 37, and also so-called yellow dextrins and white dextrins with relatively high molecular weights of 2,000 to 30,000 g/mol may be used.

The oxidized derivatives of such dextrins concern their reaction products with oxidizing agents that are capable of oxidizing at least one alcohol function of the saccharide ring to the carboxylic acid function.

Oxydisuccinates and other derivatives of disuccinates, preferably ethylenediamine disuccinate are also further suitable cobuilders. Ethylenediamine-N,N'-disuccinate (EDDS) is preferably used here in the form of its sodium or magnesium salts. In this context, glycerine disuccinates and glycerine trisuccinates are also preferred. Suitable addition quantities in zeolite-containing and/or silicate-containing formulations range from 3 to 15% by weight.

Other useful organic co-builders are, for example, acetylated hydroxycarboxylic acids and salts thereof which optionally may also be present in lactone form and which contain at least 4 carbon atoms, at least one hydroxyl group and at most two acid groups.

In addition, any compounds capable of forming complexes with alkaline earth metal ions may be used as co-builders.

Surfactants.

The group of surfactants includes the nonionic, the anionic, the cationic and the amphoteric surfactants.

All nonionic surfactants known to the person skilled in the art can be used as the nonionic surfactants. The preferred surfactants are weakly foaming nonionic surfactants. Detergents or cleaning agents, particularly cleaning agents for automatic dishwashers, are especially preferred when they comprise nonionic surfactants, particularly nonionic surfactants from the group of the alkoxylated alcohols. Preferred nonionic surfactants are alkoxylated, advantageously ethoxylated, particularly primary alcohols preferably containing 8 to 18 carbon atoms and, on average, 1 to 12 moles of ethylene oxide (EO) per mole of alcohol, in which the alcohol group may be linear or, preferably, methyl-branched in the 2-position or may contain linear and methyl-branched groups in the form of the mixtures typically present in oxoalcohol groups. Particularly preferred are, however, alcohol ethoxylates with linear groups from alcohols of natural origin with 12 to 18 carbon atoms, e.g., from coco-, palm-, tallow- or oleyl alcohol, and an average of 2 to 8 EO per mol alcohol. Exemplary preferred ethoxylated alcohols include $C_{12-14}$-alcohols with 3 EO or 4EO, $C_{9-11}$-alcohols with 7 EO, $C_{13-15}$-alcohols with 3 EO, 5 EO, 7 EO or 8 EO, $C_{12-18}$-alcohols with 3 EO, 5 EO or 7 EO and mixtures thereof, as well as mixtures of $C_{12-14}$-alcohol with 3 EO and $C_{12-18}$-alcohol with 5 EO. The cited degrees of ethoxylation constitute statistically average values that can be a whole or a fractional number for a specific product. Preferred alcohol ethoxylates have a narrowed homolog distribution (narrow range ethoxylates, NRE). In addition to these nonionic surfactants, fatty alcohols with more than 12 EO can also be used. Examples of these are tallow fatty alcohol with 14 EO, 25 EO, 30 EO or 40 EO.

Furthermore, as additional nonionic surfactants, alkyl glycosides that satisfy the general formula $RO(G)_x$ can be added, where R means a primary linear or methyl-branched, particularly 2-methyl-branched, aliphatic group containing 8 to 22 and preferably 12 to 18 carbon atoms and G stands for a glycose unit containing 5 or 6 carbon atoms, preferably glucose. The degree of oligomerization x, which defines the distribution of monoglycosides and oligoglycosides, is any number between 1.0 and 10, preferably between 1.2 and 1.4.

Another class of preferred nonionic surfactants which may be used, either as the sole nonionic surfactant or in combination with other nonionic surfactants, is alkoxylated, preferably ethoxylated or ethoxylated and propoxylated fatty acid alkyl esters preferably containing 1 to 4 carbon atoms in the alkyl chain.

Nonionic surfactants of the amine oxide type, for example, N-coco alkyl-N,N-dimethylamine oxide and N-tallow alkyl-N,N-dihydroxyethylamine oxide, and the fatty acid alkanolamides may also be suitable. The quantity in which these nonionic surfactants are used is preferably no more than the quantity in which the ethoxylated fatty alcohols are used and, particularly no more than half that quantity.

Other suitable surfactants are polyhydroxyfatty acid amides corresponding to the formula,

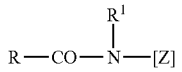

in which RCO stands for an aliphatic acyl group with 6 to 22 carbon atoms, $R^1$ for hydrogen, an alkyl or hydroxyalkyl group with 1 to 4 carbon atoms and [Z] for a linear or branched polyhydroxyalkyl group with 3 to 10 carbon atoms and 3 to 10 hydroxyl groups. The polyhydroxyfatty acid amides are known substances, which may normally be obtained by reductive amination of a reducing sugar with ammonia, an alkylamine or an alkanolamine and subsequent acylation with a fatty acid, a fatty acid alkyl ester or a fatty acid chloride.

The group of polyhydroxyfatty acid amides also includes compounds corresponding to the formula

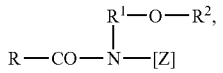

in which R is a linear or branched alkyl or alkenyl group containing 7 to 12 carbon atoms, $R^1$ is a linear, branched or cyclic alkyl group or an aryl radical containing 2 to 8 carbon atoms and $R^2$ is a linear, branched or cyclic alkyl group or an aryl group or an oxyalkyl group containing 1 to 8 carbon atoms, $C_{1-4}$-alkyl- or phenyl groups being preferred, and [Z] is a linear polyhydroxyalkyl group, of which the alkyl chain is substituted by at least two hydroxyl groups, or alkoxylated, preferably ethoxylated or propoxylated derivatives of that group.

[Z] is preferably obtained by reductive amination of a reducing sugar, for example, glucose, fructose, maltose, lactose, galactose, mannose or xylose. The N-alkoxy- or N-aryloxy-substituted compounds may then be converted into the required polyhydroxyfatty acid amides by reaction with fatty acid methyl esters in the presence of an alkoxide as catalyst.

Moreover, surfactant(s) that comprise one or more tallow fat alcohols with 20 to 30 EO in combination with a silicone defoamer are particularly preferably used.

Nonionic surfactants from the group of the alkoxylated alcohols, particularly preferably from the group of the mixed alkoxylated alcohols and especially from the group of the EO-AO-EO-nonionic surfactants are likewise incorporated with particular preference.

Nonionic surfactants that have a melting point above room temperature are used with particular preference. Nonionic surfactant(s) with a melting point above 20° C., preferably above 25° C., particularly preferably between 25 and 60° C. and, quite particularly preferably between 26.6 and 43.3° C., is/are particularly preferred.

Suitable nonionic surfactants with a melting and/or softening point in the cited temperature range are, for example, weakly foaming nonionic surfactants that can be solid or highly viscous at room temperature. If nonionic surfactants are used that are highly viscous at room temperature, then it is preferred that they have a viscosity greater than 20 Pa s, preferably above 35 Pa s and especially above 40 Pa s. Nonionic surfactants that have a waxy consistency at room temperature are also preferred.

Preferred surfactants that are solid at room temperature are used and belong to the groups of the alkoxylated nonionic surfactants, in particular, the ethoxylated primary alcohols, and mixtures of these surfactants with structurally more complex surfactants, such as polyoxypropylene/polyoxyethylene/polyoxypropylene ((PO/EO/PO) surfactants). Such (PO/EO/PO)-nonionic surfactants are characterized in addition as having good foam control In one preferred embodiment of the present invention, the nonionic surfactant with a melting point above room temperature is an ethoxylated nonionic surfactant that results from the reaction of a monohydroxyalkanol or alkylphenol containing 6 to 20 carbon atoms with preferably at least 12 moles, particularly preferably at least 15 moles and quite particularly preferably at least 20 moles of ethylene oxide per mole of alcohol or alkylphenol.

A particularly preferred nonionic surfactant that is solid at room temperature is obtained from a straight-chain fatty alcohol containing 16 to 20 carbon atoms ($C_{16-20}$ alcohol), preferably a $C_{18}$ alcohol, and at least 12 moles, preferably at least 15 moles and more preferably at least 20 moles of ethylene oxide. Of these nonionic surfactants, the so-called narrow range ethoxylates (see above) are particularly preferred.

Accordingly, ethoxylated nonionic surfactant(s) prepared from $C_{6-20}$-monohydroxy alkanols or $C_{6-20}$-alkyl phenols or $C_{16-20}$-fatty alcohols and more than 12 mole, preferably more than 15 mole and especially more than 20 mole ethylene oxide per mole alcohol, are used with particular preference.

Preferably, the room temperature solid nonionic surfactant additionally has propylene oxide units in the molecule. These PO units preferably make up as much as 25% by weight, more preferably as much as 20% by weight and, especially up to 15% by weight of the total molecular weight of the nonionic surfactant. Particularly preferred nonionic surfactants are ethoxylated monohydroxyalkanols or alkylphenols, which have additional polyoxyethylene-polyoxypropylene block copolymer units. The alcohol or alkylphenol component of these nonionic surfactant molecules preferably makes up more than 30 wt. %, more preferably more than 50 wt. % and most preferably more than 70 wt. % of the total molecular weight of these nonionic surfactants. Preferred agents are characterized in that they comprise ethoxylated and propoxylated nonionic surfactants, in which the propylene oxide units in the molecule preferably make up as much as 25% by weight, more preferably as much as 20% by weight and, especially up to 15% by weight of the total molecular weight of the nonionic surfactant.

Other particularly preferred nonionic surfactants with melting points above room temperature contain 40 to 70% of a polyoxypropylene/polyoxyethylene/polyoxypropylene block polymer blend that contains 75% by weight of an inverted block copolymer of polyoxyethylene and polyoxypropylene with 17 moles of ethylene oxide and 44 moles of propylene oxide and 25% by weight of a block copolymer of polyoxyethylene and polyoxypropylene initiated with trimethylolpropane and containing 24 moles of ethylene oxide and 99 moles of propylene oxide per mole of trimethylolpropane.

Nonionic surfactants, which may be used with particular advantage are obtainable, for example, under the name of Poly Tergent® SLF-18 from Olin Chemicals.

Surfactants of the formula $$R^1O[CH_2CH(CH_3)O]_x[CH_2CH_2O]_yCH_2CH(OH)R^2,$$

in which $R^1$ stands for a linear or branched aliphatic hydrocarbon radical with 4 to 18 carbon atoms or mixtures thereof, $R^2$ means a linear or branched hydrocarbon radical with 2 to 26 carbon atoms or mixtures thereof and x stands for values between 0.5 and 1.5 and y stands for a value of at least 15.

Other preferred nonionic surfactants are the end-capped poly(oxyalkylated) nonionic surfactants corresponding to the following formula $$R^1O[CH_2CH(R^3)O]_x[CH_2]_kCH(OH)[CH_2]_jOR^2,$$

in which $R^1$ and $R^2$ stand for linear or branched, saturated or unsaturated, aliphatic or aromatic hydrocarbon groups with 1 to 30 carbon atoms, $R^3$ stands for H or for a methyl, ethyl, n-propyl, isopropyl, n-butyl, 2-butyl or 2-methyl-2-butyl group, x stands for values between 1 and 30, k and j for values between 1 and 12, preferably between 1 and 5. Each $R^3$ in the above formula $R^1O[CH_2CH(R^3)O]_x[CH_2]_kCH(OH)[CH_2]_jOR^2$ can be different for the case where $x \geqq 2$. $R^1$ and $R^2$ are preferably linear or branched, saturated or unsaturated, aliphatic or aromatic hydrocarbon groups containing 6 to 22 carbon atoms, groups containing 8 to 18 carbon atoms being particularly preferred. H, —$CH_3$ or —$CH_2CH_3$ are particularly preferred for the group $R^3$. Particularly preferred values for x are in the range from 1 to 20 and more particularly in the range from 6 to 15.

As described above, each $R^3$ in the above formula can be different for the case where $x \geqq 2$. By this means, the alkylene oxide unit in the straight brackets can be varied. If, for example, x has a value of 3, the substituent $R^3$ may be selected to form ethylene oxide ($R^3$=H) or propylene oxide ($R^3$=$CH_3$) units which may be joined together in any order, for example, (EO)(PO)(EO), (EO)(EO)(PO), (EO)(EO)(EO), (PO)(EO)(PO), (PO)(PO)(EO) and (PO)(PO)(PO). The value 3 for x was selected by way of example and may easily be larger, the range of variation increasing with increasing x-values and including, for example, a large number of (EO) groups combined with a small number of (PO) groups or vice versa.

Particularly preferred end-capped poly(oxyalkylated) alcohols corresponding to the above formula have values for both k and j of 1, so that the above formula can be simplified to $$R^1O[CH_2CH(R^3)O]_xCH_2CH(OH)CH_2OR^2$$

In this last formula, $R^1$, $R^2$ and $R^3$ are as defined above and x stands for a number from 1 to 30, preferably 1 to 20 and quite particularly preferably 6 to 18. Surfactants in which the substituents $R^1$ and $R^2$ have 9 to 14 carbon atoms, $R^3$ stands for H and x takes a value of 6 to 15 are particularly preferred.

In summary, end-capped poly(oxyalkylated) nonionic surfactants corresponding to the formula $$R^1O[CH_2CH(R^3)O]_x[CH_2]_kCH(OH)[CH_2]_jOR^2,$$

in which $R^1$ and $R^2$ stand for linear or branched, saturated or unsaturated, aliphatic or aromatic hydrocarbon groups with 1 to 30 carbon atoms, $R^3$ stands for H or for a methyl, ethyl, n-propyl, isopropyl, n-butyl, 2-butyl or 2-methyl-2-butyl group, x stands for values between 1 and 30, k and j for values between 1 and 12, preferably between 1 and 5, are preferred, wherein surfactants of the type $$R^1O[CH_2CH(R^3)O]_xCH_2CH(OH)CH_2OR^2,$$

in which x stands for numbers from 1 to 30, preferably 1 to 20 and especially 6 to 18, are particularly preferred.

Particularly preferred nonionic surfactants in the context of the present invention have proved to be weakly foaming nonionic surfactants, which have alternating ethylene oxide and alkylene oxide units. Among these, the surfactants with EO-AO-EO-AO blocks are again preferred, wherein one to ten EO or AO groups, respectively, are linked together, before a block of the other groups follows. Here, nonionic surfactants of the general formula $$R^1-O-(CH_2-CH_2-O)_w-(CH_2-\underset{\underset{R^2}{|}}{CH}-O)_x-(CH_2-CH_2-O)_y-(CH_2-\underset{\underset{R^3}{|}}{CH}-O)_z-H$$

are preferred, in which $R^1$ stands for a linear or branched, saturated or mono- or polyunsaturated $C_{6-24}$-alkyl or alkenyl group, each group $R^2$ or $R^3$ independently of one another is selected from $—CH_3$, $—CH_2CH_3$, $—CH_2CH_2—CH_3$, $CH(CH_3)_2$, and the indices w, x, y, z independently of one another stand for whole numbers from 1 to 6.

The preferred nonionic surfactants of the previous formula can be manufactured by known methods from the corresponding alcohols $R^1$—OH and ethylene- or alkylene oxide. The group $R^1$ in the previous formula can vary depending on the origin of the alcohol. When natural sources are used, the group $R^1$ has an even number of carbon atoms and generally is not branched, the linear alcohols of natural origin with 12 to 18 carbon atoms, for example, coconut, palm, tallow or oleyl alcohol being preferred. The alcohols available from synthetic sources are, for example, Guerbet alcohols or mixtures of methyl branched in the 2-position or linear and methyl branched groups, as are typically present in oxo alcohols. Independently of the type of alcohol used for the manufacture of the nonionic surfactants comprised in the agents, nonionic surfactants are preferred, wherein $R^1$ in the previous formula stands for an alkyl group with 6 to 24, preferably 8 to 20, particularly preferably 9 to 15 and particularly 9 to 11 carbon atoms.

In addition to propylene oxide, especially butylene oxide can be the alkylene oxide unit that alternates with the ethylene oxide unit in the preferred nonionic surfactants. However, other alkylene oxides are also suitable in which $R^2$ or $R^3$ independently of one another are selected from $—CH_2CH_2—CH_3$ or $CH(CH_3)_2$. Preferably, nonionic surfactants of the previous formula are used, in which $R^2$ or $R^3$ stand for a group $—CH_3$, w and x independently of one another stand for values of 3 or 4 and y and z independently of one another stand for values of 1 or 2.

In summary, especially nonionic surfactants are preferred that have a $C_{9-15}$-alkyl group with 1 to 4 ethylene oxide units, followed by 1 to 4 propylene oxide units, followed by 1 to 4 ethylene oxide units, followed by 1 to 4 propylene oxide units. These surfactants exhibit the required low viscosity in aqueous solution and according to the invention are used with particular preference.

Other preferred nonionic surfactants are the end-capped poly(oxyalkylated) nonionic surfactants corresponding to the following formula $$R^1O[CH_2CH(R^3)O]_xR^2,$$

in which $R^1$ stands for linear or branched, saturated or unsaturated, aliphatic or aromatic hydrocarbon groups with 1 to 30 carbon atoms, $R^2$ for linear or branched, saturated or unsaturated, aliphatic or aromatic hydrocarbon groups with 1 to 30 carbon atoms, which preferably contains 1 to 5 hydroxyl groups and preferably is also functionalized with an ether group, $R^3$ stands for H or for a methyl, ethyl, n-propyl, isopropyl, n-butyl, 2-butyl or 2-methyl-2-butyl group, x has a value between 1 and 40.

In a particularly preferred embodiment of the present application, $R^3$ stands for H in the above-cited general formula. From the group of the resulting end capped polyoxyalkylated nonionic surfactants of formula $$R^1O[CH_2CH_2O]_xR^2$$

those nonionic surfactants are particularly preferred, in which $R^1$ stands for linear or branched, saturated or unsaturated, aliphatic or aromatic hydrocarbon radicals with 1 to 30 carbon atoms, preferably with 4 to 20 carbon atoms, $R^2$ for linear or branched, saturated or unsaturated, aliphatic or aromatic hydrocarbon radicals with 1 to 30 carbon atoms, which preferably contains 1 to 5 hydroxyl groups and x has a value of 1 to 40.

In particular, those end capped polyoxyalkylated nonionic surfactants are preferred that according to the formula $$R^1O[CH_2CH_2O]_xCH_2CH(OH)R^2$$

in addition to a group $R^1$ that stands for linear or branched, saturated or unsaturated, aliphatic or aromatic hydrocarbon groups with 1 to 30 carbon atoms, preferably 4 to 20 carbon atoms, further comprise a linear or branched, saturated or unsaturated, aliphatic or aromatic hydrocarbon group $R^2$ with 1 to 30 carbon atoms that is neighboring an intermediate group $—CH_2CH(OH)—$. In this formula, x stands for a number between 1 and 90.

Nonionic surfactants of the general formula $$R^1O[CH_2CH_2O]_xCH_2CH(OH)R^2,$$

are particularly preferred, which in addition to a group $R^1$ that stands for linear or branched, saturated or unsaturated, aliphatic or aromatic hydrocarbon groups with 1 to 30 carbon atoms, preferably 4 to 20 carbon atoms, further comprises a linear or branched, saturated or unsaturated, aliphatic or aromatic hydrocarbon group $R^2$ with 1 to 30 carbon atoms, preferably 22 to 22 carbon atoms that is neighboring a monohydroxylated intermediate group $—CH_2CH(OH)—$ and in which x stands for values between 40 and 80, preferably between 40 and 60.

The suitable end capped polyoxyalkylated nonionic surfactants of the previous formula can be obtained, for example, by treating a terminal epoxide of the formula $R^2CH(O)CH_2$ with an ethoxylated alcohol of the formula $R^1O[CH_2CH_2O]_{x-1}CH_2CH_2OH$.

Further particularly preferred end capped polyoxyalkylated nonionic surfactants are those of the formula $$R^1O[CH_2CH_2O]_x[CH_2CH(CH_3)]O_yCH_2CH(OH)R^2,$$

in which $R^1$ and $R^2$ independently of one another stand for linear or branched, saturated or mono- or polyunsaturated hydrocarbon groups with 2 to 26 carbon atoms, $R^3$ independently of each other is selected from $—CH_3$, $—CH_2CH_3$, —$CH_2CH_2$—$CH_3$, $CH(CH_3)_2$, preferably —$CH_3$, however, and x and y independently of one another stand for values between 1 and 32, wherein nonionic surfactants with values for x from 15 to 32 and y from 0.5 and 1.5 are quite particularly preferred.

Surfactants of the general formula

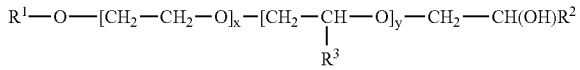

in which $R^1$ and $R^2$ independently of one another stand for linear or branched, saturated or mono- or polyunsaturated hydrocarbon groups with 2 to 26 carbon atoms, $R^3$ independently of each other is selected from —$CH_3$, —$CH_2CH_3$, —$CH_2CH_2$—$CH_3$, $CH(CH_3)_2$, preferably —$CH_3$, however, and x and y independently of one another stand for values between 1 and 32, are inventively preferred, wherein nonionic surfactants with values for x from 15 to 32 and y from 0.5 and 1.5 are quite particularly preferred.

The cited carbon chain lengths and degrees of ethoxylation or alkoxylation of the above-mentioned nonionic surfactants constitute statistically average values that can be a whole or a fractional number for a specific product. Due to the manufacturing process, commercial products of the cited formulas do not consist in the main of one sole representative, but rather are a mixture, wherein not only the carbon chain lengths but also the degrees of ethoxylation or alkoxylation can be average values and thus be fractional numbers.

Of course, the above-mentioned nonionic surfactants are not only employed as single substances, but also as surfactant mixtures of two, three, four or more surfactants. Accordingly, surfactant mixtures do not refer to mixtures of nonionic surfactants that as a whole fall under one of the above cited general formulas, but rather refer to such mixtures that comprise two, three, four or more nonionic surfactants that can be described by the different above-mentioned general formulas.

Exemplary suitable anionic surfactants are those of the sulfonate and sulfate type. Suitable surfactants of the sulfonate type are, advantageously $C_{9-13}$-alkylbenzene sulfonates, olefin sulfonates, i.e. mixtures of alkene- and hydroxyalkane sulfonates, and disulfonates, as are obtained, for example, from $C_{12-18}$-monoolefins having a terminal or internal double bond, by sulfonation with gaseous sulfur trioxide and subsequent alkaline or acidic hydrolysis of the sulfonation products. Those alkane sulfonates, obtained from $C_{12-18}$ alkanes by sulfochlorination or sulfoxidation, for example, with subsequent hydrolysis or neutralization, are also suitable. The esters of α-sulfofatty acids (ester sulfonates), e.g. the α-sulfonated methyl esters of hydrogenated coco-, palm nut- or tallow acids are likewise suitable.

Further suitable anionic surfactants are sulfated fatty acid esters of glycerine. They include the mono-, di- and triesters and also mixtures of them, such as those obtained by the esterification of a monoglycerine with 1 to 3 moles fatty acid or the transesterification of triglycerides with 0.3 to 2 moles glycerine. Preferred sulfated fatty acid esters of glycerol in this case are the sulfated products of saturated fatty acids with 6 to 22 carbon atoms, for example, caproic acid, caprylic acid, capric acid, myristic acid, lauric acid, palmitic acid, stearic acid or behenic acid.

Preferred alk(en)yl sulfates are the alkali and especially sodium salts of the sulfuric acid half-esters derived from the $C_{12}$-$C_{18}$ fatty alcohols, for example, from coconut butter alcohol, tallow alcohol, lauryl, myristyl, cetyl or stearyl alcohol or from $C_{10}$-$C_{20}$ oxo alcohols and those half-esters of secondary alcohols of these chain lengths. Additionally preferred are alk(en)yl sulfates of the said chain lengths, which contain a synthetic, straight-chained alkyl group produced on a petrochemical basis and which show similar degradation behavior to the suitable compounds based on fat chemical raw materials. The $C_{12}$-$C_{16}$ alkyl sulfates and $C_{12}$-$C_{15}$ alkyl sulfates and $C_{14}$-$C_{15}$ alkyl sulfates are preferred on the grounds of laundry performance. 2,3 alkyl sulfates, which can be obtained from Shell Oil Company under the trade name DAN®, are also suitable anionic surfactants.

Sulfuric acid mono-esters derived from straight-chained or branched $C_{7-21}$ alcohols ethoxylated with 1 to 6 moles ethylene oxide are also suitable, for example, 2-methyl-branched $C_{9-11}$ alcohols with an average of 3.5 mole ethylene oxide (EO) or $C_{12-18}$ fatty alcohols with 1 to 4 EO. Due to their high foaming performance, they are only used in fairly small quantities in cleaning agents, for example, in amounts of 1 to 5% by weight.

Other suitable anionic surfactants are the salts of alkylsulfosuccinic acid, which are also referred to as sulfosuccinates or esters of sulfosuccinic acid and the monoesters and/or di-esters of sulfosuccinic acid with alcohols, preferably fatty alcohols and especially ethoxylated fatty alcohols. Preferred sulfosuccinates contain $C_{8-18}$ fatty alcohol groups or mixtures of them. Especially preferred sulfosuccinates contain a fatty alcohol group derived from the ethoxylated fatty alcohols that are under consideration as nonionic surfactants. Once again the especially preferred sulfosuccinates are those whose fatty alcohol groups are derived from ethoxylated fatty alcohols with narrow range distribution. It is also possible to use alk(en)ylsuccinic acid with preferably 8 to 18 carbon atoms in the alk(en)yl chain, or salts thereof.

Soaps, in particular, can be considered as further anionic surfactants. Saturated fatty acid soaps are suitable, such as the salts of lauric acid, myristic acid, palmitic acid, stearic acid, hydrogenated erucic acid and behenic acid, and especially soap mixtures derived from natural fatty acids such as coconut oil fatty acid, palm kernel oil fatty acid or tallow fatty acid.

Anionic surfactants, including soaps, may be in the form of their sodium, potassium or ammonium salts or as soluble salts of organic bases, such as mono-, di- or triethanolamine. Preferably, the anionic surfactants are in the form of their sodium or potassium salts, especially in the form of sodium salts.

When the anionic surfactants are components of dishwasher detergents, their content, based on the total weight of the agent, is advantageously less than 4% by weight, preferably less than 2% by weight and quite particularly preferably less than 1% by weight.

Dishwasher detergents which comprise no anionic surfactants are particularly preferred.

Cationic and/or amphoteric surfactants can be added instead of, or in combination with the cited surfactants.

As the cationic active substances, cationic compounds of the following formulas can be incorporated, for example:

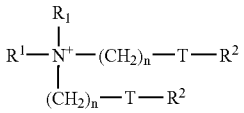

-continued

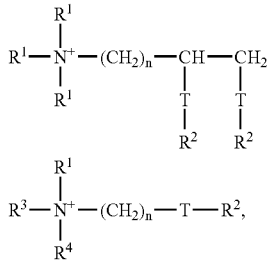

in which each group $R^1$, independently of one another, is chosen from $C_{1-6}$alkyl, -alkenyl or -hydroxyalkyl groups; each group $R^2$, independently of one another, is chosen from $C_{8-28}$-alkyl or -alkenyl groups; $R^3$=$R^1$ or $(CH_2)_n$-T-$R^2$; $R^4$=R1 or $R^2$ or $(CH_2)_n$-T-$R^2$; T=—$CH_2$—, —O—CO— or —CO—O— and n is an integer from 0 to 5.

In dishwasher detergents, the content of cationic and/or amphoteric surfactants is advantageously less than 6% by weight, preferably less than 4% by weight, particularly preferably less than 2% by weight and, quite particularly preferably, less than 1% by weight. Dishwasher detergents, which comprise no cationic or amphoteric surfactants, are particularly preferred.

Polymers.

The group of polymers includes, in particular, the active detergent polymers or active cleansing polymers, for example, the rinsing polymers and/or polymers active for water softening. Generally, in addition to nonionic polymers, also cationic, anionic or amphoteric polymers are suitable for incorporation in detergents or cleaning agents.

In the context of the present invention, "cationic polymers" are polymers that carry a positive charge in the polymer molecule. These can be realized, for example, by (alkyl-) ammonium groups present in the polymer chain or other positively charged groups. Particularly preferred cationic polymers come from the groups of the quaternized cellulose derivatives, the polysiloxanes having quaternized groups, the cationic guar derivatives, the polymeric dimethyl diallyl ammonium salts and their copolymers with esters and amides of acrylic acid and methacrylic acid, the copolymers of vinyl pyrrolidone with quaternized derivatives of dialkylamino acrylate and -methacrylate, the vinyl pyrrolidone/methoimidazolinium chloride copolymers, the quaternized polyvinyl alcohols or the polymers listed under the INCI descriptions Polyquaternium 2, Polyquaternium 17, Polyquaternium 18 and Polyquaternium 27.

In the context of the present invention, "amphoteric polymers" are polymers that also possess, in addition to a positively charged group in the polymer chain, further negatively charged groups or monomer units. These groups can concern, for example, carboxylic acids, sulfonic acids or phosphonic acids.

Preferred detergents or cleaning agents, in particular, preferred dishwasher detergents, are those that comprise a polymer a) that possesses monomer units of the formula $R^1R^2C{=}CR^3R^4$, in which each group $R^1$, $R^2$, $R^3$, $R^4$ independently of each other is selected from hydrogen, derivatized hydroxyl groups, $C_1$ to $C_{30}$ linear or branched alkyl groups, aryl, aryl substituted $C_{1-30}$ linear or branched alkyl groups, polyalkoxylated alkyl groups, heteroatomic organic groups having at least one positive charge without charged nitrogen, at least one quaternized nitrogen atom or at least one amino group with a positive charge in the pH range 2 to 11, or salts hereof, with the proviso that at least one group $R^1$, $R^2$, $R^3$, $R^4$ is a heteroatomic organic group with at least one positive charge without charged nitrogen, at least one quaternized nitrogen atom or at least one amino group with a positive charge, and are particularly preferred in the context of the present application.

In the scope of the present application, particularly preferred cationic or amphoteric polymers comprise as the monomer unit a compound of the general formula

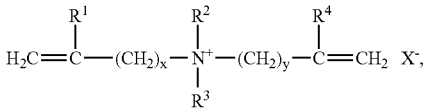

in which $R^1$ and $R^4$ independently of one another stands for a linear or branched hydrocarbon group with 1 to 6 carbon atoms; $R^2$ and $R^3$ independently of one another stand for an alkyl, hydroxyalkyl or aminoalkyl group, in which the alkyl group is linear or branched and has 1 to 6 carbon atoms, wherein it is preferably a methyl group; x and y independently of one another stand for whole numbers between 1 and 3. $X^-$ represents a counter ion, preferably a counter ion from the group chloride, bromide, iodide, sulfate, hydrogen sulfate, methosulfate, lauryl sulfate, dodecylbenzene sulfonate, p-toluene sulfonate (tosylate), cumene sulfonate, xylene sulfonate, phosphate, citrate, formate, acetate or mixtures thereof.

Preferred groups $R^1$ and $R^4$ in the above formula are selected from —$CH_3$, —$CH_2$—$CH_3$, —$CH_2$—$CH_2$—$CH_3$, —$CH(CH_3)$—$CH_3$, —$CH_2$—OH, —$CH_2$—$CH_2$—OH, —CH(OH)—$CH_3$, —$CH_2$—$CH_2$—$CH_2$—OH, —$CH_2$—CH(OH)—$CH_3$, —CH(OH)—$CH_2$—$CH_3$, and —$(CH_2CH_2$—$O)_n$H.

Quite particularly preferred polymers are those that possess a cationic monomer unit of the above general formula, in which $R^1$ and $R^4$ stand for H, $R^2$ and $R^3$ stand for methyl, and x and y are each 1. The monomer units corresponding to the formula

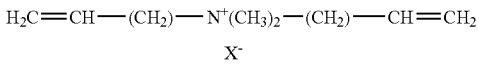

are also designated as DADMAC (diallyl dimethyl ammonium chloride) for the case where $X^-$=chloride.

Further particularly preferred cationic or amphoteric polymers comprise a monomer unit of the general formula

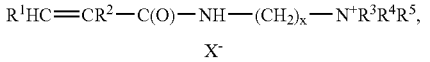

in which $R^1$, $R^2$, $R^3$, $R^4$ and $R^5$ independently of one another stand for linear or branched, saturated or unsaturated alkyl, or hydroxyalkyl group with 1 to 6 carbon atoms, preferably for a linear or branched alkyl group selected from —$CH_3$, —$CH_2$—$CH_3$, —$CH_2$—$CH_2$—$CH_3$, —$CH(CH_3)$—$CH_3$, —$CH_2$—OH, —$CH_2$—$CH_2$—OH, —CH(OH)—$CH_3$, —$CH_2$—$CH_2$—$CH_2$—OH, —$CH_2$—CH(OH)—$CH_3$, —CH(OH)—$CH_2$—$CH_3$, and —$(CH_2CH_2$—$O)_n$H, and x stands for a whole number between 1 and 6.

In the context of the present application, quite particularly preferred polymers possess a cationic monomer unit of the above general formula, in which $R^1$ stands for H, and $R^2$, $R^3$, $R^4$ and $R^5$ stand for methyl, and x stands for 3. The monomer units corresponding to the formula $$H_2C{=}C(CH_3){-}C(O){-}NH{-}(CH_2)_x{-}N^+(CH_3)_3\ X^-$$

are also designated as MAPTAC (methylacrylamidopropyltrimethyl ammonium chloride) for the case where $X^-$=chloride.

According to the invention, preferred polymers are used that comprise diallyl dimethyl ammonium salts and/or acrylamidopropyl trimethyl ammonium salts as monomer units.

The previously mentioned polymers possess not only cationic groups but also anionic groups or monomer units. These anionic monomer units come, for example, from the group of the linear or branched, saturated or unsaturated carboxylates, the linear or branched, saturated or unsaturated phosphonates, the linear or branched, saturated or unsaturated sulfates or the linear or branched, saturated or unsaturated sulfonates. Preferred monomer units are acrylic acid, the (meth)acrylic acids, the (dimethyl)acrylic acid, the (ethyl)acrylic acid, the cyanoacrylic acid, the vinylacetic acid, the allylacetic acid, the crotonic acid, the maleic acid, the fumaric acid, the cinnamic acid and its derivatives, the allylsulfonic acids, such as for example, allyloxybenzene sulfonic acid and methallyl sulfonic acid or the allylphosphonic acids.

Preferred usable amphoteric polymers come from the group of the alkylacrylamide/acrylic acid copolymers, the alkylacrylamide/methacrylic acid copolymers, the alkylacrylamide/methylmethacrylic acid copolymers, the alkylacrylamide/acrylic acid/alkyl-aminoalkyl(meth)acrylic acid copolymers, the alkylacrylamide/methacrylic acid/alkylaminoalkyl(meth)acrylic acid copolymers, the alkylacrylamide/methylmethacrylic acid/alkylaminoalkyl(meth)acrylic acid copolymers, the alkylacrylamide/alkyl methacrylate/alkylaminoethyl methacrylate/alkyl methacrylate copolymers as well as the copolymers of unsaturated carboxylic acids, cationic derivatized unsaturated carboxylic acids and optionally additional ionic or nonionic monomers.

Preferred usable zwitterionic polymers come from the group of the acrylamidoalkyl trialkyl ammonium chloride/acrylic acid copolymers as well as their alkali metal- and ammonium salts, the acrylamidoalkyl trialkyl ammonium chloride/methacrylic acid copolymers as well as their alkali metal- and ammonium salts and their methacroylethylbetaine/methacrylate copolymers.

In addition, preferred amphoteric polymers are those that include methacrylamidoalkyl-trialkyl ammonium chloride and dimethyl(diallyl)ammonium chloride as the cationic monomer in addition to one or more anionic monomers.

Particularly preferred amphoteric polymers come from the group of methacrylamidoalkyl-trialkyl ammonium chloride/dimethyl(diallyl)ammonium chloride/acrylic acid copolymers, the methacrylamidoalkyl trialkyl ammonium chloride/dimethyl(diallyl)ammonium chloride/methacrylic acid copolymers and the methacrylamidoalkyl trialkyl ammonium chloride/dimethyl(diallyl)ammonium chloride/alkyl(meth) acrylic acid copolymers as well as their alkali metal and ammonium salts.

In particular, preferred amphoteric polymers are from the group of the methacrylamidopropyl trimethyl ammonium chloride/dimethyl(diallyl)ammonium chloride/acrylic acid copolymers, the methacrylamidopropyl trimethyl ammonium chloride/dimethyl(diallyl)ammonium chloride/acrylic acid copolymers and the methacrylamidopropyl trimethyl ammonium chloride/dimethyl(diallyl)ammonium chloride/alkyl(meth)acrylic acid copolymers as well as their alkali metal and ammonium salts.

In a particularly preferred embodiment of the present invention, the polymers are in preconditioned form. Suitable preconditioning of the polymers include, inter alia

- Encapsulation of the polymers by water-soluble or water-dispersible coating agents, preferably by water-soluble or water-dispersible natural or synthetic polymers;
- Encapsulation of the polymers by water-insoluble, meltable coating agents, preferably by water-insoluble coating agents from the group of the waxes or paraffins having a melting point above 30° C.;
- Cogranulation of the polymers with inert carriers, preferably with carriers from the group of detergent active or cleansing active substances, particularly preferably from the group of builders or cobuilders.

Detergents or cleaning agents comprise the above-mentioned cationic and/or amphoteric polymers in amounts between 0.01 and 10 wt. %, each based on the total weight of the detergent or cleaning agent. However, in the context of the present application, those detergents or cleaning agents are preferred in which the weight content of the cationic and/or amphoteric polymers is between 0.01 and 8 wt. %, preferably between 0.01 and 6 wt. %, particularly preferably between 0.01 and 4 wt. %, quite particularly preferably between 0.01 and 2 wt. % and especially between 0.01 and 1 wt. %, each based on the total weight of the automatic dishwasher detergent.

Exemplary polymers active for water softening are polymers with sulfonic acid groups, which are especially preferably employed.

Particularly preferred suitable polymers comprising sulfonic acid groups are copolymers of unsaturated carboxylic acids, monomers comprising sulfonic acid groups and optional further ionic or non-ionogenic monomers.

In the context of the present invention, unsaturated carboxylic acids of the formula $$R^1(R^2)C{=}C(R^3)COOH$$

are preferred monomers, in which $R^1$ to $R^3$ independently of one another stand for —H, —$CH_3$, a linear or branched, saturated alkyl group containing 2 to 12 carbon atoms, a linear or branched, mono- or polyunsaturated alkenyl group containing 2 to 12 carbon atoms, with —$NH_2$, —OH or —COOH substituted alkyl or alkenyl groups as defined above or —COOH or —$COOR^4$, wherein $R^4$ is a saturated or unsaturated, linear or branched hydrocarbon group containing 1 to 12 carbon atoms.

Among the unsaturated carboxylic acids corresponding to the above formula, acrylic acid ($R^1{=}R^2{=}R^3{=}H$), methacrylic acid ($R^1{=}R^2{=}H$; $R^3{=}CH_3$) and/or maleic acid ($R^1{=}COOH$; $R^2{=}R^3{=}H$) are particularly preferred.

The preferred monomers containing sulfonic acid groups are those of the formula, $$R^5(R^6)C{=}C(R^7){-}X{-}SO_3H$$

in which $R^5$ to $R^7$ independently of one another stand for —H, —$CH_3$, a linear or branched, saturated alkyl group containing 2 to 12 carbon atoms, a linear or branched, mono- or polyunsaturated alkenyl group containing 2 to 12 carbon atoms, with —$NH_2$, —OH or —COOH substituted alkyl or alkenyl groups as defined above or —COOH or —$COOR^4$, wherein $R^4$ is a saturated or unsaturated, linear or branched hydrocarbon group containing 1 to 12 carbon atoms.

Preferred monomers are those of the formulas $$H_2C{=}CH{-}X{-}SO_3H$$

$$H_2C{=}C(CH_3){-}X{-}SO_3H$$

$$HO_3S{-}X{-}(R^6)C{=}C(R^7){-}X{-}SO_3H$$

in which $R^6$ and $R^7$ independently of one another are selected from —H, —$CH_3$, —$CH_2CH_3$, —$CH_2CH_2CH_3$, —$CH(CH_3)_2$ and X is an optionally present spacer group selected from —$(CH_2)_n$— with n=0 to 4, —COO—$(CH_2)_k$— with k=1 to 6, —C(O)—NH—$C(CH_3)_2$— and —C(O)—NH—$CH(CH_2CH_3)$—.

Accordingly, particularly preferred sulfonic acid-containing monomers are 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxy-propanesulfonic acid, allylsulfonic acid, methallylsulfonic acid, allyloxybenzenesulfonic acid, methallyloxybenzenesulfonic acid, 2-hydroxy-3-(2-propenyloxy) propanesulfonic acid, 2-methyl-2-propene-1-sulfonic acid, styrene sulfonic acid, vinylsulfonic acid, 3-sulfopropyl acrylate, 3-sulfopropyl methacrylate, sulfomethylacrylamide, sulfomethylmethacrylamide and water-soluble salts of the cited acids.

Additional ionic or non-ionogenic monomers particularly include ethylenically unsaturated compounds. Preferably, the content of these additional ionic or non-ionogenic monomers in the added polymers is less than 20 wt. %, based on the polymer. Particularly preferred polymers for use consist solely of monomers of the formula $R^1(R^2)C{=}C(R^3)COOH$ and monomers of formula $R^5(R^6)C{=}C(R^7){-}X{-}SO_3H$.

In summary, copolymers of i) unsaturated carboxylic acids of the formula $R^1(R^2)C{=}C(R^3)COOH$
   in which $R^1$ to $R^3$ independently of one another stand for —H, —$CH_3$, a linear or branched, saturated alkyl radical containing 2 to 12 carbon atoms, a linear or branched, mono- or polyunsaturated alkenyl group containing 2 to 12 carbon atoms, with —$NH_2$, —OH or —COOH substituted alkyl or alkenyl groups as defined above or —COOH or —$COOR^4$, wherein $R^4$ is a saturated or unsaturated, linear or branched hydrocarbon radical containing 1 to 12 carbon atoms.

ii) monomers containing sulfonic acid groups corresponding to the formula $R^5(R^6)C{=}C(R^7){-}X{-}SO_3H$
   in which $R^5$ to $R^7$ independently of one another stand for —H, —$CH_3$, a linear or branched, saturated alkyl radical containing 2 to 12 carbon atoms, a linear or branched, mono- or polyunsaturated alkenyl group containing 2 to 12 carbon atoms, with —$NH_2$, —OH or —COOH substituted alkyl or alkenyl groups as defined above or —COOH or —$COOR^4$, wherein $R^4$ is a saturated or unsaturated, linear or branched hydrocarbon radical containing 1 to 12 carbon atoms and X stands for an optionally present spacer group selected from —$(CH_2)_n$— with n=0 to 4, —COO—$(CH_2)_k$— with k=1 to 6, —C(O)—NH—$C(CH_3)_2$— and —C(O)—NH—$CH(CH_2CH_3)$—.

iii) optional additional ionic or nonionic monomers are particularly preferred.

Further particularly preferred copolymers consist of i) one or a plurality of unsaturated carboxylic acids from the group acrylic acid, methacrylic acid and/or maleic acid ii) one or a plurality of monomers containing sulfonic acid groups of the formulas:

$$H_2C{=}CH{-}X{-}SO_3H$$

$$H_2C{=}C(CH_3){-}X{-}SO_3H$$

$$HO_3S{-}X{-}(R^6)C{=}C(R^7){-}X{-}SO_3H$$

in which $R^8$ and $R^7$ independently of one another are selected from —H, —$CH_3$, —$CH_2CH_3$, —$CH_2CH_2CH_3$, —$CH(CH_3)_2$ and X is an optionally present spacer group selected from —$(CH_2)_n$— with n=0 to 4, —COO—$(CH_2)_k$— with k=1 to 6, —C(O)—NH—$C(CH_3)_2$— and —C(O)—NH—$CH(CH_2CH_3)$— iii) optional additional ionic or nonionic monomers.

The copolymers can contain monomers from groups (i) and (ii) and optionally (iii) in varying amounts, wherein all representatives of group (i) can be combined with all representatives of group (ii) and all representatives of group (iii). Particularly preferred polymers have defined structural units, which are described below.

For example, copolymers are preferred, which comprise structural units of the formula $$-[CH_2{-}CHCOOH]_m{-}[CH_2{-}CHC(O){-}Y{-}SO_3H]_p-$$

in which m and p each stand for a whole natural number between 1 and 2,000 and Y stands for a spacer group selected from substituted or unsubstituted aliphatic, aromatic or araliphatic hydrocarbon groups containing 1 to 24 carbon atoms, wherein spacer groups, in which Y represents —O—$(CH_2)_n$— with n=0 to 4, —O—$(C_6H_4)$—, —NH—$C(CH_3)_2$— or —NH—$CH(CH_2CH_3)$— are preferred.

These polymers are produced by copolymerization of acrylic acid with an acrylic acid derivative containing sulfonic acid groups. If the acrylic acid derivative containing sulfonic acid groups is copolymerized with methacrylic acid, then another polymer results whose incorporation is likewise preferred. The appropriate copolymers comprise structural units of the formula $$-[CH_2{-}C(CH_3)COOH]_m{-}[CH_2{-}CHC(O){-}Y{-}SO_3H]_p-$$

in which m and p each stand for a whole natural number between 1 and 2,000 and Y stands for a spacer group selected from substituted or unsubstituted aliphatic, aromatic or araliphatic hydrocarbon groups containing 1 to 24 carbon atoms, wherein spacer groups, in which Y represents —O—$(CH_2)_n$— with n=0 to 4, —O—$(C_6H_4)$—, —NH—$C(CH_3)_2$— or —NH—$CH(CH_2CH_3)$— are preferred.

Entirely analogously, acrylic acid and/or methacrylic acid may also be copolymerized with methacrylic acid derivatives containing sulfonic acid groups, so that the structural units in the molecule are changed. Consequently, copolymers that comprise structural units of the formula $$-[CH_2{-}CHCOOH]_m{-}[CH_2{-}C(CH_3)C(O){-}Y{-}SO_3H]_p-$$

in which m and p each stand for a whole natural number between 1 and 2,000 and Y stands for a spacer group selected from substituted or unsubstituted aliphatic, aromatic or araliphatic hydrocarbon groups containing 1 to 24 carbon atoms, wherein spacer groups, in which Y represents —O—$(CH_2)_n$— with n=0 to 4, —O—$(C_6H_4)$—, —NH—$C(CH_3)_2$— or —NH—$CH(CH_2CH_3)$— are preferred.

$$-[CH_2{-}C(CH_3)COOH]_m{-}[CH_2{-}C(CH_3)C(O){-}Y{-}SO_3H]_p-$$

in which m and p each stand for a whole natural number between 1 and 2,000 and Y stands for a spacer group selected from substituted or unsubstituted aliphatic, aromatic or araliphatic hydrocarbon groups containing 1 to 24 carbon atoms, wherein spacer groups, in which Y represents —O—$(CH_2)_n$— with n=0 to 4, —O—$(C_6H_4)$—, —NH—$C(CH_3)_2$— or —NH—$CH(CH_2CH_3)$— are preferred.

Instead of acrylic acid and/or methacrylic acid, or in addition to them, maleic acid can also be incorporated as the particularly preferred monomer from group i). In this way, one arrives at inventively preferred copolymers that comprise structural units of the formula $$—[HOOCC\ H—CHCOOH]_m—[CH_2—CHC(O)—Y—SO_3H]_p—$$

in which m and p each stand for a whole natural number between 1 and 2,000 and Y stands for a spacer group selected from substituted or unsubstituted aliphatic, aromatic or araliphatic hydrocarbon groups containing 1 to 24 carbon atoms, wherein spacer groups, in which Y represents —O—$(CH_2)_n$— with n=0 to 4, —O—$(C_6H_4$, —NH—$C(CH_3)_2$— or —NH—$CH(CH_2CH_3)$— are preferred. In addition, copolymers are inventively preferred that comprise the structural units of formula $$—[HOOCCH—CHCOOH]_m—[CH_2—C(CH_3)C(O)O—Y—SO_3H]_p—$$

in which m and p each stand for a whole natural number between 1 and 2,000 and Y stands for a spacer group selected from substituted or unsubstituted aliphatic, aromatic or araliphatic hydrocarbon groups containing 1 to 24 carbon atoms, wherein spacer groups, in which Y represents —O—$(CH_2)_n$— with n=0 to 4, —O—$(C_6H_4)$—, —NH—$C(CH_3)_2$— or —NH—$CH(CH_2CH_3)$—.

In summary, copolymers are inventively preferred, which comprise structural units of the formulas $$—[CH_2—CHCOOH]_m—[CH_2—CHC(O)—Y—SO_3H]_p—$$

$$—[CH_2—C(CH_3)COOH]_m—[CH_2—CHC(O)—Y—SO_3H]_p—$$

$$—[CH_2—CHCOOH]_m—[CH_2—C(CH_3)C(O)—Y—SO_3H]_p—$$

$$—[CH_2—C(CH_3)COOH]_m—[CH_2—C(CH_3)C(O)—Y—SO_3H]_p—$$

$$—[HOOCCH—CHCOOH]_m—[CH_2—CHC(O)—Y—SO_3H]_p—$$

$$—[HOOCCH—CHCOOH]_m—[CH_2—C(CH_3)C(O)O—Y—SO_3H]_p—$$

in which m and p each stand for a whole natural number between 1 and 2,000 and Y stands for a spacer group selected from substituted or unsubstituted aliphatic, aromatic or araliphatic hydrocarbon groups containing 1 to 24 carbon atoms, wherein spacer groups, in which Y represents —O—$(CH_2)_n$ with n=0 to 4, —O—$(C_6H_4)$—, —NH—$C(CH_3)_2$— or —NH—$CH(CH_2CH_3)$—are preferred.

The sulfonic acid groups may be present in the polymers completely or partly in neutralized form, i.e. the acidic hydrogen atom of the sulfonic acid groups can be replaced by metal ions, preferably alkali metal ions and more particularly sodium ions, in some or all of the sulfonic acid groups. The addition of copolymers containing partly or fully neutralized sulfonic acid groups is preferred according to the invention.

The monomer distribution of the inventively preferred copolymers used ranges for copolymers that comprise only monomers defined in groups (i) and (ii) from preferably 5 to 95 wt. % (i) and (ii) respectively, particularly preferably 50 to 90 wt. % monomer from group (i) and 10 to 50 wt. % monomer from group (ii) respectively, based on the polymer.

Particularly preferred terpolymers are those that comprise 20 to 85 wt. % monomer from group (i), 10 to 60 wt. % monomer from group (ii) and 5 to 30 wt. % monomer from group (iii).

The molecular weight of the inventively preferred sulfocopolymers used can be varied to adapt the properties of the polymer to the desired application requirement. Preferred detergents or cleaning agents are those wherein the molecular weights of the copolymers are 2,000 to 200,000 $gmol^{-1}$, preferably 4,000 to 25,000 $gmol^{-1}$ and especially 5,000 to 15,000 $gmol^{-1}$.

Bleaching Agents.

The bleaching agents particularly preferred incorporate an active detergent or cleansing substance. Among the compounds which serve as bleaches and liberate $H_2O_2$ in water, sodium percarbonate, sodium perborate tetrahydrate and sodium perborate monohydrate are of particular importance. Examples of further bleaching agents that may be used are peroxypyrophosphates, citrate perhydrates and $H_2O_2$-liberating peracidic salts or peracids, such as perbenzoates, peroxyphthalates, diperoxyazelaic acids, phthaloimino peracids or diperoxydodecanedioic acids.

Moreover, bleaching agents from the group of the organic bleaching agents can also be used. Typical organic bleaching agents are the diacyl peroxides, such as, for example, dibenzoyl peroxide. Further typical organic bleaching agents are the peroxy acids, wherein the alkylperoxy acids and the arylperoxy acids may be named as examples. Preferred representatives that can be added are (a) peroxybenzoic acid and ring-substituted derivatives thereof, such as alkyl peroxybenzoic acids, but also peroxy-α-naphthoic acid and magnesium monoperphthalate, (b) aliphatic or substituted aliphatic peroxy acids, such as peroxylauric acid, peroxystearic acid, ε-phthalimidoperoxycaproic acid [phthaloiminoperoxyhexanoic acid (PAP)], o-carboxybenzamido peroxycaproic acid, N-nonenylamido peradipic acid and N-nonenylamido persuccinates and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyidiperoxybutane-1,4-dioic acid, N,N-terephthaloyl-di(6-aminopercaproic acid).

Chlorine- or bromine-releasing substances can also be incorporated as bleaching agents. Suitable chlorine- or bromine-releasing materials include, for example, heterocyclic N-bromamides and N-chloramides, for example, trichloroisocyanuric acid, tribromoisocyanuric acid, dibromoisocyanuric acid and/or dichloroisocyanuric acid (DICA) and/or salts thereof with cations such as potassium and sodium. Hydantoin compounds, such as 1,3-dichloro-5,5-dimethyl hydantoin, are also suitable.

According to the invention, detergents or cleaning agents, particularly dishwasher detergents, are preferred that comprise 1 to 35 wt. %, preferably 2.5 to 30 wt. %, particularly preferably 3.5 to 20 wt. % and quite particularly preferably 5 to 15 wt. % bleaching agent, preferably sodium percarbonate.

The active oxygen content of the detergents or cleaning agents, particularly dishwasher detergents, based on the total weight of the agent, preferably ranges between 0.4 and 10 wt. %, particularly preferably between 0.5 and 8 wt. % and quite particularly preferably between 0.6 and 5 wt. %. Preferred agents possess an active oxygen content above 0.3 wt. %, particularly preferred, above 0.7 wt. %, quite particularly preferred, above 0.8 wt. % and especially, above 1.0 wt. %.

Bleach Activators.

The detergents or cleansing agents can comprise bleach activators in order to achieve an improved bleaching action on washing or cleaning at temperatures of 60° C. and below. Bleach activators which can be used are compounds which, under perhydrolysis conditions, yield aliphatic peroxycarboxylic acids having preferably 1 to 10 carbon atoms, in particular, 2 to 4 carbon atoms, and/or optionally substituted perbenzoic acid. Substances, which carry O-acyl and/or N-acyl groups of said number of carbon atoms and/or optionally substituted benzoyl groups, are suitable. Preference is given to polyacylated alkylenediamines, in particular, tetraacetyl ethylenediamine (TAED), acylated triazine derivatives, in particular, 5-diacetyl-2,4-dioxohexahydro-1,3,5-triazine (DADHT), acylated glycolurils, in particular, tetraacetyl glycoluril (TAGU), N-acylimides, in particular, N-nonanoyl succinimide (NOSI), acylated phenol sulfonates, in particular, n-nonanoyl- or isononanoyloxybenzene sulfonate (n- or iso-NOBS), carboxylic acid anhydrides, in particular, phthalic anhydride, acylated polyhydric alcohols, in particular, triacetin, ethylene glycol diacetate and 2,5-diacetoxy-2,5-dihydrofuran.

In the context of the present application, further preferred added bleach activators are compounds from the group of cationic nitriles, particularly cationic nitriles of the formula

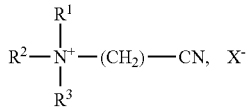

in which $R^1$ stands for —H, —$CH_3$, a $C_{2-24}$ alkyl or alkenyl group, a substituted $C_{2-24}$ alkyl or alkenyl group having at least one substituent from the group of —Cl, —Br, —OH, —$NH_2$, —CN, an alkyl or alkenylaryl radical having a $C_{1-24}$ alkyl group or for a substituted alkyl or alkenylaryl group having a $C_{1-24}$ alkyl group and at least a further substituent on the aromatic ring, $R^2$ and $R^3$, independently of one another are selected from —$CH_2$—CN, —$CH_3$, —$CH_2$—$CH_3$, —$CH_2$—$CH_2$—$CH_3$, —CH($CH_3$)—$CH_3$, —$CH_2$—OH, —$CH_2$—$CH_2$—OH, —CH(OH)—$CH_3$, —$CH_2$—$CH_2$—$CH_2$—OH, —$CH_2$—CH(OH)—$CH_3$, —CH(OH)—$CH_2$—$CH_3$, —($CH_2CH_2$—O)$_n$H with n =1, 2, 3, 4, 5 or 6 and X is an anion.

A cationic nitrile of the formula

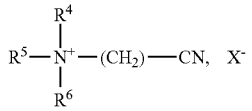

is particularly preferred, in which $R^4$, $R^5$ and $R^6$ independently of one another are selected from —$CH_3$, —$CH_2$—$CH_3$, —$CH_2$—$CH_2$—$CH_3$, —CH($CH_3$)—$CH_3$, wherein $R^4$ can also be —H and X is an anion, wherein preferably $R^5$=$R^6$=—$CH_3$ and in particular, $R^4$=$R^5$=$R^6$=—$CH_3$ and compounds of the formulas $(CH_3)_3N^{(+)}CH_2$—CNX$^-$, $(CH_3CH_2)_3N^{(+)}CH_2$—CN X$^-$, $(CH_3CH_2CH_2)_3N^{(+)}CH_2$—CNX$^-$, $(CH_3CH(CH_3))_3N^{(+)}CH_2$—CNX$^-$, or (HO—$CH_2$—$CH_2)_3N^{(+)}CH_2$—CNX$^-$ are particularly preferred, wherein once again the cationic nitrile of the formula $(CH_3)_3N^{(+)}CH_2$—CNX$^-$, in which X$^-$ stands for an anion selected from the group chloride, bromide, iodide, hydrogen sulfate, methosulfate, p-toluene sulfonate (tosylate) or xylene sulfonate.

Bleach activators which can be used are compounds which, under perhydrolysis conditions, yield aliphatic peroxycarboxylic acids having preferably 1 to 10 carbon atoms, in particular, 2 to 4 carbon atoms, and/or optionally substituted perbenzoic acid. Substances which carry O-acyl and/or N-acyl groups of said number of carbon atoms and/or optionally substituted benzoyl groups are suitable. Preference is given to polyacylated alkylenediamines, in particular, tetraacetyl ethylenediamine (TAED), acylated triazine derivatives, in particular, 1,5-diacetyl-2,4-dioxohexahydro-1,3,5-triazine (DADHT), acylated glycolurils, in particular, tetraacetyl glycoluril (TAGU), N-acylimides, in particular, N-nonanoyl succinimide (NOSI), acylated phenol sulfonates, in particular, n-nonanoyl- or isononanoyloxybenzene sulfonate (n- or iso-NOBS), carboxylic acid anhydrides, in particular, phthalic anhydride, acylated polyhydric alcohols, in particular, triacetin, ethylene glycol diacetate and 2,5-diacetoxy-2,5-dihydrofuran, n-methyl-morpholinium-acetonitrile-ethyl sulfate (MMA) as well as acetylated sorbitol and mannitol or their mixtures (SORMAN), acylated sugar derivatives, in particular, pentaacetyl glucose (PAG), pentaacetyl fructose, tetraacetyl xylose and octaacetyl lactose as well as acetylated, optionally N-alkylated glucamine and gluconolactone, and/or N-acylated lactams, for example, N-benzoyl caprolactam. Hydrophillically substituted acyl acetals and acyl lactams are also preferably used. Combinations of conventional bleach activators may also be used.

When additional bleach activators are intended to be used in addition to the nitrilequats, preferred bleach activators are added from the group of polyacylated alkylenediamines, more particularly tetraacetyl ethylenediamine (TAED), N-acyl imides, more particularly N-nonanoyl succinimide (NOSI), acylated phenol sulfonates, more particularly n-nonanoyl- or isononanoyl-oxybenzenesulfonate (n- or iso-NOBS), n-methyl morpholinium acetonitrile methyl sulfate (MMA), preferably in quantities of up to 10% by weight, more preferably in quantities of 0.1% by weight to 8% by weight, quite particularly preferably 2 to 8% by weight and especially preferably 2 to 6% by weight, based on the total weight of the bleach activator-containing agent.

In addition to, or instead of the conventional bleach activators mentioned above, so-called bleach catalysts may also be incorporated. These substances are bleach-boosting transition metal salts or transition metal complexes such as, for example, manganese-, iron-, cobalt-, ruthenium- or molybdenum-salen complexes or -carbonyl complexes. Manganese, iron, cobalt, ruthenium, molybdenum, titanium, vanadium and copper complexes with nitrogen-containing tripod ligands, as well as cobalt-, iron-, copper- and ruthenium-ammine complexes may also be employed as the bleach catalysts.

Bleach-boosting transition metal complexes, more particularly containing the central atoms Mn, Fe, Co, Cu, Mo, V, Ti and/or Ru, preferably selected from the group of manganese and/or cobalt salts and/or complexes, particularly preferably the cobalt(ammine) complexes, cobalt (acetate) complexes, cobalt (carbonyl) complexes, chlorides of cobalt or manganese and manganese sulfate, are also used in typical quantities, preferably in a quantity of up to 5% by weight, particularly preferably in a quantity of 0.0025% by weight to 1% by weight and quite particularly preferably in a quantity of 0.01% by weight to 0.25% by weight, based on the total weight of the bleach activator-containing agent. In special cases, however, even more bleach activator may be used.

Enzymes.

Enzymes can be incorporated to increase the washing or cleansing performance of detergents or cleansing agents. These particularly include proteases, amylases, lipases, hemicellulases, cellulases or oxidoreductases as well as preferably their mixtures. In principle, these enzymes are of natural origin; improved variants based on the natural molecules are available for use in detergents and accordingly they are preferred. The detergents or cleaning agents preferably comprise enzymes in total quantities of $1\times10^{-6}$ to 5 weight percent based on active protein. The protein concentration can be determined using known methods, for example, the BCA Process or the biuret process.

Preferred proteases are those of the subtilisin type. Examples of these are subtilisins BPN' and Carlsberg, the protease PB92, the subtilisins 147 and 309, the alkaline protease from *Bacillus lentus*, subtilisin DY and those enzymes of the subtilases no longer however classified in the stricter sense as subtilisines thermitase, proteinase K and the proteases TW3 and TW7. Subtilisin Carlsberg in further developed form is available under the trade name Alcalase® from Novozymes A/S, Bagsvaerd, Denmark. Subtilisins 147 and 309 are commercialized under the trade names Esperase® and Savinase® by the Novozymes company. The variants sold under the name BLAP® are derived from the protease from *Bacillus lentus* DSM 5483.

Further useable proteases are, for example, those enzymes available with the trade names Durazym®, Relase®, Everlase®, Nafizym, Natalase®, Kannase® and Ovozymes® from the Novozymes Company, those under the trade names Purafect®, Purafect® OxP and Properase® from Genencor, that under the trade name Protosol® from Advanced Biochemicals Ltd., Thane, India, that under the trade name Wuxi® from Wuxi Snyder Bioproducts Ltd., China, those under the trade names Proleather® and Protease P® from Amano Pharmaceuticals Ltd., Nagoya, Japan, and that under the designation Proteinase K-16 from Kao Corp., Tokyo, Japan.

Examples of further useable amylases according to the invention are the α-amylases from *Bacillus licheniformis*, from *B. amyloliquefaciens* and from *B. stearothermophilus*, as well as their improved further developments for use in detergents and cleaning agents. The enzyme from *B. licheniformis* is available from the Novozymes Company under the name Termamyl® and from the Genencor Company under the name Purastar®ST. Further development products of this α-amylase are available from the Novozymes Company under the trade names Duramyl® and Termamyl®ultra, from the Genencor Company under the name Purastar®OxAm and from Daiwa Seiko Inc., Tokyo, Japan as Keistase®. The α-amylase from *B. amyloliquefaciens* is commercialized by the Novozymes Company under the name BAN®, and derived variants from the α-amylase from *B. stearothermophilus* under the names BSG® and Novamyl® also from the Novozymes Company.

Moreover, for these purposes, attention should be drawn to the α(-amylase from *Bacillus* sp. A 7-7 (DSM 12368) and the cyclodextrin-glucanotransferase (CGTase) from *B. agaradherens* (DSM 9948).

Moreover, further developments of α-amylase from *Aspergillus niger* and *A. oryzae* available from the Company Novozymes under the trade name Fungamyl® are suitable. A further commercial product is the amylase-LT® for example.

According to the invention, lipases or cutinases can also be incorporated, particularly due to their triglyceride cleaving activities, but also in order to produce in situ peracids from suitable preliminary steps. These include the available or further developed lipases originating from *Humicola lanuginosa* (*Thermomyces lanuginosus*), particularly those with the amino acid substitution D96L. They are commercialized, for example, by the Novozymes Company under the trade names Lipolase®, Lipolase®Ultra, LipoPrime®, Lipozyme® and Lipex®. Moreover, suitable cutinases, for example, are those that were originally isolated from *Fusarium solani pisi* and *Humicola insolens*. Likewise useable lipases are available from the Amano Company under the designations Lipase CE®, Lipase P®, Lipase B®, and Lipase CES®, Lipase AKG®, *Bacillis* sp. Lipase®, Lipase AP®, Lipase M-AP® and Lipase AML®. Suitable lipases or cutinases whose starting enzymes were originally isolated from *Pseudomonas mendocina* and *Fusarium solanii* are for example, available from Genencor Company. Further important commercial products that may be mentioned are the commercial preparations M1 Lipase® and Lipomax® originally from Gist-Brocades Company, and the commercial enzymes from the Meito Sangyo KK Company, Japan under the names Lipase MY-30®, Lipase OF® and Lipase PL® as well as the product Lumafast® from Genencor Company.

In addition, enzymes, which are summarized under the term hemicellulases, can be added. These include, for example, mannanases, xanthanlyases, pectinlyases (=pectinases), pectinesterases, pectatlyases, xyloglucanases (=xylanases), pullulanases and β-glucanases. Suitable mannanases, for example, are available under the names Gamanase® and Pektinex AR® from Novozymes Company, under the names Rohapec® B1L from AB Enzymes and under the names Pyrolase® from Diversa Corp., San Diego, Calif., USA. β-Glucanase extracted from *B. subtilis* is available under the name Cereflo® from Novozymes Company.

To increase the bleaching action, oxidoreductases, for example, oxidases, oxygenases, katalases, peroxidases, like halo-, chloro-, bromo-, lignin-, glucose- or manganese-peroxidases, dioxygenases or laccases (phenoloxidases, polyphenoloxidases) can be incorporated according to the invention. Suitable commercial products are Denilite® 1 and 2 from the Novozymes Company. Advantageously, additional, preferably organic, particularly preferably aromatic compounds are added that interact with the enzymes to enhance the activity of the relative oxidoreductases or to facilitate the electron flow (mediators) between the oxidizing enzymes and the stains over strongly different redox potentials.

The enzymes either stem originally from microorganisms, such as the species *Bacillus, Streptomyces, Humicola*, or *Pseudomonas*, and/or are produced according to known biotechnological processes using suitable microorganisms such as by transgenic expression hosts of the species *Bacillus* or filamentary fungi.

Purification of the relevant enzymes follows conveniently using established processes such as precipitation, sedimentation, concentration, filtration of the liquid phases, microfiltration, ultrafiltration, mixing with chemicals, deodorization or suitable combinations of these steps.

The enzymes can be added in each established form according to the prior art. Included here, for example, are solid preparations obtained by granulation, extrusion or lyophilization, or particularly for liquid agents or agents in the form of gels, enzyme solutions, advantageously highly concentrated, of low moisture content and/or mixed with stabilizers.

As an alternative application form, the enzymes can also be encapsulated, for example, by spray drying or extrusion of the enzyme solution together with a preferably natural polymer or in the form of capsules, for example, those in which the enzyme is embedded in a solidified gel, or in those of the core-shell type, in which an enzyme-containing core is covered with a water-, air- and/or chemical-impervious protective layer. Further active principles, for example, stabilizers, emulsifiers, pigments, bleaches or colorants can be applied in additional layers. Such capsules are made using known methods, for example, by vibratory granulation or roll compaction or by fluid bed processes. Advantageously, these types of granulates, for example, with an applied polymeric film former are dust-free and as a result of the coating are storage stable.

In addition, it is possible to formulate two or more enzymes together, so that a single granulate exhibits a plurality of enzymatic activities.

A protein and/or enzyme can be protected, particularly in storage, against deterioration such as, for example, inactivation, denaturation or decomposition, for example, through physical influences, oxidation or proteolytic cleavage. An inhibition of the proteolysis is particularly preferred during microbial preparation of proteins and/or enzymes, particularly when the agents also contain proteases. For this use, detergents or cleansing agents can comprise stabilizers; the provision of these types of agents represents a preferred embodiment of the present invention.

One group of stabilizers is reversible protease inhibitors. For this purpose, benzamidine hydrochloride, borax, boric acids, boronic acids or their salts or esters are frequently used, above all, derivatives with aromatic groups, for example, ortho, meta or para substituted phenyl boronic acids or the salts or esters. Ovomucoid and leupeptin, inter alia, are mentioned as peptidic protease inhibitors; an additional option is the formation of fusion proteins from proteases and peptide inhibitors.

Further enzyme stabilizers are amino alcohols like mono-, di-, tri-ethanolamine and -propanolamine and their mixtures, aliphatic carboxylic acids up to $C_{12}$, such as, for example, succinic acid, other dicarboxylic acids or salts of the cited acids. End capped alkoxylated fatty acid amides are also suitable. Certain organic acids used as builders can additionally stabilize an included enzyme.

Lower aliphatic alcohols, but above all polyols such as, for example, glycerol, ethylene glycol, propylene glycol or sorbitol, are additional frequently used enzyme stabilizers. Likewise, calcium salts are used, such as, for example, calcium acetate or calcium formate, and magnesium salts.

Polyamide oligomers or polymeric compounds like lignin, water-soluble vinyl copolymers or cellulose ethers, acrylic polymers and/or polyamides stabilize enzyme preparations against physical influences or pH variations. Polymers that contain polyamine-N-oxide are effective enzyme stabilizers. Other polymeric stabilizers are the linear $C_8$-$C_{18}$ polyoxyalkylenes. Alkyl polyglycosides can stabilize the enzymatic components and even increase their performance. Crosslinked N-containing compounds also act as enzyme stabilizers.

Reducing agents and antioxidants increase the stability of enzymes against oxidative decomposition. A sulfur-containing reducing agent is sodium sulfite, for example.

The use of combinations of stabilizers is preferred, for example, of polyols, boric acid and/or borax, the combination of boric acid or borate, reducing salts and succinic acid or other dicarboxylic acids or the combination of boric acid or borate with polyols or polyamino compounds and with reducing salts. The effect of peptide-aldehyde stabilizers is increased by the combination with boric acid and/or boric acid derivatives and polyols and still more by the additional effect of divalent cations, such as for example, calcium ions.

Preferably, one or a plurality of enzymes and/or enzyme preparations, preferably solid protease preparations and/or amylase preparations are incorporated in quantities from 0.1 to 5 wt. %, preferably from 0.2 to 4.5 wt. % and, in particular, from 0.4 to 4 wt. %, each based on the total enzyme-containing agent.

Glass Corrosion Inhibitors.

Glass corrosion inhibitors prevent the occurrence of smears, streaks and scratches as well as iridescence on the glass surface of glasses washed in an automatic dishwasher. Preferred glass corrosion inhibitors come from the group of magnesium and/or zinc salts and/or magnesium and/or zinc complexes.

A preferred class of compounds that can be used to prevent glass corrosion are insoluble zinc salts.

In terms of the preferred embodiment, insoluble zinc salts are zinc salts with a solubility of maximum 10 grams zinc salt per liter of water at 20° C. According to the invention, examples of particularly preferred insoluble zinc salts are zinc silicate, zinc carbonate, zinc oxide, basic zinc carbonate ($Zn_2(OH)_2CO_3$), zinc hydroxide, zinc oxalate, zinc monophosphate ($Zn_3(PO_4)_2$), and zinc pyrophosphate ($Zn_2(P_2O_7)$).

The cited zinc compounds are preferably used in quantities that produce an amount of zinc ions in the agent between 0.02 and 10 wt. %, preferably between 0.1 and 5.0 wt. % and especially between 0.2 and 1.0 wt. %. based on the total agent containing the glass corrosion inhibitor. The exact content of the zinc salt or zinc salts in the agent naturally depends on the type of zinc salt—the lower the solubility of the added zinc salt, the higher must be its concentration in the agents.

As, for the most part, the insoluble zinc salts remain unchanged during operation of the dishwasher, the particle size of the salts is an important criterion for the salts not to stick to the glassware or machine parts. Agents are preferred in which the insoluble zinc salts have a particle size below 1.7 mm.

When the maximum particle size of the insoluble zinc salt lies below 1.7 mm, one need not worry about insoluble residues in the dishwasher. Preferably, in order to further minimize the danger of insoluble residues, the insoluble zinc salt has an average particle size markedly below this value, for example, an average particle size of less than 250 μm. This is more and more true as the solubility of the zinc salt decreases. In addition, the efficiency of the glass corrosion inhibition increases with decreasing particle size. For zinc salts with very low solubility, the particle size preferably lies below 100 μm. For zinc salts with even lower solubility, it can be even less; for example, the average particle size for the very poorly soluble zinc oxide preferably lies below 60 μm.

A further preferred class of compounds are magnesium and/or zinc salt(s) of at least one monomeric and/or polymeric organic acid. These ensure that even on repeated use, the surfaces of the glassware are not corroded, especially that no smears, streaks and scratches or iridescence occur on the glass surfaces.

Although any magnesium and/or zinc salt(s) of monomeric and/or polymeric organic acids can be used, the magnesium and/or zinc salt(s) of monomeric and/or polymeric organic acids from the groups of the non-branched, saturated or unsaturated monocarboxylic acids, the branched, saturated or unsaturated monocarboxylic acids, the saturated and unsaturated dicarboxylic acids, the aromatic mono-, di- and tricarboxylic acids, the sugar acids, the hydroxy acids, the oxoacids, the amino acids and/or the polymeric carboxylic acids are, however, preferred.

The spectrum of the inventively preferred zinc salts of organic acids, preferably organic carboxylic acids, ranges from salts that are difficultly soluble or insoluble in water, i.e. with a solubility below 100 mg/l, preferably below 10 mg/l, or especially below 0.01 mg/l, to such salts with solubilities in water greater than 100 mg/l, preferably over 500 mg/l, particularly preferably over 1 g/l and especially over 5 g/l (all solubilities at a water temperature of 20° C.). The first group of zinc salts includes zinc citrate, zinc oleate and zinc stearate, the group of soluble zinc salts includes, for example, zinc formate, zinc acetate, zinc lactate and zinc gluconate.

A particular advantageous glass corrosion inhibitor is a zinc salt of an organic carboxylic acid, particularly preferably a zinc salt from the group zinc stearate, zinc oleate, zinc gluconate, zinc acetate, zinc lactate and/or zinc citrate. Zinc ricinoleate, zinc abietate and zinc oxalate are also preferred.

In the context of the present invention, the content of zinc salt in the cleaning agent is advantageously between 0.1 and 5 wt. %, preferably between 0.2 and 4.0 wt. % and particularly preferably between 0.4 and 3 wt. %. The content of zinc in the oxidized form (calculated as $Zn^{2+}$) is between 0.01 and 1 wt. %, preferably between 0.02 and 0.5 wt. % and particularly preferably between 0.04 and 0.2 wt. % respectively, based on the total weight of the agent containing the glass corrosion inhibitor.

Corrosion Inhibitors.

Corrosion inhibitors serve to protect the tableware or the machine, silver protection agents being particularly important in automatic dishwashing. Substances known from the prior art can be incorporated. Above all, silver protectors selected from the group of triazoles, benzotriazoles, bisbenzotriazoles, aminotriazoles, alkylaminotriazoles and the transition metal salts or complexes may generally be used. Benzotriazole and/or alkylaminotriazole are particularly preferably used. Exemplary inventively preferred suitable 3-amino-5-alkyl-1,2,4-triazoles can be cited: propyl-, -butyl-, -pentyl-, -heptyl-, -octyl-, -nonyl-, -decyl-, -undecyl-, -dodecyl-, -isononyl-, -versatic-10-acid alkyl-, -phenyl-, -p-tolyl-, -(4-tert.butylphenyl)-, -(4-methoxyphenyl)-, -(2-, -3-, 4-pyridyl)-, -(2-thienyl)-, -(5-methyl-2-furyl)-, -(5-oxo-2-pyrrolidinyl)-, -3-amino-1,2,4-triazole. In dishwasher detergents, the alkylamino-1,2,4-triazoles or their physiologically compatible salts are used in a concentration of 0.001 to 10 wt. %, preferably 0.0025 to 2 wt. %, particularly preferably 0.01 to 0.04 wt. %. Preferred acids for the salt formation are hydrochloric acid, sulfuric acid, phosphoric acid, carbonic acid, sulfurous acid, organic carboxylic acids like acetic acid, glycolic acid, citric acid, succinic acid. 5-Pentyl-, 5-heptyl-, 5-nonyl-, 5-undecyl-, 5-isononyl-, 5-versatic-10-acid alkyl-3-amino-1,2,4-triazoles as well as mixtures of these substances are quite particularly efficient.

Frequently encountered in cleansing formulations, furthermore, are agents containing active chlorine, which may significantly reduce corrosion of the silver surface. In chlorine-free cleansing products, particular use is made of oxygen-containing and nitrogen-containing organic redox-active compounds, such as dihydric and trihydric phenols, e.g. hydroquinone, pyrocatechol, hydroxyhydroquinone, gallic acid, phloroglucinol, pyrogallol and derivatives of these classes of compound. Salts and complexes of inorganic compounds, such as salts of the metals Mn, Ti, Zr, Hf, V, Co and Ce are also frequently used. Preference is given in this context to the transition metal salts selected from the group consisting of manganese and/or cobalt salts and/or complexes, particularly preferably cobalt ammine complexes, cobalt acetato complexes, cobalt carbonyl complexes, the chlorides of cobalt or of manganese, and manganese sulfate. Zinc compounds may also be used to prevent corrosion of tableware.

Redox-active substances may be added instead of, or in addition to the above described silver protection agents, e.g., the benzotriazoles. These substances are preferably inorganic redox-active substances from the group of salts and/or complexes of manganese, titanium, zirconium, hafnium, vanadium, cobalt or cerium, in which the cited metals exist in the valence states II, III, IV, V or VI.

The metal salts or complexes used should be at least partially soluble in water. Suitable counter ions for the salt formation include all usual mono, di or trivalent negatively charged inorganic anions, e.g., oxide, sulfate, nitrate, fluoride and also organic anions e.g., stearate.

In the context of the invention, metal complexes are compounds that consist of a central atom and one or several ligands as well as optionally one or several of the above-mentioned anions in addition. The central atom is one of the above-mentioned metals in one of the above-mentioned valence states. Ligands are neutral molecules or anions, which are monodentate or bidentate; in the context of the invention, the term "ligands" is discussed in more detail in "Römpp Chemie Lexikon, Georg Thieme Verlag Stuttgart/New York, 9. Edition, 1990, page 2507." If the charge on the central atom and the charge of the ligand(s) do not add up to zero, then according to whether a cationic or an anionic residual charge is present, either one or several of the above-mentioned anions or one or more of the cations, e.g. sodium, potassium, ammonium ions equalise the charge difference. Suitable complex builders are e.g. citrate, acetylacetonate or 1-hydroxyethane-1,1-diphosphonate.

The current definition for "valence state" in chemistry is given in "Römpp Chemie Lexikon, Georg Thieme Verlag Stuttgart/New York, 9. Edition, 1991, page 3168."

Particularly preferred metal salts and/or metal complexes are selected from the group $MnSO_4$, Mn(II)-citrate, Mn(II)-stearate, Mn(II)-acetylacetonate, Mn(II)-[1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$, $Ce(NO_3)_3$, as well as their mixtures, such that the metal salts and/or metal complexes selected from the group $MnSO_4$, Mn(II)-citrate, Mn(II)-stearate, Mn(II)-acetylacetonate, Mn(II)-[1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$, $Ce(NO_3)_3$ are employed with particular preference.

These metal salts and/or metal complexes are generally commercially available substances that can be employed in the detergents or cleansing agents for silver corrosion protection without prior cleaning. The mixture of pentavalent and tetravalent vanadium ($V_2O_5$, $VO_2$, $V_2O_4$), known from the $SO_3$ manufacturing process (Contact Process) is suitable, for example, similarly titanyl sulfate, $TiOSO_4$ that is formed by diluting a solution of $Ti(SO_4)_2$.

The inorganic redox-active substances, particularly metal salts or metal complexes are preferably coated, i.e. completely coated with a water-impermeable material that is easily soluble at the cleaning temperature, so as to prevent any premature decomposition or oxidation on storage. Preferred coating materials, which are applied using known processes, for instance hot melt coating process from Sandwik in the food industry, are paraffins, microwaxes, waxes of natural origin such as candelilla wax, carnuba wax, beeswax, higher-melting alcohols such as, for example, hexadecanol, soaps or fatty acids. The coating material, which is solid at room temperature, is applied in the molten state onto the material to be coated, e.g. by projecting a continuous stream of finely-divided material to be coated through a likewise continuously produced atomized spray zone of molten coating material. The melting point must be chosen such that the coating material easily dissolves or quickly solidifies during the silver treatment. The melting point should ideally lie in the range between 45° C. and 65° C. and preferably in the range 50° C. to 60° C.

The cited metal salts and/or metal complexes are comprised in the cleaning agents, preferably in a quantity of 0.05 to 6 wt. %, preferably 0.2 to 2.5 wt. %, each based on the total weight of the agent containing the corrosion inhibitor.

Disintegration Aids.

In order to facilitate the disintegration of the preconditioned molded bodies, disintegration aids, so-called tablet disintegrators, may be incorporated in the agents to shorten their disintegration times. According to Römpp ($9^{th}$ Edition, Vol. 6, page 4440) and Voigt "Lehrbuch der pharmazeutischen Technologie" ($6^{th}$ Edition, 1987, pages 182-184), tablet disintegrators or disintegration accelerators are auxiliaries, which promote the rapid disintegration of tablets in water or gastric juices and the release of the pharmaceuticals in an absorbable form.

These substances, which are also known as "disintegrators" by virtue of their effect, increase in volume on contact with water so that, firstly, their own volume increases (swelling) and secondly, a pressure can also be generated by the release of gases, causing the tablet to disintegrate into smaller particles.

Well-known disintegrators are, for example, carbonate/citric acid systems, although other organic acids may also be used.

Swelling disintegration aids are, for example, synthetic polymers, such as polyvinyl pyrrolidone (PVP), or natural polymers and modified natural substances, such as cellulose and starch and derivatives thereof, alginates or casein derivatives.

The disintegration aids are preferably incorporated in quantities of 0.5 to 10 wt. %, advantageously from 3 to 7 wt. % and especially from 4 to 6 wt. %, each based on the total weight of the agent containing the disintegration aid.

Preferred disintegrators that are used are based on cellulose, and therefore the preferred detergent and cleaning agents comprise such a cellulose-based disintegrator in quantities from 0.5 to 10% by weight, advantageously 3 to 7% by weight and especially 4 to 6% by weight. Pure cellulose has the formal empirical composition $(C_6H_{10}O_5)_n$ and, formally, is a β-1,4-polyacetal of cellobiose that, in turn, is made up of two molecules of glucose. In this context, suitable celluloses consist of approximately 500 to 5,000 glucose units and consequently have average molecular weights of 50,000 to 500,000. In the context of the present invention, cellulose derivatives obtainable from cellulose by polymer-analogous reactions may also be used as cellulose-based disintegrators. These chemically modified celluloses include, for example, products of esterification or etherification reactions in which hydroxy hydrogen atoms have been substituted. However, celluloses in which the hydroxy groups have been replaced by functional groups that are not attached by an oxygen atom may also be used as cellulose derivatives. The group of cellulose derivatives includes, for example, alkali metal celluloses, carboxymethyl cellulose (CMC), cellulose esters and ethers and aminocelluloses. The cellulose derivatives mentioned are preferably not used on their own, but rather in the form of a mixture with cellulose as cellulose-based disintegrators. The content of cellulose derivatives in mixtures such as these is preferably below 50% by weight and particularly preferably below 20% by weight, based on the cellulose-based disintegrator. A particularly preferred cellulose-based disintegrator is pure cellulose, free from cellulose derivatives.

The cellulose, used as the disintegration aid, is advantageously not added in the form of fine particles, but rather conveyed in a coarser form prior to addition to the premix that will be compressed, for example, granulated or compacted. The particle sizes of such disintegrators are mostly above 200 μm, advantageously with 90 wt. % between 300 and 1,600 μm and particularly at least 90 wt. % between 400 and 1,200 μm. In the context of the present invention, the above-mentioned coarser disintegration aids, also described in greater detail in the cited publications, are preferred disintegration aids and are commercially available for example, from the Rettenmaier Company under the trade name Arbocel® TF-30-HG.

Microcrystalline cellulose can be used as a further cellulose-based disintegration aid, or as an ingredient of this component. The microcrystalline cellulose is obtained by the partial hydrolysis of cellulose, under conditions, which only attack and fully dissolve the amorphous regions (approximately 30% of the total cellulosic mass) of the cellulose, leaving the crystalline regions (approximately 70%) intact. Subsequent disaggregation of the microfine cellulose, obtained by hydrolysis, yields microcrystalline celluloses with primary particle sizes of approximately 5 μm and for example, compactable granules with an average particle size of 200 μm.

Preferred disintegration aids, advantageously a disintegration aid based on cellulose, preferably in granular, cogranulated or compacted form, are comprised in the disintegration aid-containing agent in quantities of 0.5 to 10 wt. %, preferably 3 to 7 wt. % and particularly 4 to 6 wt. %, each based on the total weight of the disintegration aid-containing agent.

Moreover, according to the invention, it can be preferred to incorporate additional effervescing systems as tablet disintegration aids. The gas-evolving effervescent system can consist of a single substance, which liberates a gas on contact with water. Among these compounds, particular mention is made of magnesium peroxide, which liberates oxygen on contact with water. Normally, however, the gas-liberating effervescent system consists of at least two ingredients that react with one another to form gas. Although various possible systems could be used, for example, systems releasing nitrogen, oxygen or hydrogen, the effervescent system used in the detergent and cleansing agent should be selected with both economic and ecological considerations in mind. Preferred effervescent systems consist of alkali metal carbonate and/or -hydrogen carbonate and an acidifying agent capable of releasing carbon dioxide from the alkali metal salts in aqueous solution.

Among the alkali metal carbonates or hydrogen carbonates, the sodium and potassium salts are markedly preferred against the other salts for reasons of cost. Naturally, the relevant pure alkali metal carbonates or hydrogen carbonates need not be used; in fact, mixtures of different carbonates and hydrogen carbonates can be preferred.

In preferred effervescent systems, 2 to 20% by weight, advantageously 3 to 15% by weight and particularly 5 to 10% by weight of an alkali metal carbonate or -hydrogen carbonate are used, and 1 to 15, advantageously 2 to 12 and preferably 3 to 10% by weight of an acidifying agent, each based on the total weight of the agent.

Suitable acidifiers, which liberate carbon dioxide from alkali salts in aqueous solution, are, for example, boric acid and alkali metal hydrogen sulfates, alkali metal dihydrogen phosphates and other inorganic salts. Preferably, however, organic acidifiers are used, citric acid being the preferred acidifier. However, solid mono-, oligo- and polycarboxylic acids are also particularly suitable. Within this group, citric acid, tartaric acid, succinic acid, malonic acid, adipic acid, maleic acid, fumaric acid, oxalic acid and polyacrylic acid are again preferred. Organic sulfonic acids, such as amidosulfonic acid, may also be used. Sokalan® DCS (trademark of BASF), a mixture of succinic acid (max. 31% by weight), glutaric acid (max. 50% by weight) and adipic acid (max. 33% by weight), is commercially available and may also be used with advantage as an acidifying agent for the purposes of the present invention.-%).

Preferred acidifiers in the effervescing system are from the group of organic di-, tri- and oligocarboxylic acids or their mixtures.

Fragrances.

In the context of the present invention, suitable perfume oils or fragrances include individual perfume compounds, for example, synthetic products of the ester, ether, aldehyde, ketone, alcohol and hydrocarbon type. Perfume compounds of the ester type are, for example, benzyl acetate, phenoxyethyl isobutyrate, p-tert.-butylcyclohexyl acetate, linalyl acetate, dimethylbenzyl carbinyl acetate, phenylethyl acetate, linalyl benzoate, benzyl formate, ethylmethylphenyl glycinate, allylcyclohexyl propionate, styrallyl propionate and benzyl salicylate. The ethers include, for example, benzyl ethyl ether; the aldehydes include, for example, the linear alkanals containing 8 to 18 carbon atoms, citral, citronellal, citronellyloxyacetaldehyde, cyclamen aldehyde, hydroxycitronellal, lilial and bourgeonal; the ketones include, for example, the ionones, ∝-isomethyl ionone and methyl cedryl ketone; the alcohols include anethol, citronellol, eugenol, geraniol, linalool, phenylethyl alcohol and terpineol and the hydrocarbons include, above all, the terpenes, such as limonene and pinene. However, mixtures of various odoriferous substances, which together produce an attractive perfume note, are preferably used. Perfume oils such as these may also contain natural perfume mixtures obtainable from vegetal sources, for example, pine, citrus, jasmine, patchouli, rose or ylang-ylang oil. Also suitable are muscatel oil, oil of sage, chamomile oil, clove oil, melissa oil, mint oil, cinnamon leaf oil, lime blossom oil, juniper berry oil, vetivert oil, olibanum oil, galbanum oil and laudanum oil and orange blossom oil, neroli oil, orange peel oil and sandalwood oil.

The general description of the employable perfumes (see above) generally illustrates the different substance classes of perfumes. The volatility of a perfume is crucial for its perceptibility, whereby in addition to the nature of the functional groups and the structure of the chemical compound, the molecular weight also plays an important role. Thus, the majority of perfumes have molecular weights up to 200 daltons. Molecular weights of 300 daltons and above are quite an exception. Due to the different volatilities of perfumes, the smell of a perfume or fragrance composed of a plurality of odorous substances changes during evaporation, the impressions of odor being subdivided into the "top note," "middle note" or "body" and "end note" or "dry out." As the perception of smell also depends to a large extent on the intensity of the odor, the top note of a perfume or fragrance consists not solely from highly volatile compounds, whereas the endnote consists to a large extent from less volatile, i.e. tenacious odiferous substances. In the composition of perfumes, higher volatile odiferous substances can be bound, for example, onto particular fixatives, whereby their rapid evaporation is impeded. In the following subdivision of perfumes into "more volatile" or "tenacious" perfumes, nothing is mentioned about the odor impression and further, whether the relevant perfume is perceived as the top note or body note.

Exemplary tenacious odorous substances that can be used in the context of the present invention are the ethereal oils such as angelica root oil, aniseed oil, arnica flowers oil, basil oil, bay oil, bergamot oil, champax blossom oil, silver fir oil, silver fir cone oil, elemi oil, eucalyptus oil, fennel oil, pine needle oil, galbanum oil, geranium oil, ginger grass oil, *guaiacum* wood oil, Indian wood oil, *helichrysum* oil, ho oil, ginger oil, iris oil, cajuput oil, sweet flag oil, camomile oil, camphor oil, Canoga oil, cardamom oil, *cassia* oil, Scotch fir oil, copaiba balsam oil, coriander oil, spearmint oil, caraway oil, cumin oil, lavender oil, lemon grass oil, limefte oil, mandarin oil, melissa oil, amber seed oil, myrrh oil, clove oil, neroli oil, niaouli oil, olibanum oil, orange oil, *origanum* oil, Palma Rosa oil, patchouli oil, Peru balsam oil, petit grain oil, pepper oil, peppermint oil, pimento oil, pine oil, rose oil, rosemary oil, sandalwood oil, celery seed oil, lavender spike oil, Japanese anise oil, turpentine oil, *thuja* oil, thyme oil, verbena oil, vetiver oil, juniper berry oil, wormwood oil, wintergreen oil, ylang-ylang oil, ysop oil, cinnamon oil, cinnamon leaf oil, citronella oil, citrus oil and cypress oil. However, in the context of the present invention, the higher boiling or solid odoriferous substances of natural or synthetic origin can be used as tenacious odoriferous substances or mixtures thereof, namely fragrances. These compounds include the following compounds and their mixtures: ambrettolide, α-amyl cinnamaldehyde, anethol, anisaldehyde, anis alcohol, anisole, methyl anthranilate, acetophenone, benzyl acetone, benzaldehyde, ethyl benzoate, benzophenone, benzyl alcohol, benzyl acetate, benzyl benzoate, benzyl formate, benzyl valeriate, borneol, bornyl acetate, α-bromostyrene, n-decyl aldehyde, n-dodecyl aldehyde, eugenol, eugenol methyl ether, eucalyptol, farnesol, fenchone, fenchyl acetate, geranyl acetate, geranyl formate, heliotropin, methyl heptyne carboxylate, heptaldehyde, hydroquinone dimethyl ether, hydroxycinnamaldehyde, hydroxycinnamyl alcohol, indole, irone, isoeugenol, isoeugenol methyl ether, isosafrol, jasmone, camphor, carvacrol, carvone, p-cresol methyl ether, coumarone, p-methoxyacetophenone, methyl-n-amyl ketone, methyl anthranilic acid methyl ester, p-methyl acetophenone, methyl chavicol, p-methyl quinoline, methyl-β-naphthyl ketone, methyl-n-nonyl acetaldehyde, methyl-n-nonyl ketone, muscone, β-naphthol ethyl ether, β-naphthol methyl ether, nerol, nitrobenzene, n-nonyl aldehyde, nonyl alcohol, n-octyl aldehyde, p-oxyacetophenone, pentadecanolide, β-phenyl ethyl alcohol, phenyl acetaldehyde dimethyl acetal, phenyl acetic acid, pulegone, safrol, isoamyl salicylate, methyl salicylate, hexyl salicylate, cyclohexyl salicylate, santalol, scatol, terpineol, thymine, thymol, γ-undecalactone, vanillin, veratrum aldehyde, cinnamaldehyde, cinnamyl alcohol, cinnamic acid, ethyl cinnamate, benzyl cinnamate. The readily volatile odoriferous substances particularly include the low boiling odoriferous substances of natural or synthetic origin that can be used alone or in mixtures. Exemplary readily volatile odoriferous substances are alkyl isothiocyanates (alkyl mustard oils), butanedione, limonene, linalool, linalyl acetate and linalyl propionate, menthol, menthone, methyl-n-heptenone, phellandrene, phenyl acetaldehyde, terpinyl acetate, citral, citronellal.

The fragrances may be directly incorporated, although it can also be of advantage to apply the fragrances on carriers that due to a slower fragrance release ensure a long lasting fragrance. Suitable carrier materials are, for example, cyclodextrins, the cyclodextrin/perfume complexes optionally being coated with other auxiliaries.

Colorants.

Preferred colorants, which are not difficult for the person skilled in the art to choose, have a high storage stability, are not affected by the other ingredients of the agent or by light and do not have any pronounced substantivity for the substrates such as glass, ceramics or plastic dishes being treated with the colorant-containing agent, so as not to color them.

When choosing the colorant, care must be taken in the case of laundry detergents that the colorants do not exhibit too strong an affinity for textile surfaces, especially synthetic fibers, while for cleansing agents, too strong an affinity for glass, ceramics or plastic tableware must be avoided. At the same time, the different stabilities of colorants towards oxidation must also be borne in mind when choosing suitable colorants. In general, water-insoluble colorants are more stable to oxidation than are water-soluble colorants. The concentration of the colorant in the detergents or cleaning agents, is varied depending on the solubility and hence also on the propensity to oxidation. For highly soluble colorants, e.g., the above cited Basacid® Green or the Sandolan® Blue, also cited above, colorant concentrations are typically chosen in the range of several $10^{-2}$ to $10^{-3}$ wt. %. For the less highly soluble, but due to their brilliance, particularly preferred pigment dyes, e.g. the above cited Pigmosol® dyes, their suitable concentration in detergents or cleaning agents, in contrast, is typically several $10^{-3}$ to $10^{-4}$ wt. %.

Dyes are preferred that can be oxidatively destroyed in the washing process, as well as mixtures thereof with suitable blue colorants, the "blue toners." It has also proved advantageous to employ dyes that are soluble in water or in liquid organic substances at room temperature. Anionic dyestuffs, for example, anionic nitroso dyes, are suitable. A possible dye is Naphtholgrün, for example, (Color Index (CI) Part 1: Acid Green 1, Part 2: 10020), which is commercially available as Basacid® Grün from BASF, Ludwigshafen, together with its mixtures with suitable blue colorants. Additional dyes that can be employed are Pigmosol® Blau 6900 (CI 74160), Pigmosol® Grün 8730 (CI 74260), Basonyl® Rot 545 FL (CI 45170), Sandolan® Rhodamin EB400 (CI 45100), Basacid® Gelb 094 (CI 47005), Sicovit® Patentblau 85 E 131 (CI 42051), Acid Blue 183 (CAS 12217-22-0, CI Acidblue 183), Pigment Blue 15 (CI 74160), Supranol® Blau GLW (CAS 12219-32-8, CI Acidblue 221)), Nylosan® Gelb N-7GL SGR (CAS 61814-57-1, CI Acidyellow 218) and/or Sandolan® Blau (CI Acid Blue 182, CAS 12219-26-0).

In addition to the components described in detail above, the detergents and cleansing agents can comprise additional ingredients that further improve the application, technological and/or aesthetic properties of the agents. Preferred agents comprise one or a plurality of materials from the group of the electrolytes, pH-adjustors, fluorescent agents, hydrotropes, foam inhibitors, silicone oils, anti-redeposition agents, optical brighteners, graying inhibitors, shrink preventers, anti-creasing agents, color transfer inhibitors, antimicrobials, germicides, fungicides, antioxidants, antistats, ironing auxiliaries, water proofing and impregnation agents, swelling and antipilling agents, sequestrants and UV absorbers.

A large number of the most varied salts can be employed as the electrolytes from the group of the inorganic salts. Preferred cations are the alkali and alkali earth metals, preferred anions are the halides and sulfates. From the industrial manufacturing point of view, the addition of NaCl or $MgCl_2$ to the detergents or cleansing agents is preferred.

The addition of pH adjusters can be considered for bringing the pH of the detergents or cleansing agents into the desired range. Any known acid or alkali can be added, insofar as their addition is not forbidden on technological or ecological grounds or grounds of protection of the consumer. The amount of these adjusters does not normally exceed 1 wt. % of the total formulation.

Soaps, oils, fats, paraffins or silicone oils, optionally deposited on carrier materials, are examples of the foam inhibitors. Inorganic salts, such as carbonates or sulfates, cellulose derivatives or silicates as well as their mixtures are examples of suitable carrier materials. In the context of the present application, preferred agents comprise paraffins, preferably unbranched paraffins (n-paraffins) and/or silicones, preferably linear polymeric silicones that have the structure $(R_2SiO)_x$ and which are also called silicone oils. These silicone oils are usually clear, colorless, neutral, odorless, hydrophobic liquids with a molecular weight between 1,000-150,000, and viscosities between 10 and 1,000,000 mPas.

Suitable anti-redeposition agents, also referred to as soil repellents, are, for example, nonionic cellulose ethers such as methyl cellulose and methyl hydroxypropyl cellulose with a content of methoxy groups of 15 to 30 wt. % and hydroxypropyl groups of 1 to 15 wt. %, each based on the nonionic cellulose ether, as well as polymers of phthalic acid and/or terephthalic acid or their derivatives known from the prior art, particularly polymers of ethylene terephthalates and/or polyethylene glycol terephthalates or anionically and/or nonionically modified derivatives thereof. From these, the sulfonated derivatives of the phthalic acid polymers and the terephthalic acid polymers are particularly preferred.

Optical brighteners ("whiteners") can be added to detergents or cleansing agents in order to eliminate graying and yellowing of the treated textiles. These materials absorb onto the fiber and effect a brightening and pseudo bleach effect in that the invisible ultraviolet radiation is converted into visible radiation, wherein the ultraviolet light absorbed from sunlight is irradiated away as weak blue fluorescence and results in pure white for the yellow shade of the grayed or yellowed washing. Suitable compounds originate, for example, from the substance classes of 4,4'-diamino-2,2'-stilbenedisulfonic acids (flavonic acids), 4,4'-distyrylbiphenylene, methylumbelliferone, coumarone, dihydroquinolinones, 1,3-diarylpyrazolines, naphthoic acid imide, benzoxazole-, benzisoxazole- and benzimidazole-systems, as well as heterocyclic substituted pyrene derivatives.

Graying inhibitors have the function of maintaining the dirt that was removed from the fibers suspended in the washing liquor, thereby preventing the dirt from resettling. Water-soluble colloids of mostly organic nature are suitable for this, for example, the water-soluble salts of polymeric carboxylic acids, glue, gelatines, salts of ether sulfonic acids of starches or celluloses, or salts of acidic sulfuric acid esters of celluloses or starches. Water-soluble, acid group-containing polyamides are also suitable for this purpose. Moreover, soluble starch preparations and others can be used as the above-mentioned starch products, e.g., degraded starches, aldehyde starches etc. Polyvinyl pyrrolidone can also be used. Additional anti-graying inhibitors that can be used are cellulose ethers such as carboxymethyl cellulose (Na salt), methyl cellulose, hydroxyalkyl celluloses and mixed ethers such as methyl hydroxyethyl cellulose, methyl hydroxypropyl cellulose, methyl carboxymethyl cellulose and mixtures thereof.

As fabric surfaces, particularly of rayon, spun rayon, cotton and their mixtures, can wrinkle of their own accord because the individual fibers are sensitive to flection, bending, pressing and squeezing perpendicular to the fiber direction, the agents can comprise synthetic crease-protection agents. They include for example, synthetic products based on fatty acids, fatty acid esters, fatty acid amides, fatty acid alkylol esters, fatty acid alkylol amides or fatty alcohols that have been mainly treated with ethylene oxide, or products based on lecithin or modified phosphoric acid esters.

Repellency and impregnation processes serve to furnish the textiles with substances that prevent soil deposition or facilitate their washability. Preferred repellency and impregnation agents are perfluorinated fatty acids also in the form of their aluminum or zirconium salts, organic silicates, silicones, polyacrylic acid esters with perfluorinated alcohol components or polymerizable compounds coupled with perfluorinated acyl or sulfonyl groups. Antistats can also be comprised. The soil repellent finish with repellency and impregnation agents is often classified as an easy-care finish. The penetration of the impregnation agent in the form of solutions or emulsions of the appropriate active substances can be facilitated by the addition of wetting agents that lower the surface tension. A further application area for repellency and impregnation agents is the water-repellent finishing of textile goods, tents, awnings, leather etc., in which, contrary to waterproofing, the fabric pores are not blocked, and the material therefore remains breathable (water-repellent finishing). The water-repellents used for water-repellent finishing coat textiles, leather, paper, wood etc. with a very thin layer of hydrophobic groups, such as long chain alkyl or siloxane groups. Suitable water-repellent agents are, for example, paraffins, waxes, metal soaps etc. with added aluminum- or zirconium salts, quaternary ammonium compounds with long chain alkyl groups, urea derivatives, fatty acid modified melamine resins, salts of chromium complexes, silicones, organo-tin compounds and glutardialdehyde as well as perfluorated compounds. The finished water-repellent materials do not feel greasy; nevertheless, water droplets form drops on them without wetting them, just like on greased materials. Thus, silicone-impregnated fabrics, for example, have a soft feel and are water and soil repellent; spots of ink, wine, fruit juices and the like are easier to remove.

Antimicrobial agents can be employed to combat microorganisms. Depending on the antimicrobial spectrum and the action mechanism, antimicrobial agents are classified as bacteriostatic agents and bactericides, fungistatic agents and fungicides, etc. Important representatives of these groups are, for example, benzalkonium chlorides, alkylaryl sulfonates, halophenols and phenol mercuric acetate, wherein these compounds can also be totally dispensed with.

The agents can comprise additional antioxidants in order to prevent undesirable changes to the detergents and cleansing agents and/or the treated fabric surfaces caused by oxygen and other oxidative processes. This class of compounds includes, for example, substituted phenols, hydroquinones, pyrocatechols and aromatic amines as well as organic sulfides, polysulfides, dithiocarbamates, phosphites and phosphonates.

An increased wear comfort can result from the additional use of antistats. Antistats increase the surface conductivity and thereby allow an improved discharge of built-up charges. Generally, external antistats are substances with at least one hydrophilic molecule ligand and provide a more or less hygroscopic film on the surfaces. These mainly interface active antistats can be subdivided into nitrogen-containing (amines, amides, quaternary ammonium compounds), phosphorus-containing (phosphoric acid esters) and sulfur-containing (alkyl sulfonates, alkyl sulfates) antistats. Lauryl (or stearyl) dimethyl benzyl ammonium chlorides are also suitable antistats for textiles or as additives to detergents, resulting in an additional finishing effect.

Rinse aids can also be employed for fabric care and to improve fabric properties such as a softer feel and lower electrostatic charging (increased wear comfort). The active principles in rinse aid formulations are "esterquats," quaternary ammonium compounds containing two hydrophobic groups, such as, for example, distearyl dimethyl ammonium chloride which, however, due to its inadequate biodegradability, is increasingly replaced by quaternary ammonium compounds that comprise ester groups in their hydrophobic groups as target break points for the biological degradation.

These types of "esterquats" with improved biodegradability can be obtained, for example, by the esterification of fatty acids with mixtures of methyldiethanolamine and/or triethanolamine and subsequent quaternization of the reaction products with alkylation agents by known methods. Dimethylol ethylene urea is also suitable as a finishing.

Silicone derivatives, for example, can be added to improve the water-absorption capacity, the wettability of the treated textiles and to facilitate ironing of the treated textiles. They additionally improve the final rinse behavior of the detergents or cleansing agents by their foam-inhibiting properties. Exemplary preferred silicone derivatives are polydialkylsiloxanes or alkylarylsiloxanes, in which the alkyl groups possess one to five carbon atoms and are totally or partially fluorinated. Preferred silicones are polydimethylsiloxanes that can be optionally derivatized and then be aminofunctional or quaternized, or possess Si—OH, Si—H and/or SiCl bonds. Further preferred silicones are the polyalkylene oxide-modified polysiloxanes, i.e. polysiloxanes that, for example, possess polyethylene glycols, as well as the polyalkylene oxide-modified dimethylpolysiloxanes.

Finally, according to the invention, UV absorbers can also be employed, which are absorbed on the treated textiles and improve the light stability of the fibers. Compounds which possess these desired properties are, for example, the efficient radiationless deactivating compounds and derivatives of benzophenone having substituents in position(s) 2- and/or 4. Also suitable are substituted benzotriazoles, acrylates that are phenyl-substituted in position 3 (cinnamic acid derivatives), optionally with cyano groups in position 2, salicylates, organic Ni complexes, as well as natural substances such as umbelliferone and the endogenous urocanic acid.

In the context of the invention, protein hydrolyzates, due to their fiber-care action, are further preferred active substances from the field of detergents and cleansing agents. Protein hydrolyzates are product mixtures obtained by acid-, base- or enzyme-catalyzed degradation of proteins (albumins). According to the invention, the added protein hydrolyzates can be of both vegetal and animal origin. Animal protein hydrolyzates are, for example, elastin, collagen, keratin, milk protein, and silk protein hydrolyzates, which can also be present in the form of their salts. According to the invention, it is preferred to use protein hydrolyzates of vegetal origin, e.g. soya, almond, rice, pea, potato and wheat protein hydrolyzates. Although it is preferred to add the protein hydrolyzates as such, optionally other mixtures containing amino acid or individual amino acids can also be added in their place, such as arginine, lysine, histidine or pyroglutamic acid. Likewise, it is possible to add derivatives of protein hydrolyzates, e.g., in the form of their fatty acid condensation products.

The non-aqueous solvents that according to the invention can also be added particularly include the organic solvents, of which only the most important can be mentioned here: Alcohols (methanol, ethanol, propanols, butanols, octanols, cyclohexanol), glycols (ethylene glycol, diethylene glycol), ethers and Glycol ethers (diethyl ether, dibutyl ether, anisole, dioxane, tetrahydrofuran, mono-, di-, tri-, polyethylene glycol ethers), ketones (acetone, butanone, cyclohexanone), esters (acetates, glycol esters), amides and other nitrogen compounds (dimethylformamide, pyridine, N-methylpyrrolidone, acetonitrile), sulfur-compounds (carbon sulfides, dimethyl sulfoxide, sulfolane), nitro-compounds (nitrobenzene), halogenated hydrocarbons (dichloromethane, chloroform, tetrachloromethane, tri-, tetrachloroethene, 1,2-dichloroethane, chlorofluorohydrocarbons), hydrocarbons (benzines, petroleum ether, cyclohexane, methylcyclohexane, decline, terpene-solvents, benzene, toluene, xylenes). Alternatively, instead of the pure solvent, their mixtures can also be added, which, for example, advantageously combine the solvent properties of different solvents. In the context of the present application, a particularly preferred solvent mixture of this type is, for example, commercial cleaning benzine, a suitable mixture of different hydrocarbons for dry-cleaning, preferably with a content of C12 to C14 hydrocarbons of more than 60 wt. %, particularly preferably above 80 wt. % and quite particularly preferably above 90 wt. %, each based on the total weight of the mixture, preferably with a boiling range of 81 to 110° C.

The invention claimed is:

1. A process for manufacturing multi-phase detergents or cleaning agents, comprising the steps of:

a) manufacturing a water-soluble or water-dispersible container;

b) filling the container with a first detergent or cleaning agent to form a first phase;

c) applying a liquid separation agent onto this first phase and hardening the separation agent to form a separation layer; and d) filling the container with a second detergent or cleaning agent to form a second phase.

2. The process according to claim 1, wherein the liquid separation agent is a solution or a suspension, whose solvent content is less than 80 weight percent.

3. The process according to claim 1, wherein the liquid separation agent is a melt, whose melting point is less than 150° C.

4. The process according to claim 1, wherein the liquid separation agent comprises an organic polymer.

5. The process according to claim 1, wherein the liquid separation agent comprises an inorganic or organic salt.

6. The process according to claim 1, wherein the content by weight of the separation agent, based on the total weight of the multi-phase detergent or cleaning agent that is packaged with a water-soluble or water-dispersible wrapping material forming the container is less than 10%.

7. The process according to claim 1, wherein the separation layer formed in step (c) has a thickness of between 1 and 1,000 μm.

8. The process according to claim 1, wherein the separation layer formed in step (c) is at least partially transparent or translucent.

9. The process according to claim 1, wherein at least one of the detergents or cleaning agents filled in steps (b) and (d) is a solid.

10. The process according to claim 1, wherein at least one of the detergents or cleaning agents filled in steps (b) and (d) is a liquid.

11. The process according to claim 1, wherein steps (c) and (d) are repeated.

12. The process according to claim 1, comprising an additional step (e) of sealing the filled container with a water-soluble film.

* * * * *